US008266871B1

(12) United States Patent
Stravitz

(10) Patent No.: US 8,266,871 B1
(45) Date of Patent: Sep. 18, 2012

(54) WASTE DISPOSAL DEVICES WITH ADVANCED CONTROL

(76) Inventor: David M Stravitz, New York, NY (US)

( * ) Notice: Subject to any disclaimer, the term of this patent is extended or adjusted under 35 U.S.C. 154(b) by 0 days.

(21) Appl. No.: 13/173,001

(22) Filed: Jun. 30, 2011

Related U.S. Application Data

(60) Provisional application No. 61/362,183, filed on Jul. 7, 2010.

(51) Int. Cl.
*B65B 7/12* (2006.01)

(52) U.S. Cl. ..... 53/370; 53/483; 53/567

(58) Field of Classification Search ..... 53/370, 53/567, 576, 577, 459, 483, 469
See application file for complete search history.

(56) References Cited

U.S. PATENT DOCUMENTS

| | | | |
|---|---|---|---|
| 2,946,474 | A | 7/1960 | Knapp |
| 4,470,220 | A | 9/1984 | Sudo |
| 4,576,252 | A | 3/1986 | Omata |
| 4,869,049 | A | 9/1989 | Richards et al. |
| 5,125,526 | A | 6/1992 | Sumanis |
| 5,444,877 | A | 8/1995 | Kumarasurier |
| 5,535,913 | A | 7/1996 | Asbach et al. |
| 5,590,512 | A | 1/1997 | Richards et al. |
| 5,794,277 | A | 8/1998 | Jones |
| 5,813,200 | A | 9/1998 | Jacoby |
| 6,024,238 | A | 2/2000 | Jaros |
| 6,128,890 | A | 10/2000 | Firth |
| 6,145,283 | A | 11/2000 | Noordenbos et al. |
| 6,170,240 | B1 | 1/2001 | Jacoby et al. |
| 6,370,847 | B1 | 4/2002 | Jensen et al. |
| 6,516,588 | B2 | 2/2003 | Jensen et al. |
| 6,561,055 | B1 | 5/2003 | Turk |
| 6,612,099 | B2 | 9/2003 | Stravitz |
| 6,626,316 | B2 | 9/2003 | Yang |
| 6,719,194 | B2 | 4/2004 | Richards |
| 6,804,930 | B2 | 10/2004 | Stravitz |
| 6,851,251 | B2 | 2/2005 | Stravitz |
| 7,114,314 | B2 | 10/2006 | Stravitz |
| 7,146,785 | B2 | 12/2006 | Stravitz |
| 7,316,100 | B2 | 1/2008 | Stravitz et al. |
| 7,374,060 | B2 | 5/2008 | Yang et al. |
| 7,434,377 | B2 | 10/2008 | Stravitz et al. |
| 7,503,152 | B2 | 3/2009 | Stravitz et al. |
| 7,503,159 | B2 | 3/2009 | Stravitz et al. |
| 7,617,659 | B2 | 11/2009 | Stravitz et al. |
| 7,708,188 | B2 | 5/2010 | Stravitz et al. |
| 7,712,285 | B2 | 5/2010 | Stravitz et al. |
| 7,963,414 | B1 | 6/2011 | Stravitz |

(Continued)

OTHER PUBLICATIONS

Analysis of Airborne Microorganisms from Biohazard Waste Containers, Sabrina S. Jedlicka et al., 2011.

*Primary Examiner* — Sameh H. Tawfik
(74) *Attorney, Agent, or Firm* — Brian Roffe

(57) ABSTRACT

Waste disposal device adapted to receive a waste-containing member includes a container defining a waste-receiving compartment having an opening, a lid connected to the container and having a first, closed position covering the opening of the container and a second, open position in which the opening is exposed, and a rotation mechanism arranged in the container to rotate the waste-containing member when present in the container. The rotation mechanism is arranged to rotate the waste-containing member upon closure of the lid. A switch mechanism enables opening movement of the lid to cause the rotation mechanism to rotate the waste-containing member or prevent the rotation mechanism from rotating the waste-containing member depending on a setting of the switch mechanism.

24 Claims, 45 Drawing Sheets

U.S. PATENT DOCUMENTS

| | | | |
|---|---|---|---|
| 2002/0038535 | A1 | 4/2002 | Jensen et al. |
| 2004/0020175 | A1 | 2/2004 | Stravitz |
| 2006/0237461 | A1 | 10/2006 | Chomik et al. |
| 2007/0157581 | A1 | 7/2007 | Webb et al. |
| 2010/0005759 | A1 | 1/2010 | Stravitz |
| 2010/0005762 | A1 | 1/2010 | Stravitz |
| 2010/0006712 | A1 | 1/2010 | Stravitz |

WASTE DISPOSAL DEVICES WITH ADVANCED CONTROL

CROSS-REFERENCE TO RELATED APPLICATION

This application claims priority of U.S. provisional patent application Ser. No. 61/362,183 filed Jul. 7, 2010, incorporated by reference herein.

FIELD OF THE INVENTION

The present invention relates generally to improvements to waste disposal devices and more specifically to waste disposal devices that enable enhanced control over a rotation mechanism that causes rotation of a twisting assembly that twists or untwists a bag or tubing extending through the twisting assembly.

The present invention also relates generally to waste disposal devices that include a manual control, e.g., a knob or slide mechanism, that provides the waste disposal device with two different operating states wherein opening of the lid, via a manually exerted force or via depression of a foot pedal, can either cause unwinding or untwisting of a knot or twist in the bag or tubing or not cause such untwisting or unwinding depending on the operating state of the waste disposal device.

The present invention also relates generally to waste disposal devices that enable viewing of the interior of the device and the state or condition of a bag of waste or tubing containing waste therein.

The present invention also relates generally to waste disposal devices that reduce outflow of potentially harmful bacteria and fungus from a waste-containing bag or tubing in the waste disposal device during opening of a lid thereof.

BACKGROUND OF THE INVENTION

Numerous waste disposal devices exist including those disclosed in U.S. Pat. Nos. 6,612,099, 6,804,930, 6,851,251, 7,114,314, 7,146,785, 7,316,100, 7,434,377, 7,503,152, 7,503,159, 7,617,659, 7,708,188 and 7,712,285, all of which are incorporated by reference herein. Additionally, innovative waste disposal devices are disclosed in U.S. patent application Ser. No. 12/637,252 filed Dec. 14, 2009, now U.S. Pat. No. 7,963,414, also incorporated by reference herein.

In addition, waste disposal devices are disclosed in U.S. patent application Ser. No. 12/172,715 filed Jul. 14, 2008, 12/172,758 filed Jul. 14, 2008, 12/172,793 filed Jul. 14, 2008 and 13/161,764 filed Jun. 16, 2011, as well as U.S. provisional patent application Ser. Nos. 61/366,221 filed Jul. 21, 2010, 61/362,159 filed Jul. 7, 2010, and 61/409,188 filed Nov. 2, 2010, all of which are incorporated by reference herein. Non-provisional applications of the '221 and '159 applications are being simultaneously filed, and have been assigned Ser. Nos. 13/172,976 and 13/172,968, respectively, and are incorporated by reference herein.

Some of these waste disposal devices include a twisting assembly arranged in a container to form a twist in a bag or tubing into which waste is inserted through a membrane associated with the twisting assembly. Automatic twisting of the bag or tubing is provided, e.g., upon closure of a lid that results in rotation of the twisting assembly through a gear-containing rotation mechanism. On the other hand, when the lid is opened, the same rotation mechanism prevents untwisting of the bag or tubing, thereby providing the advantage of maintaining a twist in the bag or tubing and sealing in odor from the deposited waste.

It has now been found by the inventor herein, and not believed to have been previously appreciated, that it would be desirable to couple the opening of the lid with untwisting or unknotting of the bag or tubing to better facilitate insertion of waste, without permanently altering the control of the rotation mechanism to provide for this ability, i.e., maintaining the ability of the opening of the lid to avoid untwisting of the bag or tubing. This thereby enables a user to have the ability to either untwist or not untwist the bag or tubing upon opening the lid.

OBJECTS AND SUMMARY OF THE INVENTION

An object of the present invention is to provide a waste disposal device that enables opening of the lid to untwist a bag or tubing to better facilitate insertion of waste while also providing the capability that opening of the lid avoids untwisting of the bag or tubing.

In order to achieve this object, in a most basic embodiment of a waste disposal device in accordance with the invention, there are thus two different operating states or conditions of the waste disposal device, one in which both opening and closing of the lid affect the twist or knot in the bag or tubing (the opening untwisting or unwinding the twist or knot and the closing twisting or winding the bag or tubing) and another one in which only the closing of the lid affects the twist or knot in the bag or tubing, i.e., causes twisting or winding the bag or tubing.

The former operating state is beneficial when it is desired to avoid contact with the bag or tubing since the person inserting the waste does not have to force the twist or knot open. In this case, a membrane, that engages with the bag or tubing and causes the formation or untwisting of a twist or knot in the bag or tubing, may be provided with a larger central aperture so that when the bag or tubing is untwisted or unknotted, there is a substantially open passage through which waste can be easily dropped into the interior of the bag or tubing without necessitating contact between the inserter's hand and the bag or tubing that may contain potentially harmful bacteria and fungus.

In order to achieve the foregoing object and others, a more specific embodiment of a waste disposal device in accordance with the invention is adapted to receive a waste-containing member and includes a container defining a waste-receiving compartment having an opening, a lid connected to the container and having a first, closed position covering the opening of the container and a second, open position in which the opening is exposed, and a rotation mechanism arranged in the container to rotate the waste-containing member when present in the container. The rotation mechanism is arranged to rotate the waste-containing member upon closure of the lid. A switch mechanism enables, when in one position, state, condition or setting, opening movement of the lid to cause the rotation mechanism to rotate the waste-containing member or, when in another position, state, condition or setting, prevents the rotation mechanism from rotating the waste-containing member.

The switch mechanism may comprise a rotatable toggle mechanism that has one or more locking members that selectively engage with and trap a gear shaft associated with one or more gears of the rotation mechanism, preventing its radial movement out of engagement with other gears of the rotation mechanism, with such engagement causing the rotation mechanism to rotate the waste-containing member. The toggle mechanism may include a rotatable knob accessible from an exterior of the container and a lever mechanism controlled by the knob. The lever mechanism includes a shaft and the locking member(s) fixed thereto. Each locking member includes a slot designed to receive and retain the gear shaft to thereby prevent radial movement of the shaft and thus one or more of the gears connected thereto. By preventing radial movement of the shaft (not rotation of the shaft), the shaft is fixed in a gear coupling between a gear attached to the lid and a gear attached to a twisting mechanism through which the waste-containing member passes. This twisting mechanism being rotatable by the rotation mechanism to cause the rotation of the waste-containing member.

Alternatively, the switch mechanism may comprise a slide member that has one or more trapping portions that selectively engage with and trap the gear shaft preventing its radial movement out of engagement with other gears, with such engagement causing the rotation mechanism to rotate the waste-containing member.

Any of the waste disposal devices described above may include a foot pedal assembly that causes both opening of the lid when depressed and closure of the lid when the pressing force is removed. In combination with the switch mechanism in the position, state, condition or setting wherein it causes both twisting of the bag or tubing upon closure of the lid and untwisting of the bag or tubing upon opening of the lid, this provides a completely hands-free use of the waste disposal device (manual effort only being required to drop the waste into the opened bag or tubing).

On the other hand, some embodiments do not require a foot pedal assembly and may be opened instead by the user lifting up the lid. Lifting up the lid may cause the untwisting of the bag or tubing, or not, depending on the position, state, condition or setting of the switch mechanism. The lid is also closed, either by manual force or by a spring provided in the waste disposal device that returns to its original state when the lifting force on the lid is removed.

A method for controlling migration of odor and bacteria through an opening of a bag or tubing in a container of a waste disposal device in accordance with the invention includes connecting a lid to the container, the lid having a first, closed position and a second, fully open position, coupling a foot pedal assembly to the lid such that depression of a foot pedal of the foot pedal assembly causes opening of the lid and when the pressing force is removed, the lid closes, and arranging a twisting assembly in the container to engage with and twist or untwist the bag or tubing. The devices prevents passage of odor and bacteria from an interior of the bag or tubing through the opening of the bag and/or prevent suction of odor and bacteria from the bag or tubing when the lid is moved from its first position to its second position because the container has a setting (via one of the switch mechanisms described above) wherein the twisting assembly twists the bag or tubing during closure of the lid and unwinds or untwists a knot or twist in the bag or tubing during opening of the lid. As such, during an initial stage of opening of the lid while the lid is still over the knot or twist, the knot or tubing is unwound or untwisted thereby opening a seal of the bag or tubing while the bag or tubing is covered by the lid.

In a preferred embodiment, the twisting assembly has a membrane with a large aperture through which the bag or tubing passes such that when the bag or tubing is unwound or twisted, the opening into the bag or tubing is unobstructed. This provides contact-free insertion of waste into the bag or tubing through the unobstructed opening is possible, which is especially important when disposing of potentially infectious medical waste.

BRIEF DESCRIPTION OF THE DRAWINGS

The invention, together with further objects and advantages thereof, may best be understood by reference to the following description taken in conjunction with the accompanying drawings, wherein like reference numerals identify like elements, and wherein.

DETAILED DESCRIPTION OF THE INVENTION

Figure 1:
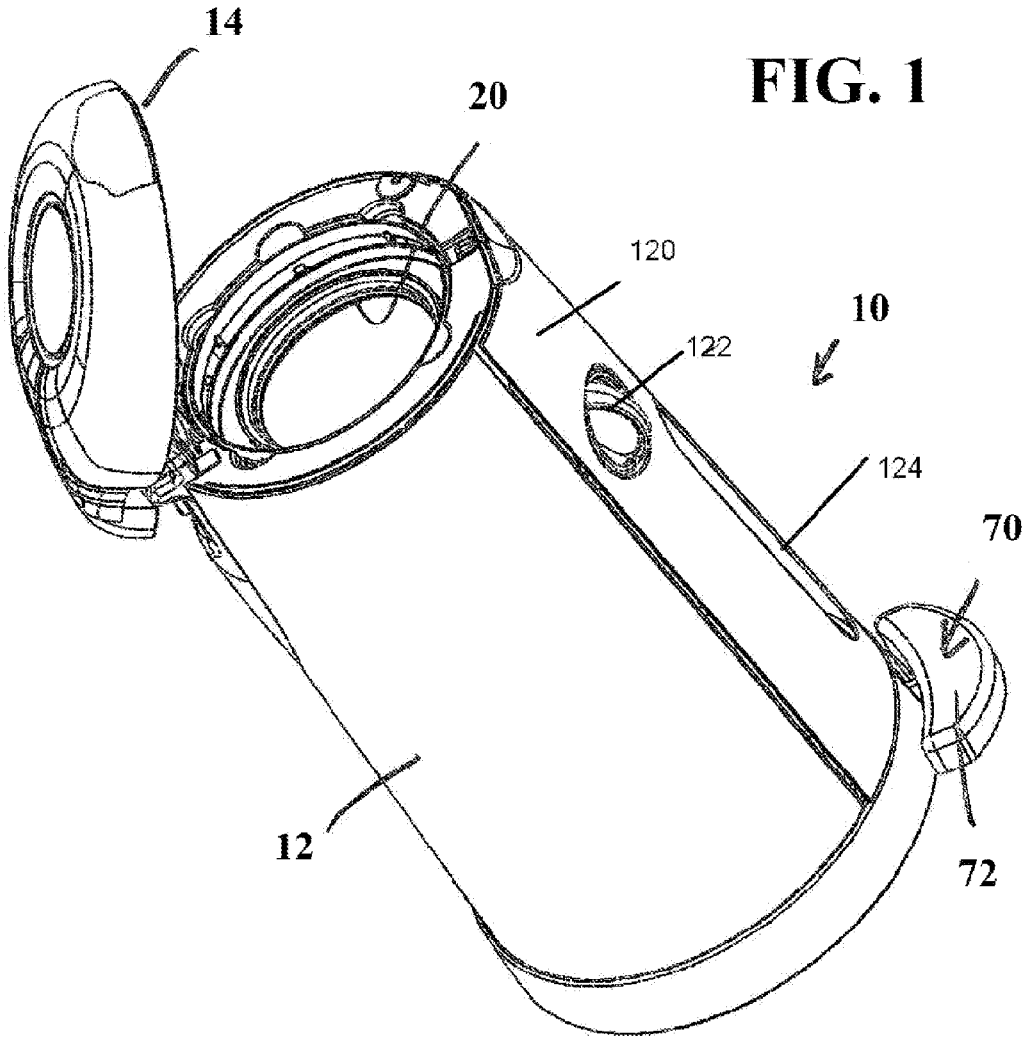
FIG. 1 is a perspective view of a waste disposal device in accordance with the invention shown without a membrane.

Referring to the accompanying drawings wherein like reference numbers refer to the same or similar elements, a first embodiment of a waste disposal device 10 in accordance with the invention is shown in FIG. 1. Waste disposal device 10 in accordance with the invention is an improvement of the waste disposal device shown in U.S. patent application Ser. No. 12/637,252, filed Dec. 14, 2009 now U.S. Pat. No. 7,963,414, incorporated by reference herein and to the extent parts thereof are not identified nor elaborated upon herein, the disclosure of these parts in the '252 application is incorporated by reference herein, along with the application in its entirety.

Figure 2:
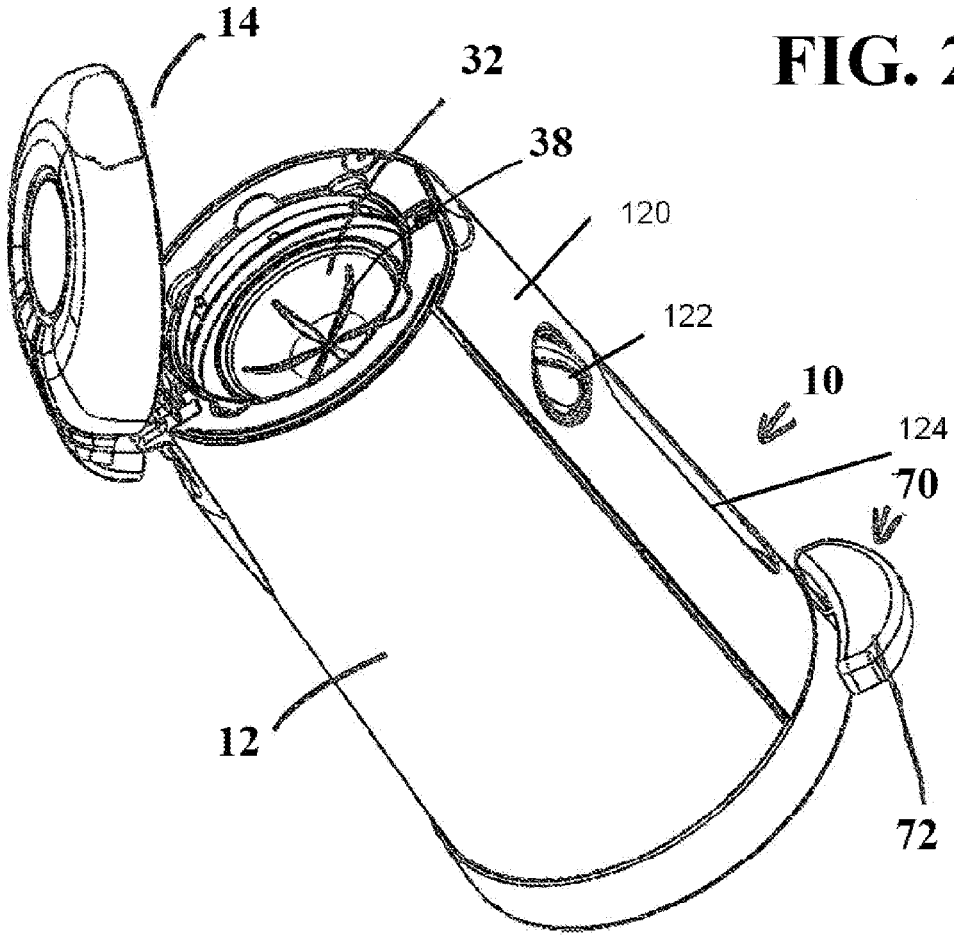
FIG. 2 is another perspective view of the waste disposal device shown in FIG. 1 with a membrane.
Figure 3:
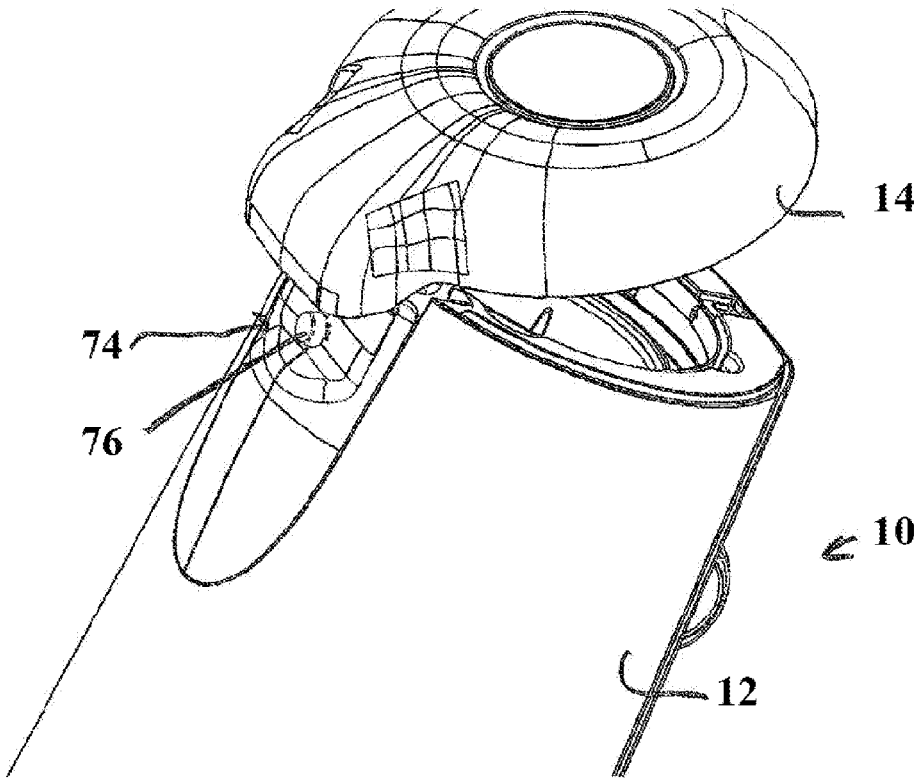
FIG. 3 is a rear perspective view of the waste disposal device shown in FIG. 1.

Waste disposal device 10 (see, e.g., FIGS. 1 and 2 in which it is shown in its entirety) includes a substantially cylindrical container 12 having an outer wall and a base arranged at the lower end region of the outer wall, and which defines a waste-receiving compartment. A lid 14 (see, e.g., FIGS. 1 and 2) is pivotally connected to the outer wall so as to be movable between an open position in which a waste insertion opening leading to the waste-receiving compartment is exposed to enable insertion of waste into the container 12 and a closed position in which the lid 14 overlies and closes the waste insertion opening.

Figure 8:
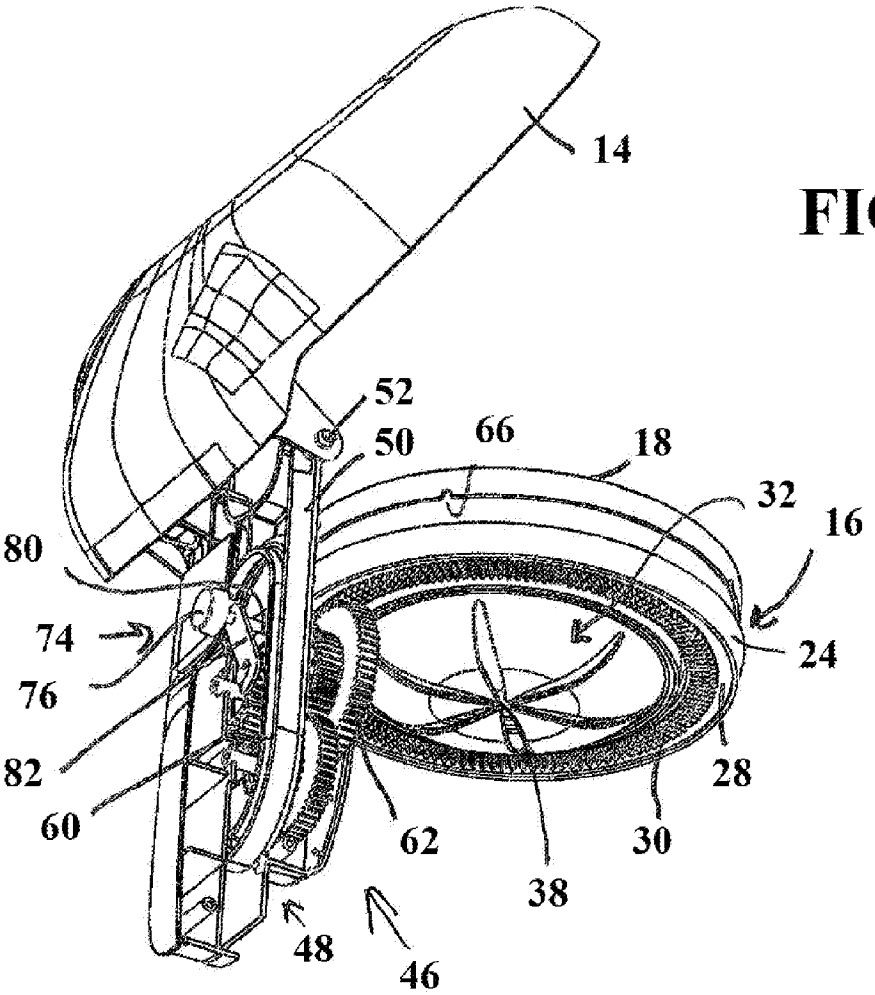
FIG. 8 is a perspective view showing the switch mechanism in the first position.

A general feature of waste disposal device 10 is that there is rotation of a twisting mechanism 16 shown in FIGS. 8-10 which engages with tubing or a bag, hereinafter referred to as a waste-containing member 94 (see, e.g., FIGS. 15 and 16), relative to a stationary support, i.e., an annular rim 18 (see FIGS. 8-10, 15 and 16), which supports or retains the waste-containing member 94 into which the waste is placed to thereby cause the formation of a twist or knot 96 in the waste-containing member 94. Rotation of this waste-containing member 94 or the twisting mechanism 16 thereof would occur after insertion of waste to thereby form a twist or knot 96 above the inserted waste 98 and inhibit release of odors from the waste 98. Rotation of this waste-containing member 94 or the twisting mechanism 16 thereof may also occur before insertion of waste to thereby untwist a previously formed twist to enlarge the waste insertion opening for a subsequent waste insertion.

Figure 15:
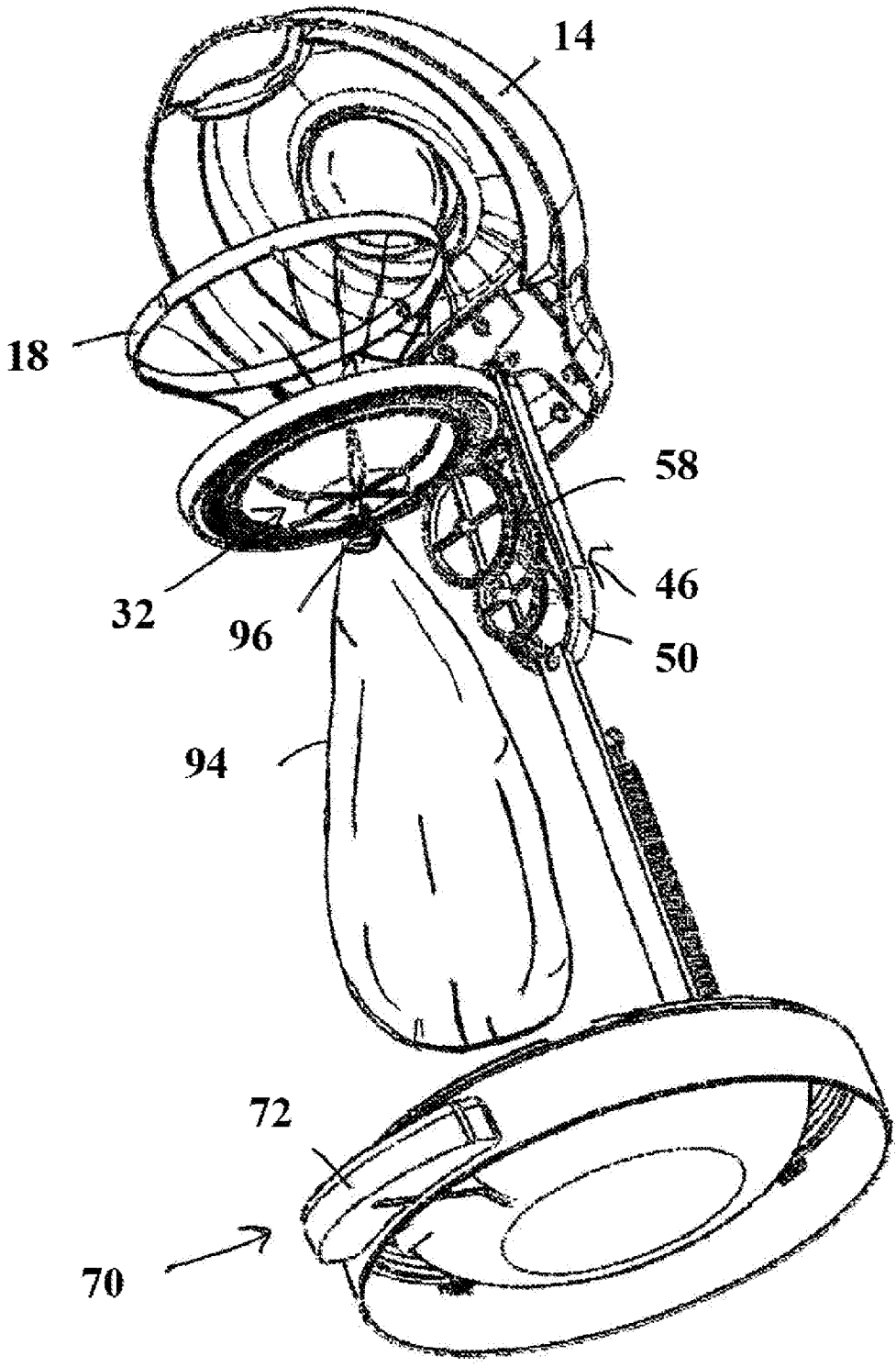
FIG. 15 is a view of the waste disposal device with the container removed and showing a bag attached to the support member.
Figure 16:
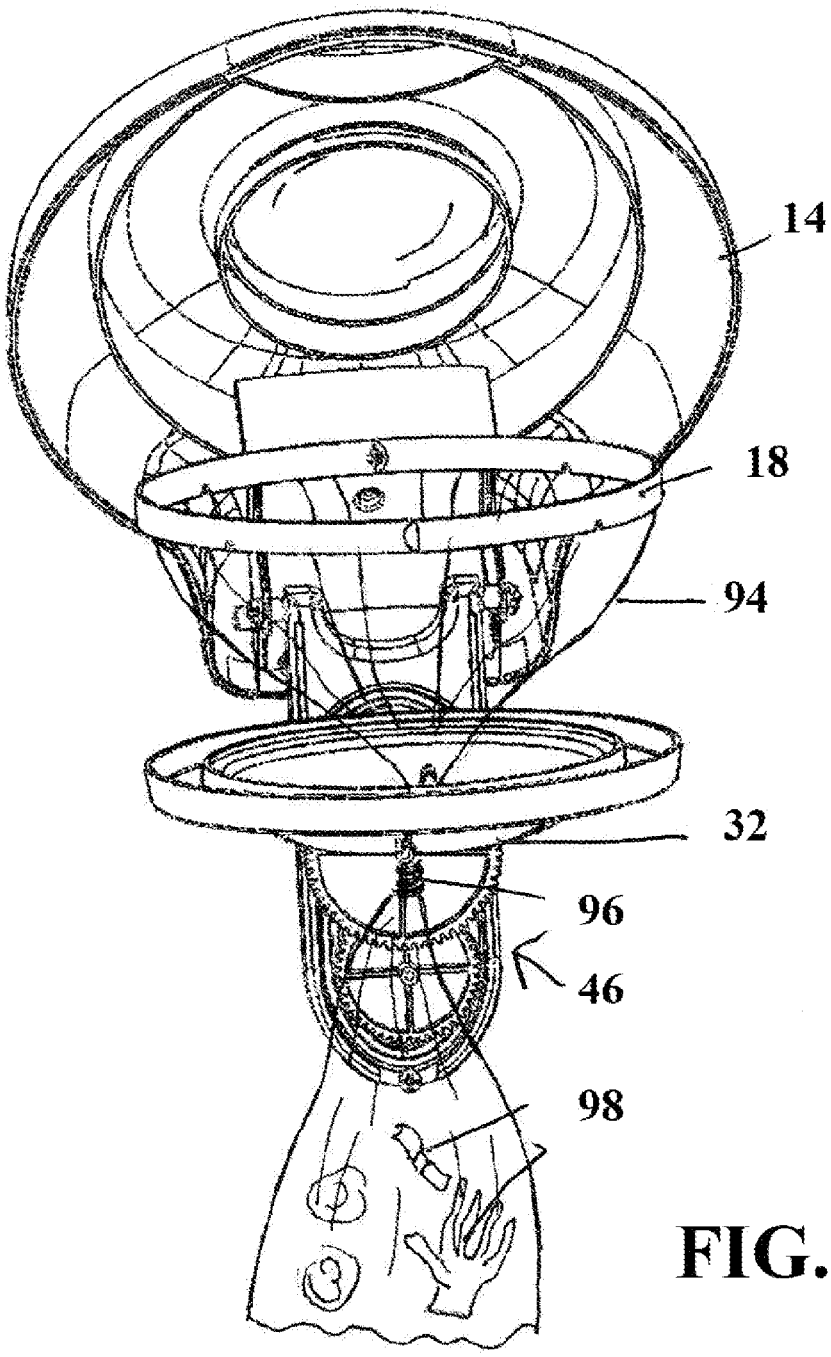
FIG. 16 is another view of the waste disposal device with the container removed and showing a bag attached to the support member.

FIGS. 15 and 16 also show the annular rim 18, or annular ring, affixed to the waste-containing member 94, which as shown is a bag containing both medical waste and diapers, and the like. The annual rim 18 sits on its side in the container 12, which adds more stacking strength and repels deflection. When the bag is full, the annular rim 18, which may be made of two parts pivotable together, folds onto itself, i.e., the outside half member is larger than the inside half member and the half members are brought together in a nesting relationship, to form an odor barrier seal as well as a convenient handle to carry the waste away safely and pleasantly. The bag may be substantially the same diameter as the annular rim 18, or a larger bag diameter is welded, fastened or otherwise attached to a smaller rim or ring. The bag may be adhered to the interior and/or exterior surface of the annular rim 18, as well as the bag may envelop the annular rim in its entirety. In the latter case, the bag would wrap around the rim and then be fastened (sealed) to itself.

Figure 11:
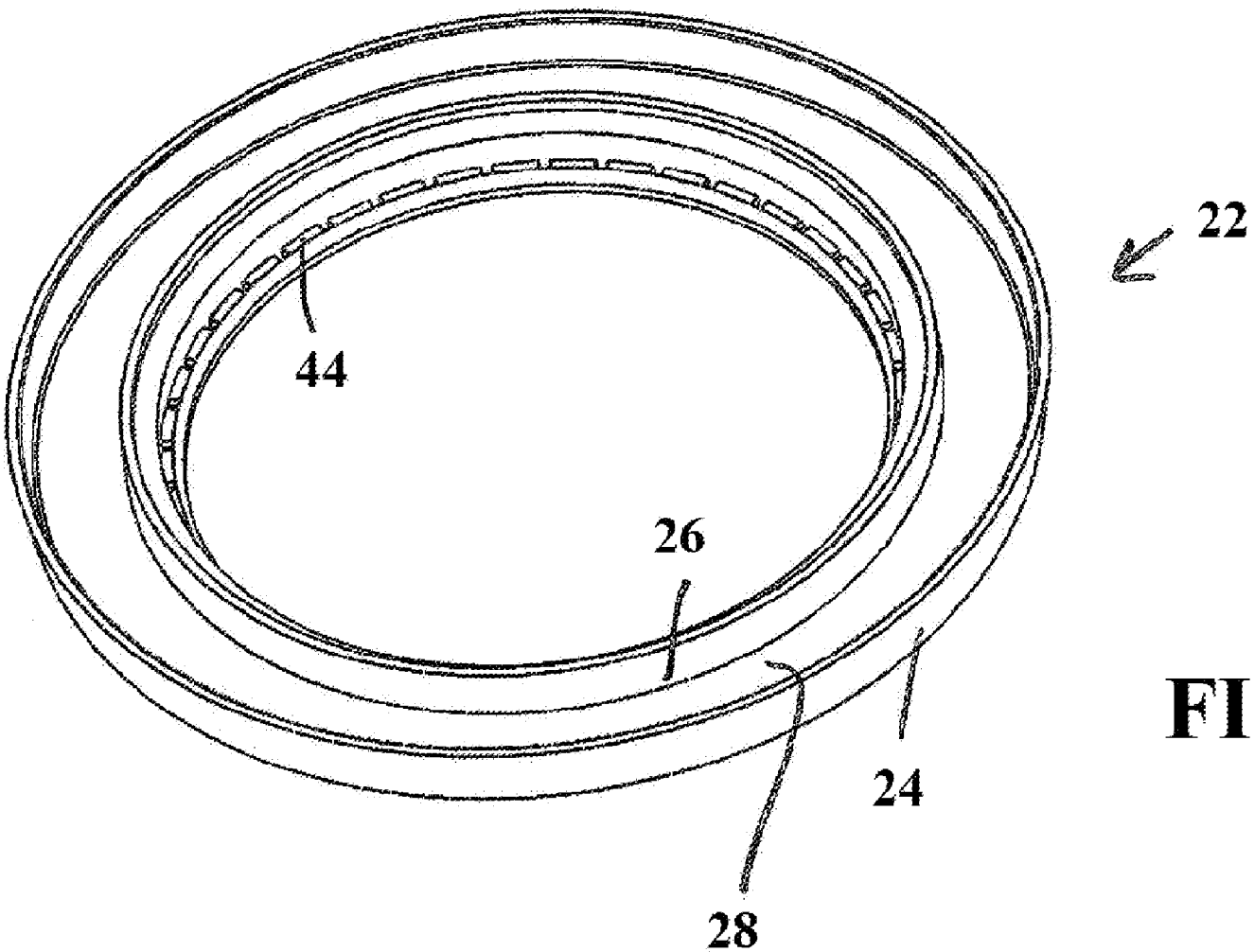
FIG. 11 is a perspective view of a twisting member in the waste disposal device in accordance with the invention.

To implement this technique, the twisting mechanism 16 is movably seated on a support flange 20 of the container 12 shown in FIG. 1 and may have any of several constructions known in the prior art. One such twisting mechanism 16 includes a twisting member 22 having a substantially tubular outer wall 24, a substantially tubular inner wall 26, a substantially planar bottom support wall 28 (see FIG. 11) and a circular gear rim 30 formed on the underside of the bottom support wall 28 and on which projections are formed. The bottom support wall 28 may or may not be contiguous between the outer and inner walls 24, 26 and apertures may be formed therein. The gear rim 30 and its projections may be formed integral or unitary with the twisting member 22 or separate therefrom and then attached thereto.

The twisting mechanism 16 also includes a grasping member such as a membrane generally referred to by reference number 32 and more specifically by reference numbers 32A, 32B, 32C" (in any one of the various shapes shown in FIGS.

Figure 12A:
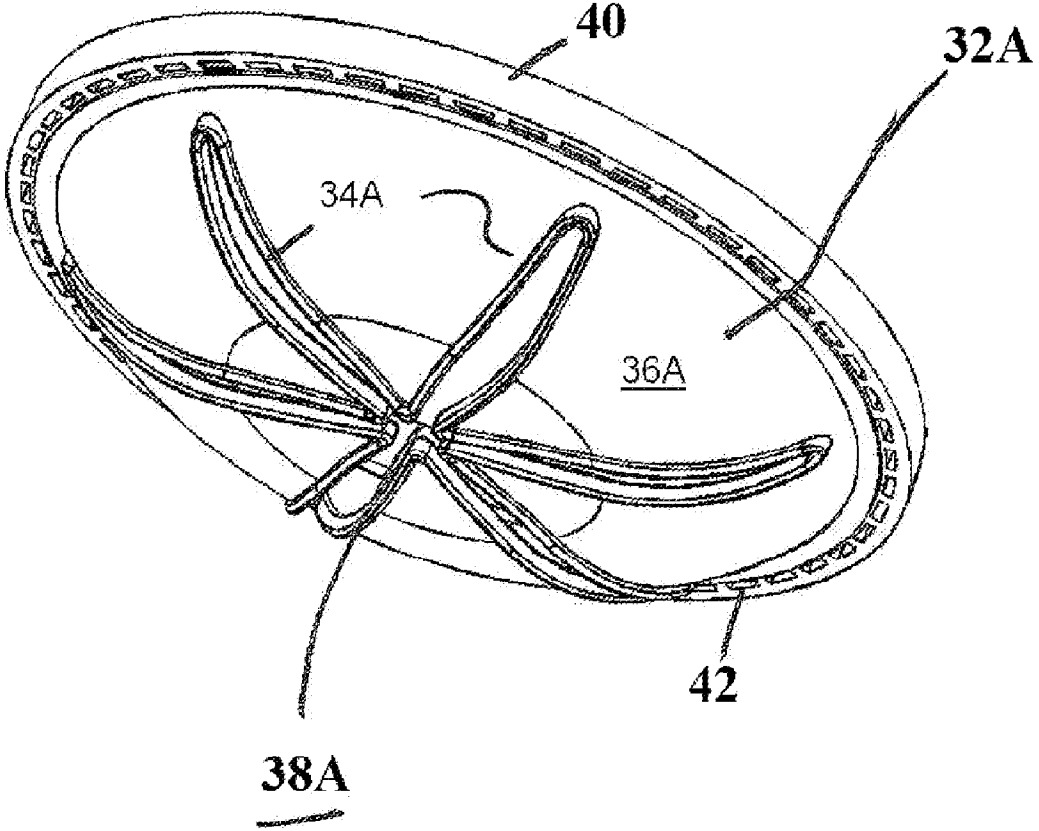
FIGS. 12A and 12B are perspective views of a first embodiment of a membrane in the waste disposal device in accordance with the invention.
Figure 13B:
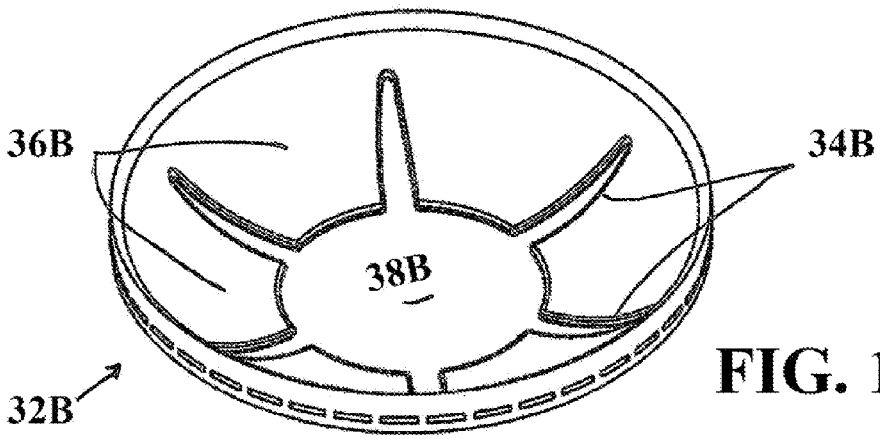
FIGS. 13A and 13B are perspective views of a second embodiment of a membrane in a waste disposal device in accordance with the invention.
Figure 13A:
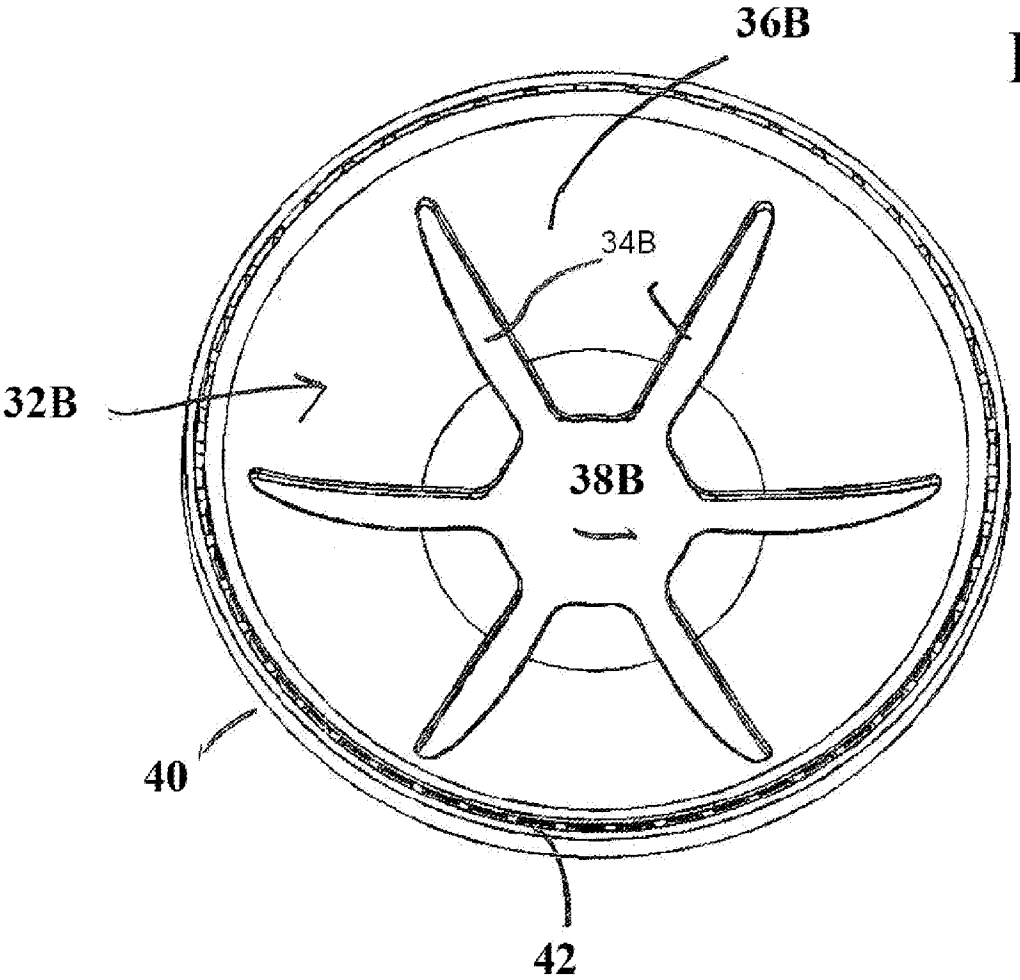

12A, 12B, 13A, 13B and 38) arranged to engage with waste-containing member 94 (shown best in FIGS. 12A and 13A). When the twisting mechanism 16 is rotated in one direction, the engagement of the membrane 32, 32A, 32B, 32C with the waste-containing member 94 causes the waste-containing member to be twisted, i.e., form a twist or knot 96 in the waste-containing member 94 and when the twisting mechanism 16 is rotated in the opposite direction, the engagement of the membrane 32, 32A, 32B, 32C with the waste-containing member 94 causes the waste-containing member 94 to be untwisted, i.e., untwist a previously formed twist or knot 96 in the waste-containing member 94 (see FIGS. 15 and 16).

Engagement of the waste-containing member 94 with the membrane 32, 32A, 32B, 32C" arises since the waste-containing member 94 passes through one or more slots, generally referred to by reference number 34 and more specifically by reference numbers 34A, 34B, 34C (see FIGS. 12A, 12B, 13A, 13B and 38) between fingers generally referred to by reference numbers 36 and more specifically by references numbers, 36A, 36B, 36C (see FIGS. 12A, 12B, 13A, 13B and 38) of the membrane 32, 32A, 32B, 32C (see FIGS. 12A, 12B, 13A, 13B and 38). The membrane 32, 32A, 32B, 32C includes an aperture generally referred to by reference number 38 and more specifically by reference numbers 38A, 38B and 38C (see FIGS. 2, 8, 9, 12A, 12B, 13A, 13B and 38) through which the waste-containing member 94 passes. Note that the waste-containing member 94 may pass through the aperture 38, 38A, 38B, 38C only one slot 34, 34A, 34B, 34C, or only partially through one slot 34, 34A, 34B, 34C, or only partially through two or more slots 34, 34A, 34B, 34C, and/or only through the center aperture 38, 38A, 38B, 38C at the intersection of the slots 34, 34A, 34B, 34C, and the exact manner depends on the actual use of the waste disposal device 10.

Membrane 32, 32A, 32B, 32C may be made of thermoplastic material, such as polypropylene elastomer, as well as silicone, rubber and the like.

Figure 12B:
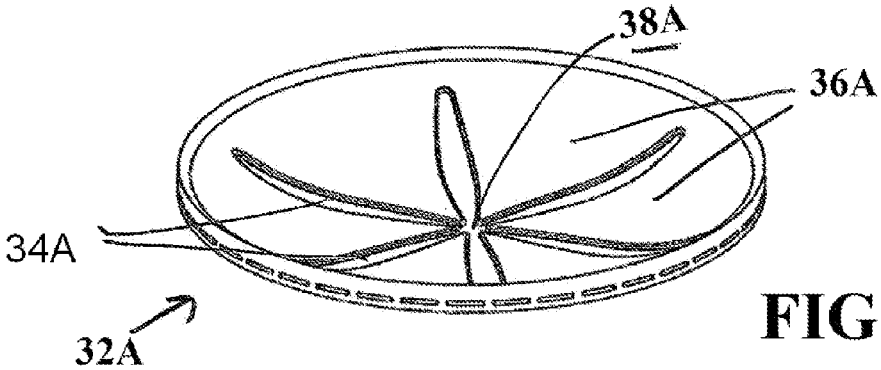

As to more specific details, FIGS. 12A and 12B show an embodiment of the membrane 32A, wherein the central aperture 38A is small whereas FIGS. 13A and 13B show a membrane 32B, with a larger central aperture 38B. The particular membrane used may depend on the type of waste products, e.g., larger waste products such as adult incontinence diapers may require the membrane 32B with the larger aperture 38B, as well as for "Hands Free" applications while small medical waste products such as non-sharp disposables and the like, may be better suited for the membrane 32A with the smaller aperture 38A. Of course, the selection of which membrane 32, 32A, 32B, 32C to use is entirely up to the user. It is envisioned however, that multiple and different membranes may be provided for use with all of the components of the waste disposal devices 10 remaining the same. Indeed, a kit may be sold with the waste disposal device 10 and multiple membranes, with instructions on which to use for particular waste. The user can then interchange the membrane depending on when they are using the waste disposal device for whichever type of waste.

Figure 38:
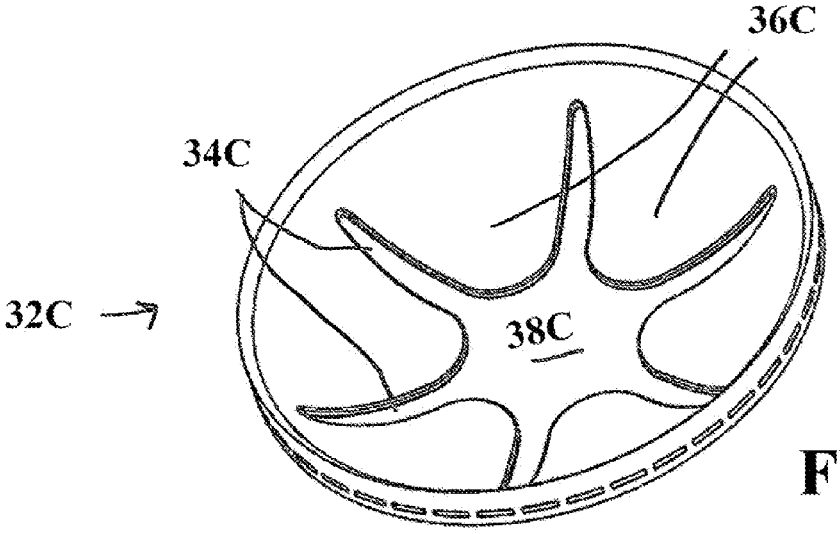
FIG. 38 shows another membrane for use in a waste disposal device in accordance with the invention.

In general, a membrane with a larger aperture (as shown in FIGS. 13A, 13B and 38) would be best suited for "hands-free" medical waste applications, and possibly, optionally, for adult incontinence diapers. A membrane with a smaller aperture (as shown in FIGS. 12A and 12B), is more likely to be used for baby diapers and possibly adult incontinence products. The reason for the larger opening is when the unwinding condition takes place, the doctor, nurse, hospital attendant or other medical personnel that deals with blood pathogens, can simply drop the medical waste into the (large) opening without touching the bag and thereby avoid getting contaminated or infected.

This is a very important advantage of a waste disposal device in accordance with the invention, especially when used with a membrane having a large aperture for disposing of potentially infectious medical waste. By setting the waste disposal device to unwind or untwist the bag or tubing when opening the lid, i.e., effected via depression of the foot pedal, the bag or tubing is open and easily facilitates insertion of medical waste without contact of the inserter with the bag or tubing. This is thus truly a hands-free system.

For children's diapers and non-medical waste, the waste disposal device can use a membrane with a small or large aperture because the user can either insert each waste item in the knotted or un-knotted position of the bag or tubing. Like prior inventions by the inventor herein, inserting the waste item into the knotted film causes unwinding of the knot or twist and allows the waste inserter to pass the waste into the bag, while keeping the smell to a minimum. Unwinding is, therefore, best when the waste inserter does not want to be in physical contact with any contamination that can harm humans.

For adult diapers, a membrane with a larger aperture would preferably be used, since the waste items would be somewhat large and the larger aperture would ease insertion of the adult diapers into the bag or tubing, but other membranes may of course be used. In fact, none of the uses of the membranes and waste disposal devices described herein are intended to limit the application of the membranes and waste disposal devices including the same and any disclosed waste disposal device and membrane may be used for any purpose, whether disclosed herein or not.

Referring back to FIG. 13B, the membrane 32B in this embodiment includes concave fingers 36B that have twelve points (two on each finger 36B) that could engage with the waste-containing member 94 which may be a bag or tubing, also referred to by reference numeral 94. On the other hand, the membrane 32C in FIG. 38 includes convex fingers 36C that engage the bag or tubing 94 with six broad radius points, one on each finger 36C.

Figure 39:
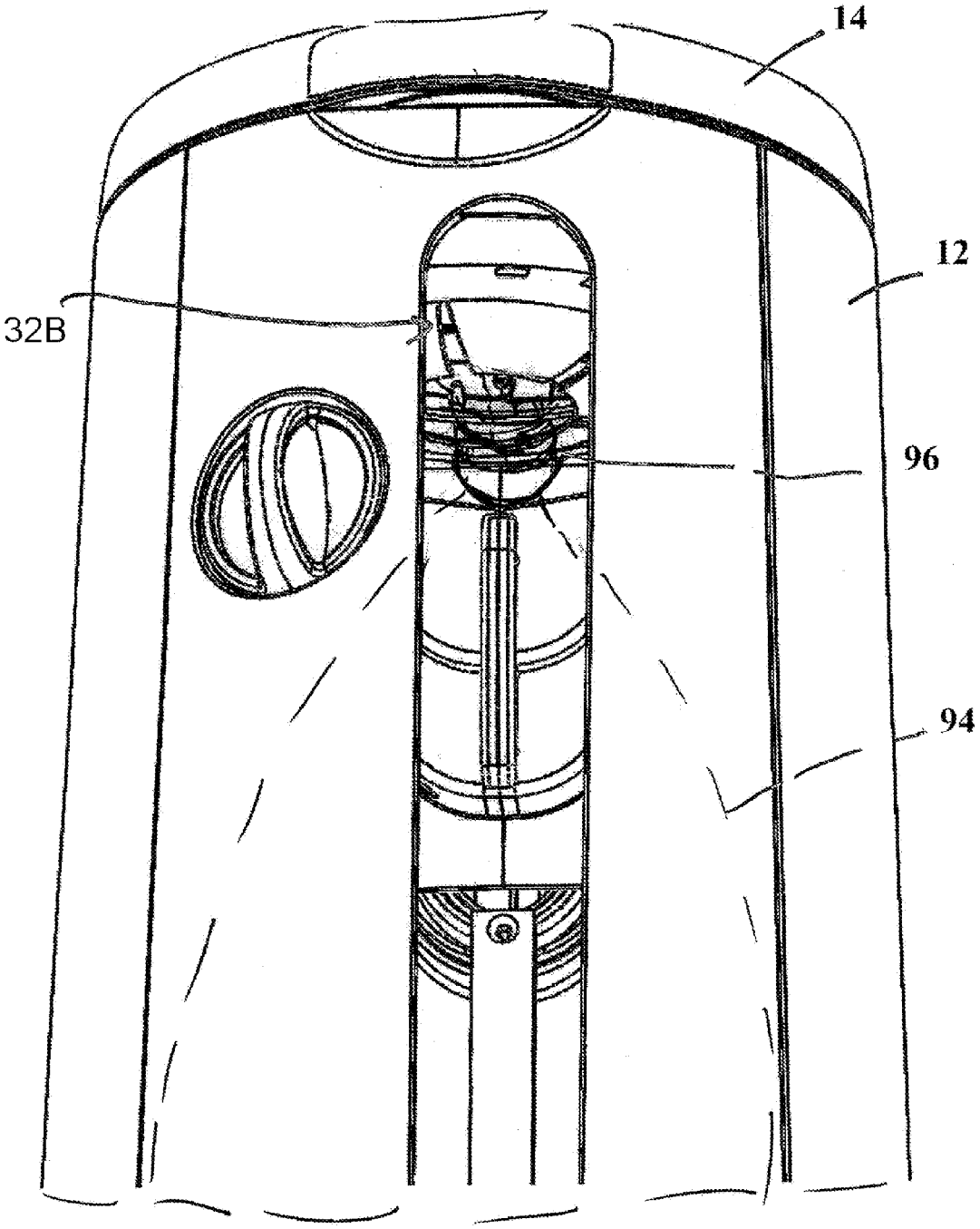
FIG. 39 shows a waste disposal device with the membrane shown in FIG. 13B taken through a transparent window.

Referring now to FIGS. 39-44, these illustrations show waste disposal devices with different membranes and a bag or tubing 94. FIG. 39 shows a waste disposal device with membrane 32B (see FIGS. 13A and 13B), one with a larger aperture that is especially useful when hands-free disposal of medical waste or disposal of adult diapers or other large waste items is sought.

Figure 40:
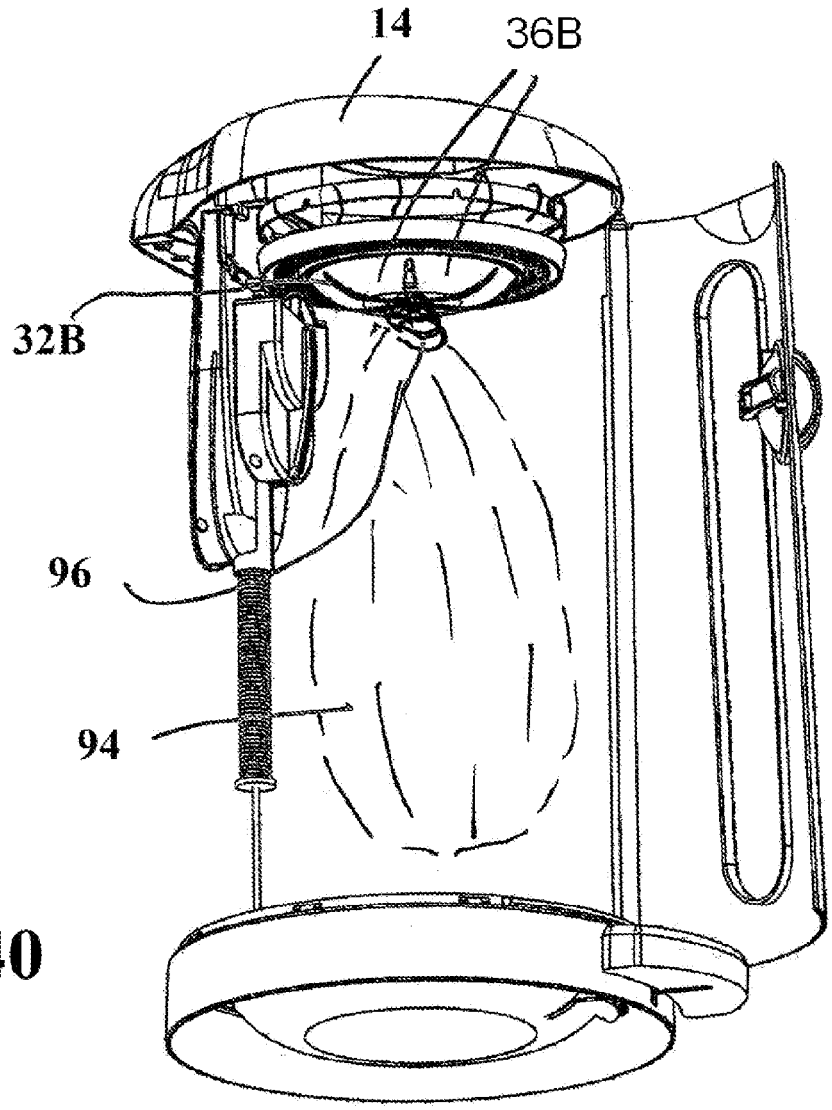
FIG. 40 shows a waste disposal device with the membrane shown in FIG. 12B with portions of the surrounding pail removed.

FIG. 40 shows a waste disposal device with membrane 32A (see FIGS. 12A and 12B) and a bag or tubing 94, which would be particularly suited for use with small, non-medical waste of children's diapers.

Figure 41:
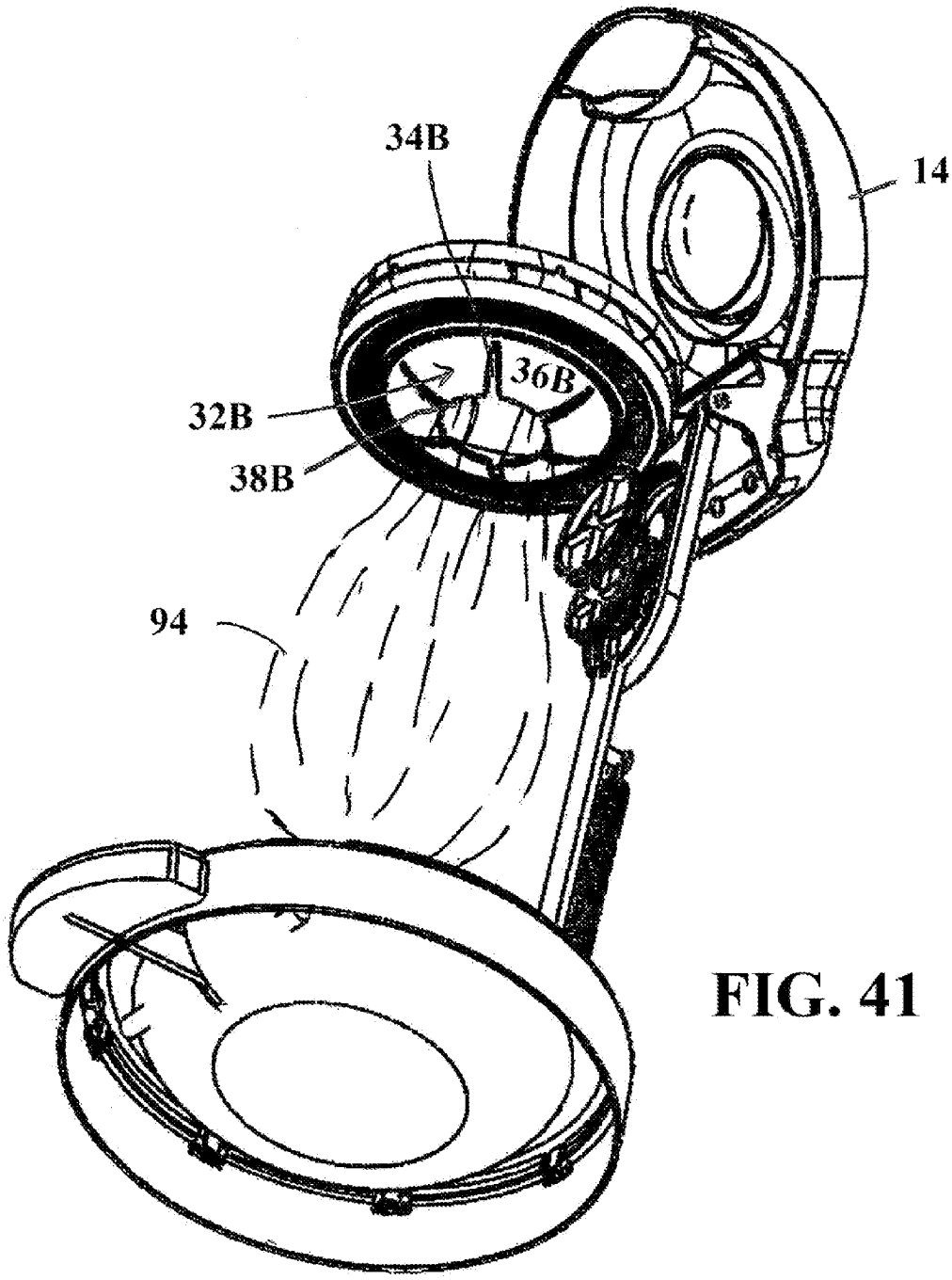
FIG. 41 shows a waste disposal device with the membrane shown in FIG. 13B with the surrounding pail removed and the bag or tubing without a knot or twist.

FIG. 41 shows the waste disposal device of FIG. 39 with the bag or tubing 94 in an unwound or untwisted state so that the bag or tubing 94 clearly defines an unobstructed passage through the aperture 38B in the membrane 32B to enable insertion of waste without contacting the inner surfaces of the bag or tubing 94.

Figure 42:
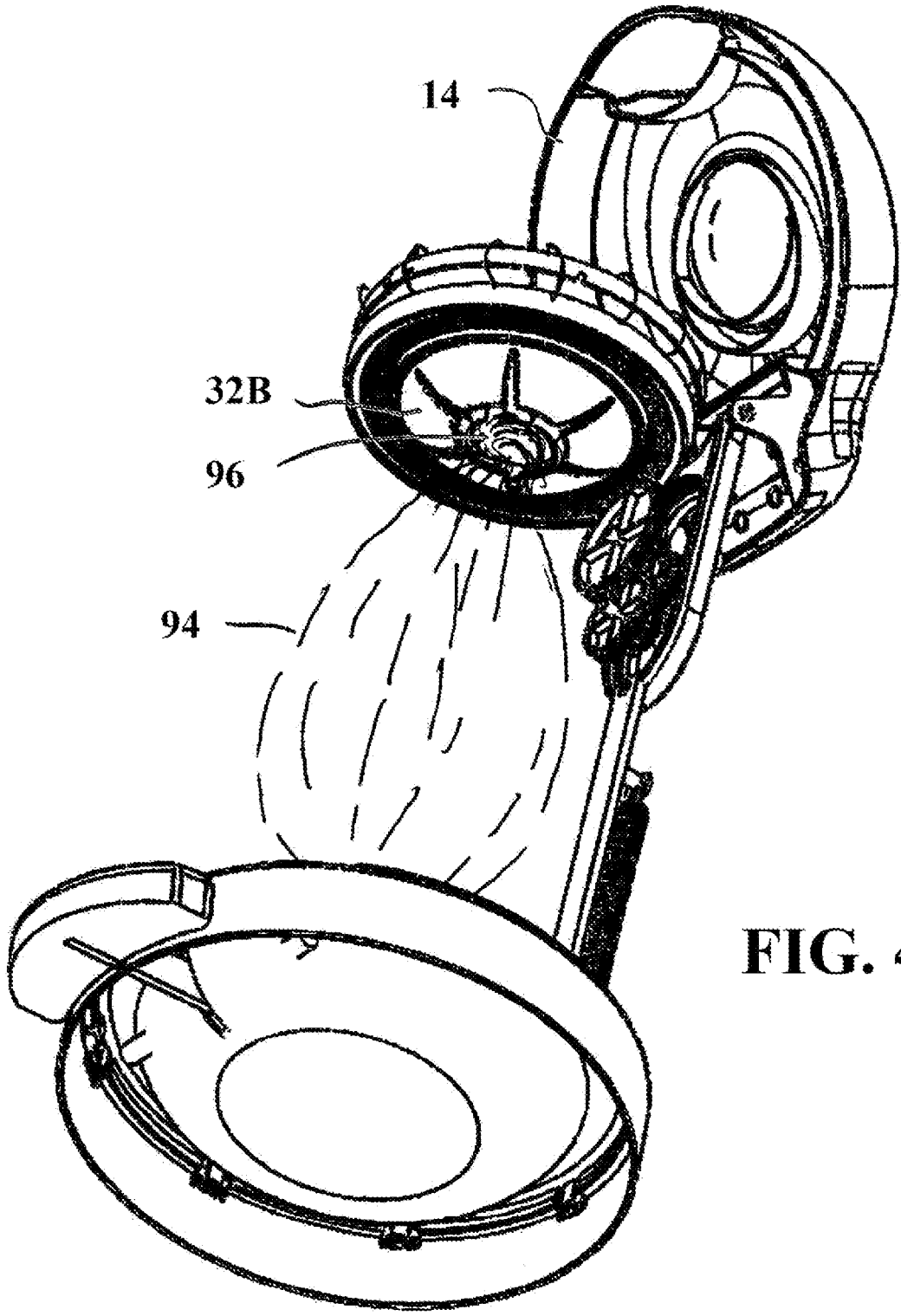
FIG. 42 shows a waste disposal device with the membrane shown in FIG. 13B with the surrounding pail removed and the bag or tubing with a knot or twist.
Figure 43:
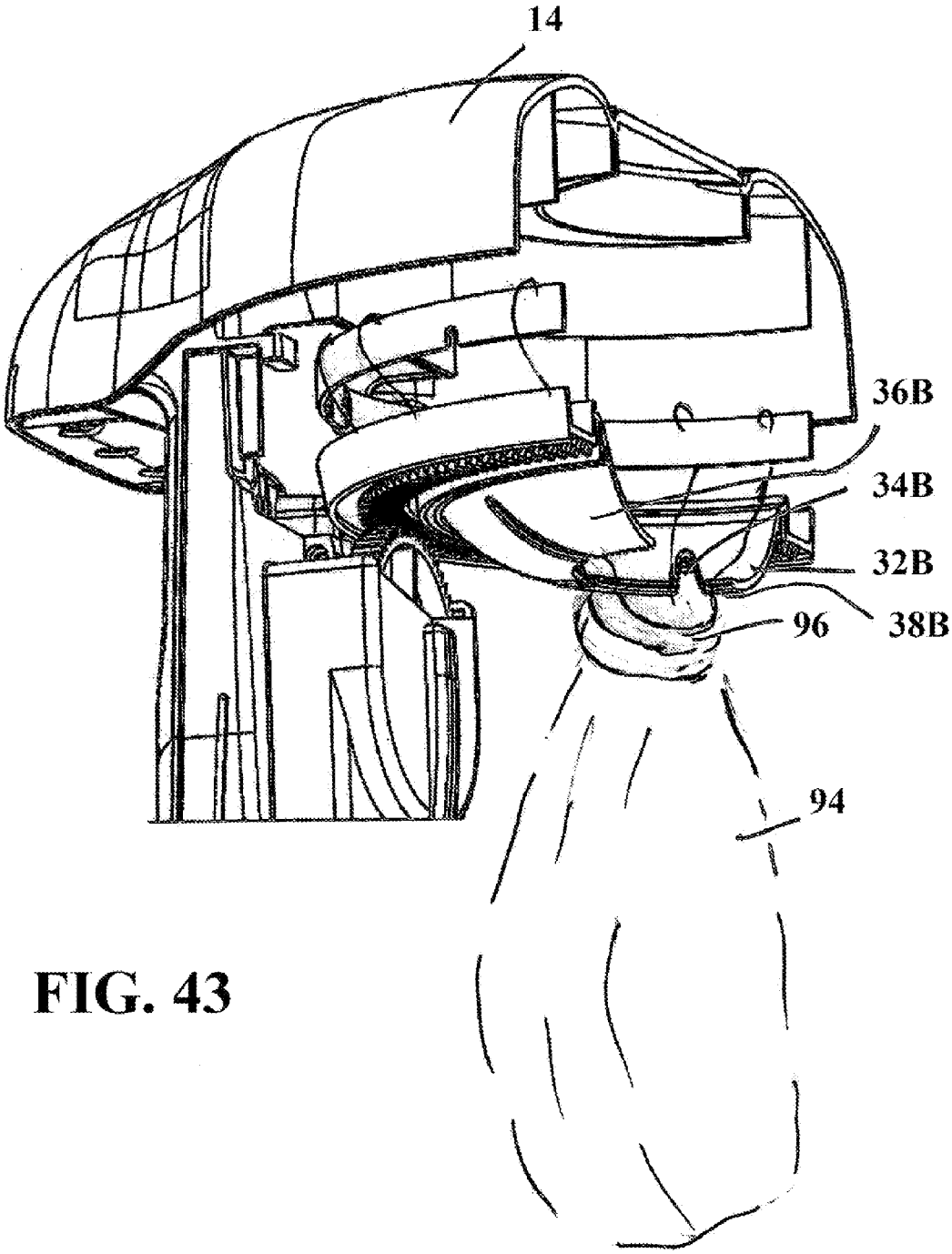
FIG. 43 is an enlarged view of the waste disposal device shown in FIG. 42.

FIG. 42 shows the waste disposal device of FIG. 39 with the bag or tubing 94 in a wound or twisted state so that the bag or tubing 94, i.e., showing knot or twist 96 which is formed in the vicinity of the aperture 38B FIG. 43 is a partially broken-away view of the waste disposal device shown in FIG. 42 more clearly showing the knot or twist 96.

Figure 44:
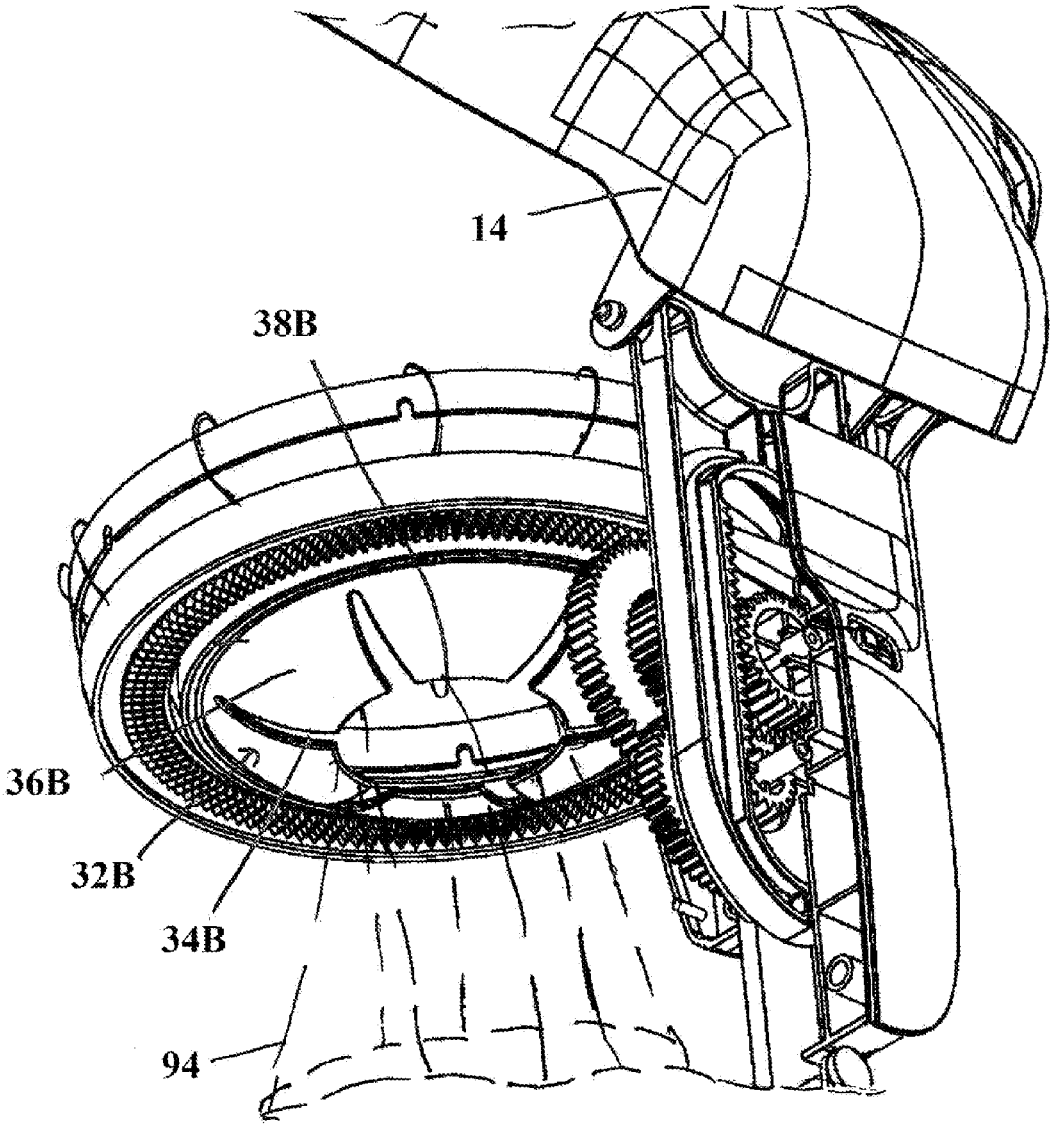
FIG. 44 is an enlarged view of the waste disposal device with the membrane shown in FIG. 41.

FIG. 44 is a partially broken-away view of the waste disposal device shown in FIG. 41 more clearly showing the unobstructed passage through the large aperture 38B in the membrane 32B to enable hands-free and contact-free insertion of waste into the bag or tubing 94.

An aperture, through which the waste-containing member 94 passes, may be formed in the membrane 32A by other means, including, barely discernible small slits extending from a frame supporting the outer edge of the membrane 32A to a center. The membrane 32A may be formed and constructed in different ways and is not limited to the presence of six fingers 36A separated by slots 34A (See FIGS. 12A and 12B). The material of the fingers 36A (FIGS. 12A and 12B) may be selected to be flexible so that they flex downward in a direction away from the center when a person pushes waste through the central region of the membrane 32A. The material of the fingers 36A should also be resilient so that the fingers 36A return to their initial form after the person has removed their hand from engagement with the membrane 32A, or the inserted waste has been pushed downward through the membrane 32A and is no longer in engagement therewith. For example, as noted above, the membrane 32A may be made of silicone or another rubbery material. It may also be made of a flexible synthetic material which flexes under pressure and returns when pressure is removed.

The waste-containing member, i.e., bag or tubing 94, passing through the aperture 38B (see FIGS. 41-44) may tend to flex the fingers 36A downward but the fingers 36A will still remain in engagement with the waste-containing member, i.e., bag or tubing 94, and enable it to be twisted in the manner described below upon rotation of the membrane 32A. The edges of the fingers 36A (which are expected to engage the waste-containing member) may be provided with a friction-enhancing material to increase the contact force between the fingers 36A and the waste-containing member. The membrane 32A may also be made entirely made of this friction-enhancing material. The membrane 32A may be designed, as known to one skilled in the art, to turn the bag or tubing or other waste-containing member 94 and slip enough so as to not tear the bag, tubing or other waste-containing member 94 due to too much friction.

The membrane 32, either membrane 32A or membrane 32B or another membrane constructed in accordance with the disclosure herein, may be formed integral with the twisting member 22 or separate therefrom and then attached thereto. For example, the membrane 32 may include an annular channel on its underside which frictionally engages with an annular projection on the twisting member 22. Friction between the projection on the twisting member 22 and the edges of the channel on the membrane 32 enables the membrane 32 to be securely retained on the twisting member 22 and thus rotated upon and in conjunction with rotation of the twisting member 22.

As shown in FIGS. 12A and 13A, the membrane 32 may also be attached to an annular rim 40 made of a rigid material and that includes slots 42 on an underside. The twisting member 22 includes projections 44 (see FIG. 11) that enter into the slots 42 thereby fixing the membrane 32 to the twisting member 22.

Any other structure for fixing the membrane 32 to the twisting member 22 to enable them to rotate together may also be used. Instead of the membrane 32, another form of a grasping member may be used. The general function of such a grasping member is to engage with the waste-containing member 94 as the waste-containing member 94 passes by it and is capable of twisting the waste-containing member 94 when rotated. For example, the grasping member may be a circular frame having fingers extending inwardly therefrom, or have a comparable structure as disclosed in prior art waste disposal devices.

A rotation mechanism 46 (see FIGS. 8, 9, 15 and 16) is provided to rotate whatever twisting mechanism 16 is arranged in the container 12, upon closure of the lid 14. Rotation mechanism 46 includes a substantially U-shaped rack gear assembly 48. The U-shaped rack gear assembly 48 (whether a rack and pinion gear assembly or otherwise) includes a substantially U-shaped frame 50 which is pivotally coupled to the lid 14 at the upper ends of the U-shape via one or more pivot pins 52 and a rack gear 54 on the inside surface of one or both of the legs 56 of the U-shaped frame 50 (see FIG. 10). Each rack gear 54 has a series of teeth on at least a portion of a longitudinally extending surface.

Instead of a U-shaped rack gear assembly 48 having a U-shaped frame 50, a rack gear assembly having a frame with a different form may be used, or a frame may be entirely omitted. Also, only a single elongate rack gear 54 may be provided. Thus, in a waste disposal device in accordance with the invention, there may be at a minimum, only a single rack gear coupled to the lid 14 and which moves vertically in one direction upon opening of the lid 14 and vertically in the opposite direction upon closing of the lid 14.

Figure 7:
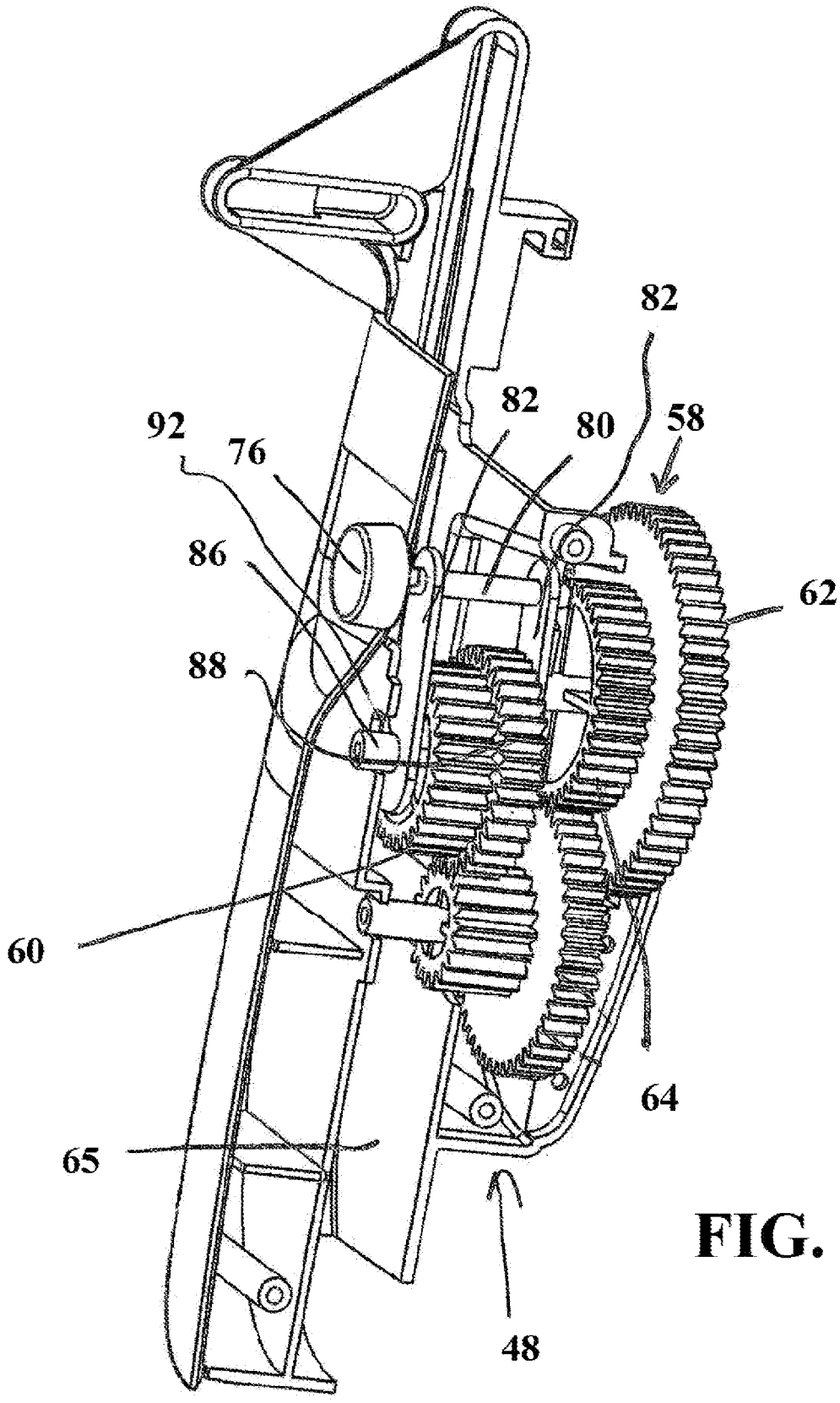
FIG. 7 is a perspective view of part of the waste disposal device shown in FIG. 1 with the switch mechanism in a second position.

The rotation mechanism 46 also includes a gear assembly 58 (as best seen in FIG. 7) having one gear 60 in meshing engagement with the rack gear 54 and one gear 62 in meshing engagement with the projections of the gear rim 30 on the twisting member 22 (this gear being referred to as the drive gear), and then optionally one or more additional gears 64 interposed between the gear 60 in engagement with the rack gear 54 and the drive gear 62. The gear assembly 58, except for a portion of the drive gear 62 which engages with the twisting member, may be situated in a housing 65.

Gear assembly 58 also includes an appropriate mechanism for enabling one-way transmission of rotational force from the rack gear 54 to the drive gear 62. Such mechanisms are known in the prior art. Other gear assemblies including more or less gears than shown can also be used to convert the downward movement of the rack gear 54 into rotational movement of the drive gear 62 in only a single direction. For example, a bevel gear may be used.

In operation, when the lid 14 is closed, the U-shaped frame 50 and thus the rack gear 54 are moved downward causing rotation of the gears 60, 62 in the gear assembly 58 and ultimately rotation of the drive gear 62. The twisting member of the twisting mechanism 16 is thus caused to rotate in view of the engagement between the projections on the gear rim 30 of the twisting member 22 and the drive gear 62. As such, the closing movement of the lid 14 is converted into rotational movement of the twisting member of the twisting mechanism 16.

Other mechanisms for converting only the closing movement of the lid 14 into rotational movement of the twisting member 22 of the twisting mechanism 16 are also contemplated within the scope of the invention and include those known in the prior art. Opening movement of the lid 14 is not converted into rotational movement of the twisting member 22 because the shaft of the gear 60 (See FIG. 7) is situated in an elongate slot 92 and movable in the slot 92 (as disclosed in greater detail in the inventor's prior applications). The shaft of the gear 60 is moved against an edge of the slot 92 during the closing movement of the lid 14 thereby fixing the gear 60 in a gear transmission between the rack gear 54 and the drive gear 62. But during opening movement of the lid 14, the shaft of the gear 60 moves upward in the slot 92 and is not pressed against an edge of the slot 92. The movable gear prevents motive transmission between the rack gear 54 and the drive gear 62. Thus, the slot 92, which may be oval, prevents unwinding or untwisting of the twist or knot 96 when the lid 14 is closed but when the gear 60 or its shaft 86 is trapped by structure described below, it produces the unwind or untwisting effect when the lid 14 is lifted.

In order to provide for rotation of the twisting member 22 relative to the stationary waste-containing member and thus the formation of a twist in the waste-containing member in the aperture 38 (see FIGS. 2 and 8-10) and/or slot(s) 34 between the fingers 36 of the membrane 32 (and which is engaged by the fingers 36), a mechanism for preventing rotation of the waste-containing member is preferably provided. The anti-rotation mechanism or rotation preventing mechanism may be any of those constructions known in the prior art. For example, if the waste-containing member is tubing housed in a cartridge, then the cartridge could be provided with a plurality of indentations, e.g., four, six, eight, that receive projections on the housing of the container 12. Tubing support 18A as seen in FIG. 10 can have notches, a rib or just be a tight friction fit to prevent rotation, etc.

In the illustrated embodiment, the bag or tubing support comprises the annular rim 18 and may have one or more indentations 66 are formed in the lower surface of the annular rim 18 that engage with corresponding projections on a part of the container 12 that does not rotate when the twisting mechanism 16 rotates. This part may be the inner surface of a support flange 68.

The waste disposal device 10 also includes a foot pedal assembly 70 which causes both opening of the lid 14 when a foot pedal of the foot pedal assembly 70 is depressed and closure of the lid 14 when the pressing force is removed. The foot pedal assembly 70 may be considered part of the rotation mechanism 46 or not.

The foot pedal assembly 70 includes the foot pedal 72 which extends outward from a lower region of the container 12, a horizontal actuating member connected to the foot pedal 72 at a first end region, a rigid vertical actuating member 73 (see FIG. 15) having a slot through which a projection at the second end region of the horizontal actuating member passes and a pivot pin connected to the horizontal actuating member between its ends. An upper end region of the vertical actuating member is connected to the U-shaped frame 50, or formed integral therewith. The pivot pin is retained as its ends extend through apertures in a base of the container 12. These components may be seen in the '252 application.

The foot pedal assembly also includes a spring 75 (see FIG. 15) that extends alongside the vertical actuating member 73 and is connected at its upper end to a projection 77 extending from the vertical actuating member 73 (see FIG. 15) and at its lower end region to a loop extending from a base portion of the container 12. The spring may include a hook at its upper end which is hooked onto or over the projection. The spring may additionally or alternatively include a hook at its lower end which is hooked onto or through the loop. Instead of projection and loop, apertures may be formed, i.e., in a portion of the vertical actuating member and the base portion, in which the hooks of the spring could be retained.

With this structure, depression of the foot pedal 72 causes pivoting of the horizontal actuating member about the pivot pin, i.e., the first end of the horizontal actuating member proximate the foot pedal 72 pivots downward while the second end of the horizontal actuating member proximate the vertical actuating member pivots upward. This upward pivotal movement causes the projection to abut against the upper interior surface defining the slot and urge the vertical actuating member upward. At the same time, the spring is tensioned in view of the fixing of its lower end to the base portion and the fixing of its upper end to the projection on the vertical actuating member. The upward movement of the vertical actuating member causes the U-shaped frame 50 to move upward thereby forcing the lid 14 to open. In view of the presence of the optional mechanism to enable one-way transmission of rotational force from the rack gear 54 to the drive gear 62, the drive gear 62 is not rotated during the opening movement of the lid 14.

As long as the foot pedal 72 is depressed, i.e., by the user's foot, the lid 14 will remain open. However, once the force depressing the foot pedal 72 is removed, the spring will naturally compress and urge the vertical actuating member downward, in turn causing the U-shaped frame 50 to be urged downward thereby causing the rack gear 54 to move downward. As described above, the downward movement of the rack gear 54 is converted into rotation of the drive gear 62 and thus rotation of the twisting member of the twisting mechanism 16. At the same time, the first end of the horizontal actuating member proximate the foot pedal 72 will also be pivoted upward into a position in which it can be depressed again.

Thus, the foot pedal assembly 70 enables use of the waste disposal device 10, both opening of the lid 14 and closing of the lid 14, solely by use of the user's foot (in a hands-free manner). Therefore, there is no manual contact between the user's hands and any portion of the waste disposal device 10 which is required in order to open the lid 14 or close the lid 14. This eliminates any problems resulting from the user holding other materials and being unable to close the lid as well as problems resulting from contact between the user's hands and bacteria or other harmful microorganisms on the lid.

Waste disposal device 10 may be used for any type of waste, including but not limited to medical waste from hospitals, doctors' offices, home health care personnel and facilities, nursing homes, biohazard laboratories, and the like. The waste disposal device 10 may also be used for personal hygiene such as for disposing of soiled diapers.

Modifications to the waste disposal device 10 are envisioned. For example, an access door 120 (see FIGS. 1 and 2) may be formed in the outer wall of the container 12 to pivot about hinges to enable access to an interior waste-receiving chamber of the container 12 in which a pail may be placed to receive a bag which will be filled with waste during use of the waste disposal device 10. A closure mechanism 122 would be provided to secure the door 120 in a closed position (see FIGS. 1 and 2). Access door 120 may also include a window 124, see FIGS. 1 and 2, (additional details about which are set forth below with reference to the embodiment shown in FIGS. 23-27).

Referring back to FIGS. 1-9, to enable a user with ability to control whether the opening movement of the lid 14 results in untwisting of the bag or tubing (or vice versa, i.e., control whether the closing of the lid 14 results in untwisting of the bag or tubing when the opening of the lid results in twisting of the bag or tubing), a switch mechanism 74 is provided to enable the opening movement of the lid 14 to either cause rotation of a twisting mechanism 16 or prevent rotation of the twisting mechanism 16.

Figure 6:
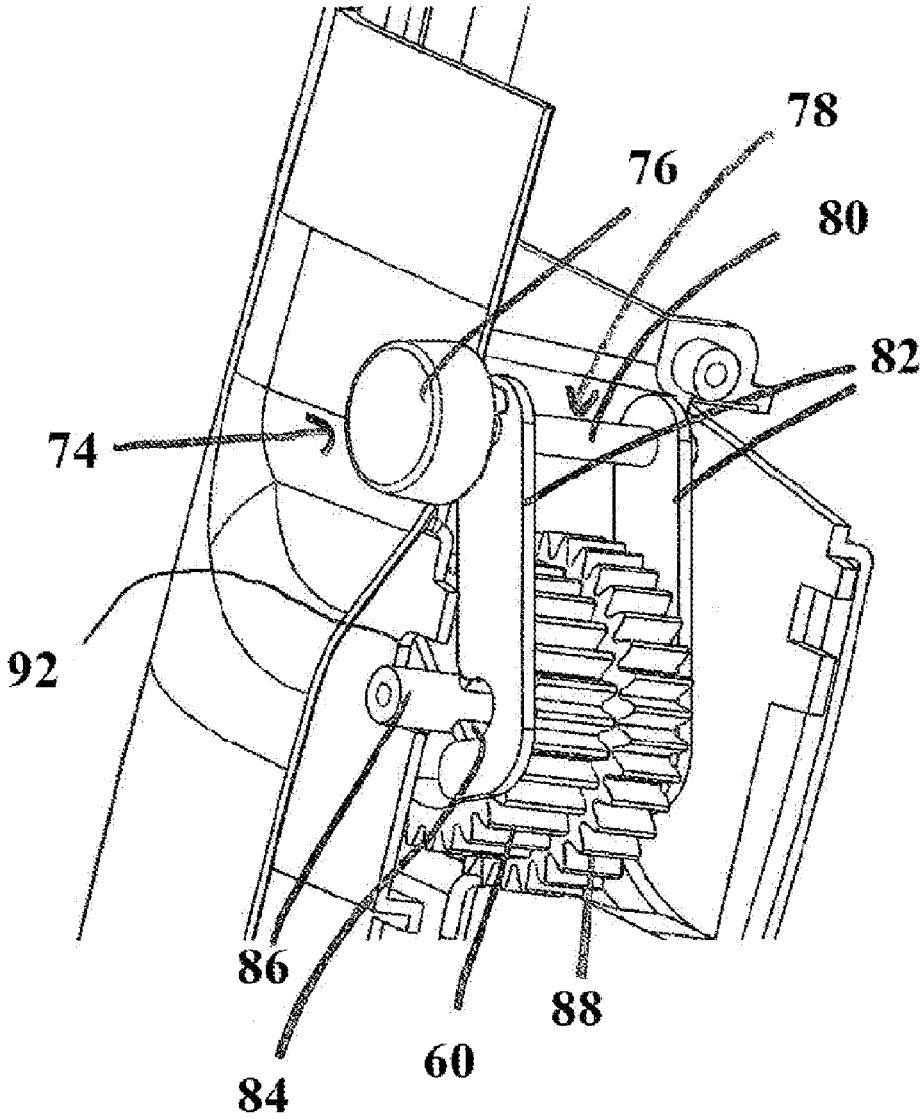
FIG. 6 is an enlarged view of the switch mechanism in the first position.
Figure 14:
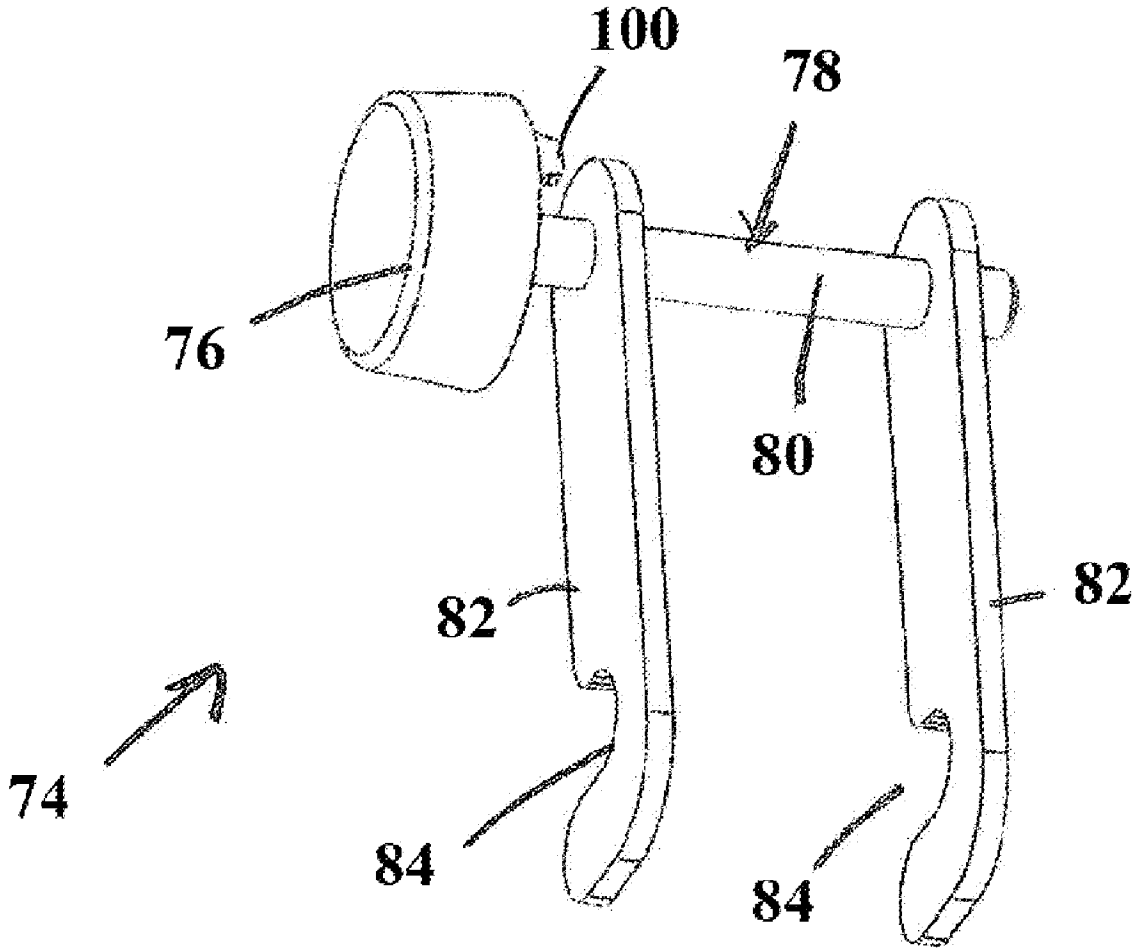
FIG. 14 is a perspective of a switch mechanism in the waste disposal device in accordance with the invention.

The switch mechanism 74 includes a knob 76 accessible from the exterior of the waste disposal device 10 and which controls a lever mechanism 78 (see FIGS. 6 and 14). Lever mechanism 78 includes a shaft 80 and two locking members 82 fixed thereto. The locking members 82 each include a slot 84, see again FIG. 14, designed to receive the shaft 86 about which the gear 60, and another gear 88 on the same shaft, rotate with a minimum of clearance to thereby retain the shaft 86 and prevent radial movement of the shaft 86 and thus the gears 60, 88. Slot 84 may be an oval slot or notch or have any other construction so long as it is capable of trapping the shaft 86 of the gear 60, 88.

These gears 60, 88 are part of the gear assembly 58 of the rotation mechanism 46 that effects rotation of the twisting mechanism 16 upon closure of the lid 14 as disclosed in the '252 application. Although the lever mechanism 78 is shown including two locking members 82, it may include an alternate number of locking members, e.g., only a single locking member (see FIGS. 18-22 discussed below), three locking members, etc.

As disclosed in the '252 application, during the opening movement of the lid 14, the rotation mechanism does not convey motive force from the rack gear attached to the lid 14 to the gear rim attached to or formed integral with the twisting mechanism. This same concept is applied when the locking members 82 are not engaged with the shaft 86 as shown in FIGS. 5, 6, 8 and 10, i.e., the opening movement of the lid 14 via a foot pedal 72 does not result in rotation of the twisting mechanism.

Figure 9:
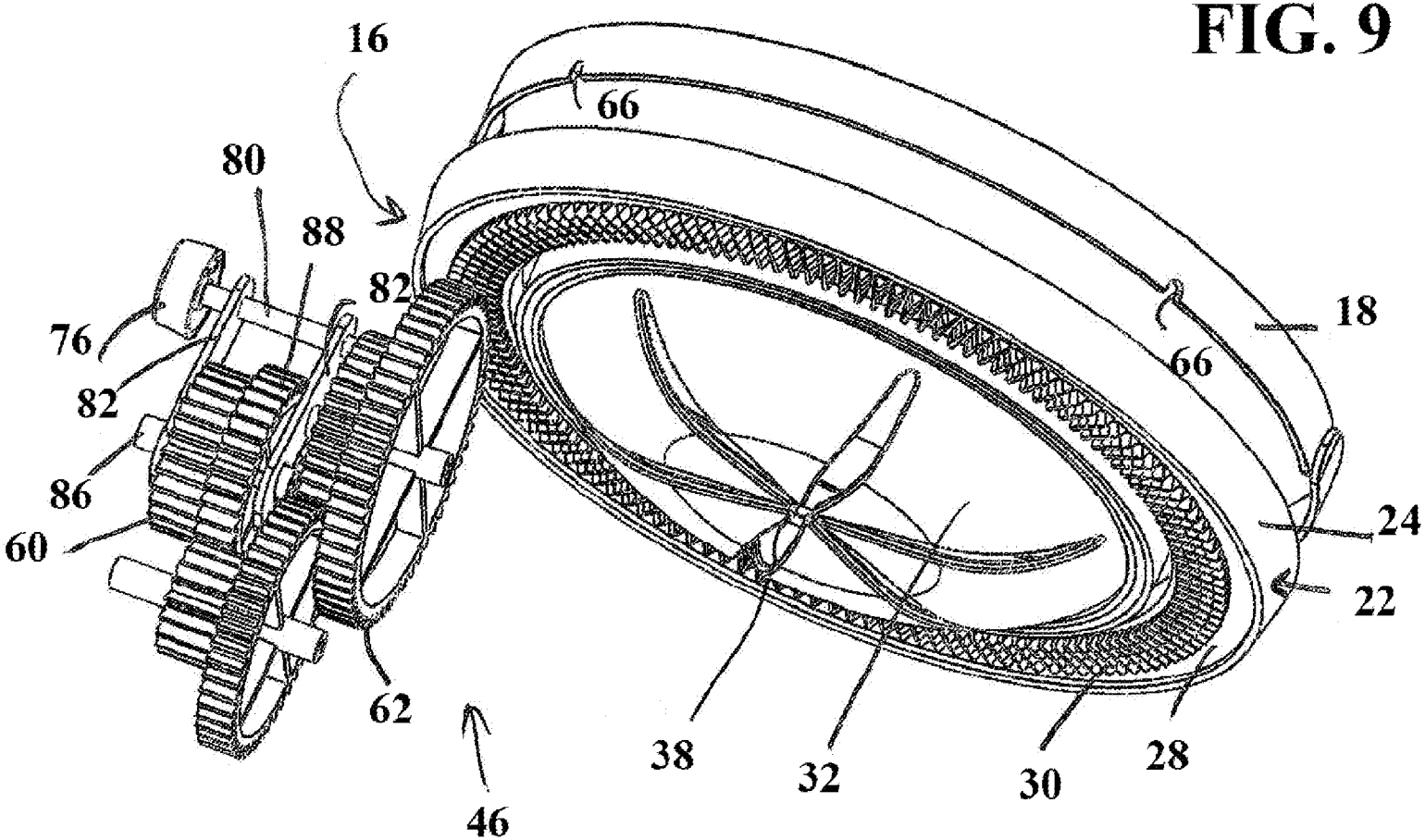
FIG. 9 is a perspective view of part of the waste disposal device shown in FIG. 1 showing the gear assembly and twisting mechanism.
Figure 10:
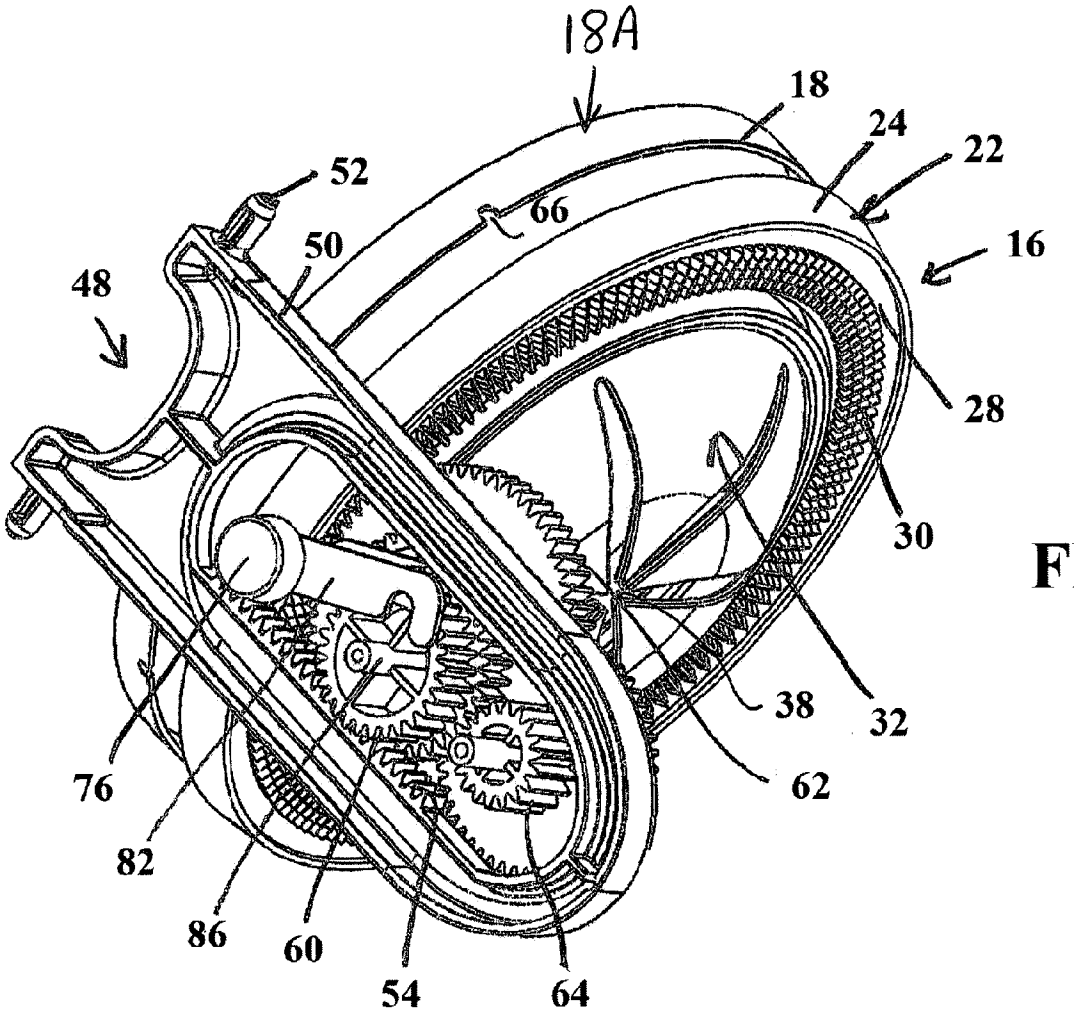
FIG. 10 is another perspective view of part of the waste disposal device shown in FIG. 1 showing the gear assembly and twisting mechanism.

However, as seen in FIGS. 7 and 9, when the locking members 82 are engaged with the shaft 86, i.e., the shaft 86 is fixed in the slots 84 of the locking members 82. Thus, as shown in FIGS. 7 and 9, the gears 60, 88 are maintained in the same position as during the closing movement of the lid 14, and therefore, there is a conveyance of motive force from the rack gear 54 attached to the lid 14 to the gear rim 30 attached to the twisting mechanism 16. The shaft 86 is therefore unable to move in the slot 92 (see FIG. 7).

A variation of switch mechanism 74 is shown in FIGS. 18-22 and designated 110. Like switch mechanism 74, switch mechanism 110 enables opening movement of the lid 14 to either cause rotation of the twisting mechanism 16 or prevent rotation of the twisting mechanism 16.

The switch mechanism 110 includes the knob 76 accessible from the exterior of the waste disposal device 10 and which controls a lever mechanism 112 (see FIGS. 18-22). Lever mechanism 112 includes a small shaft 114 and only a single locking member 116 fixed at to the end region of the shaft 114 (see FIG. 22). By contrast, switch mechanism 74 includes two locking members 82 fixed to an elongate shaft 80.

The locking member 116 includes a slot 118 designed to receive the shaft 86 about which the gear 60, and another gear 88 on the same shaft, rotate with a minimum of clearance to thereby retain the shaft 86 and prevent radial movement of the shaft 86 and thus the gears 60, 88. Slot 118 is therefore similar in function to slots 84. Slot 118 may be an oval slot or notch or have any other construction so long as it is capable of trapping the shaft 86 of the gear 60, 88. Thus, only one side of the pinion gear assembly, gears 60, 88, is trapped against movement of the shaft 86 on which these gears are supported.

Figure 18:
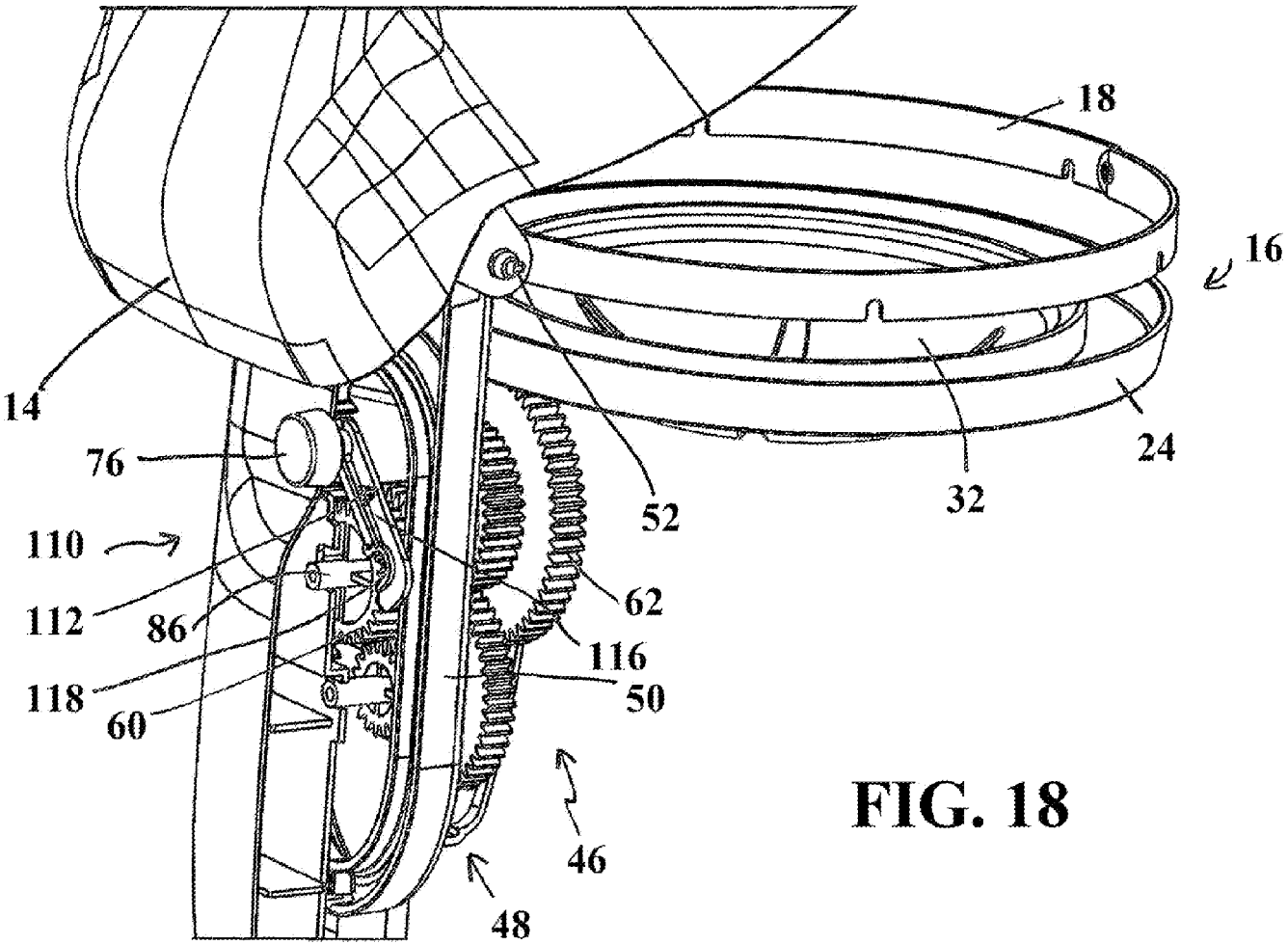
FIG. 18 is a view of a waste disposal device, partially broken away, with a variant of the switch mechanism of the waste disposal device shown in FIGS. 1-9 in the unengaged position.
Figure 19:
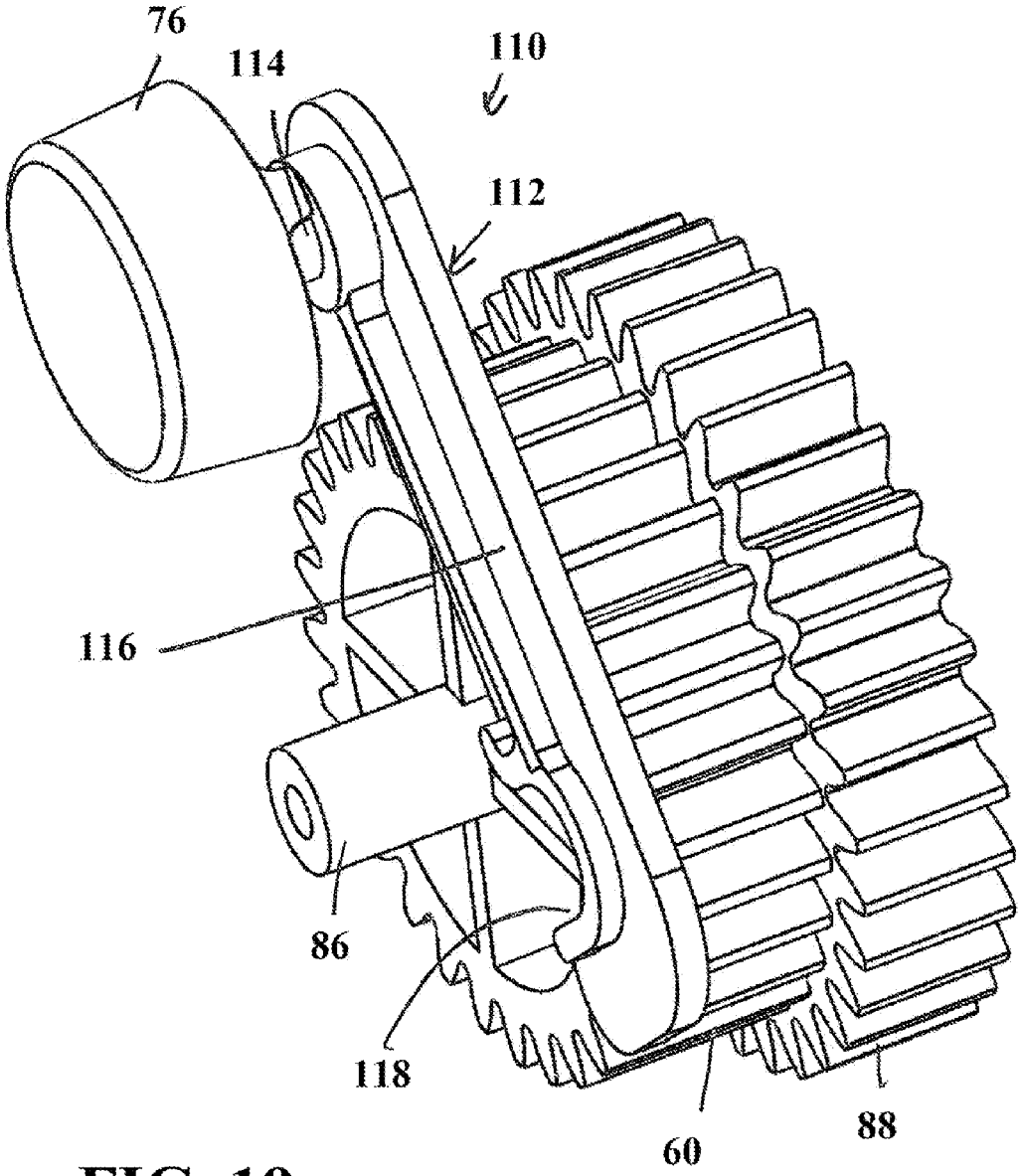
FIG. 19 is a view of the switch mechanism of the waste disposal device shown in FIG. 18 in the unengaged position.
Figure 20:
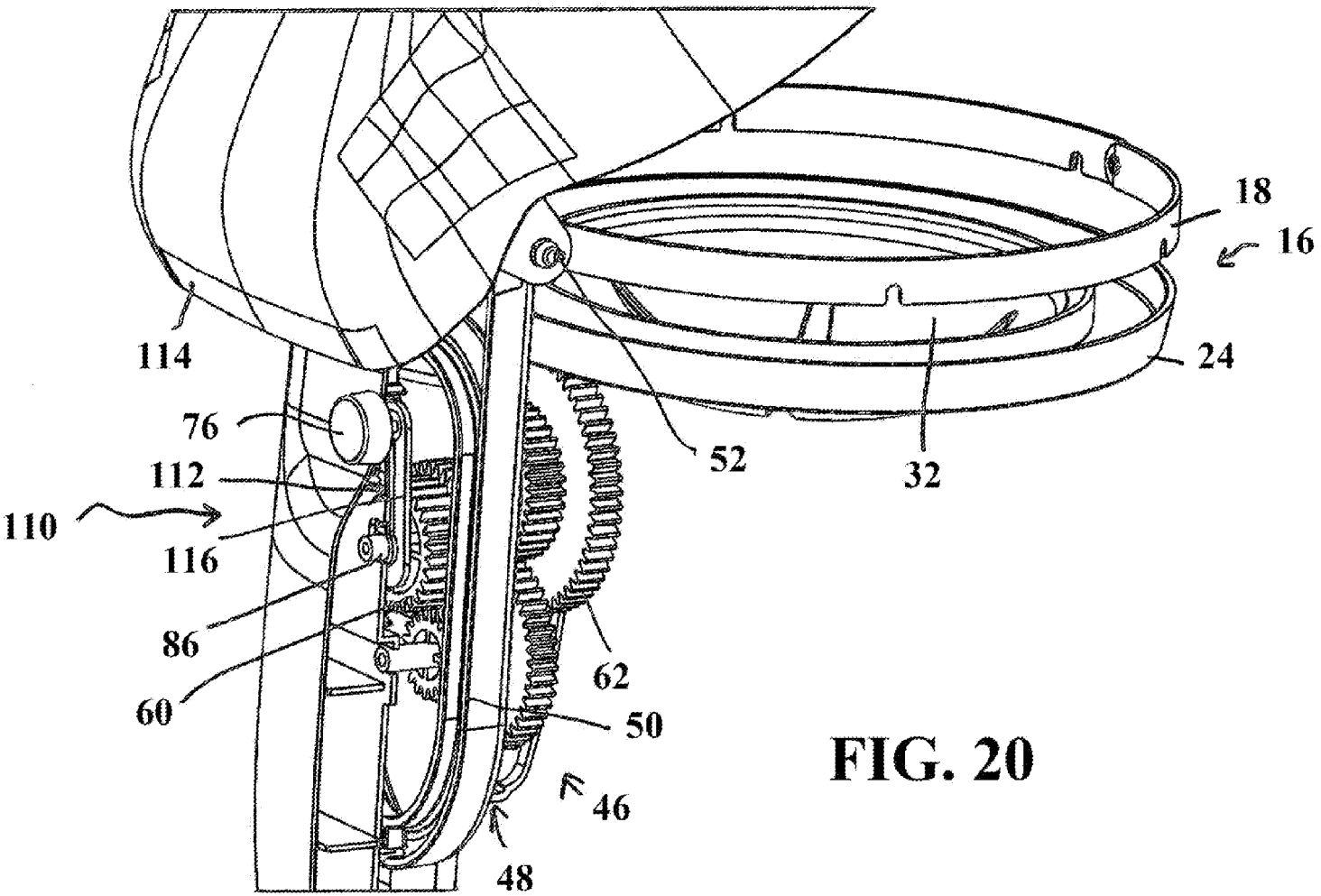
FIG. 20 is a view of the waste disposal device shown in FIG. 18 with the switch mechanism in the engaged position.
Figure 21:
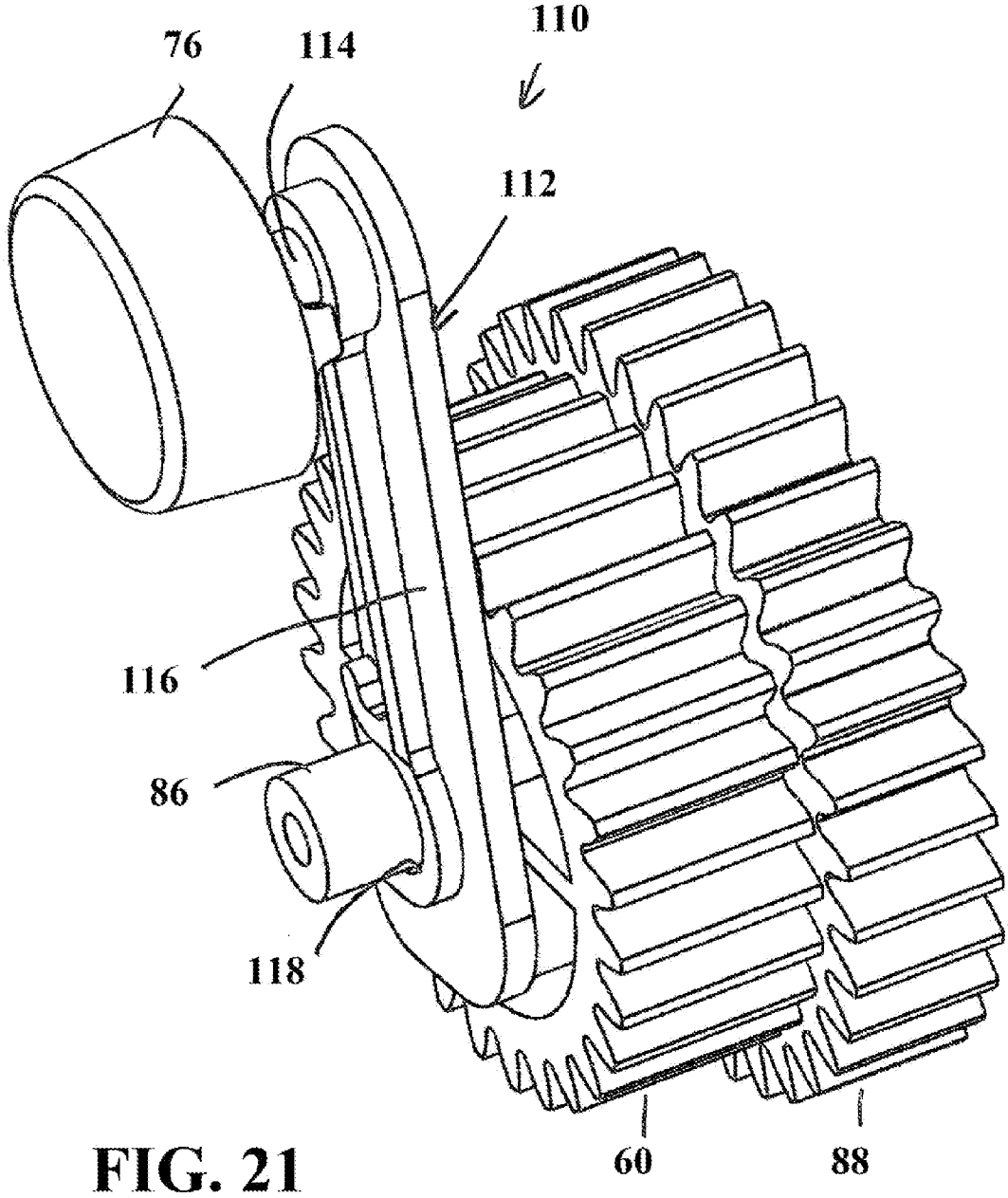
FIG. 21 is a view of the switch mechanism of the waste disposal device shown in FIG. 18 in the engaged position.
Figure 22:
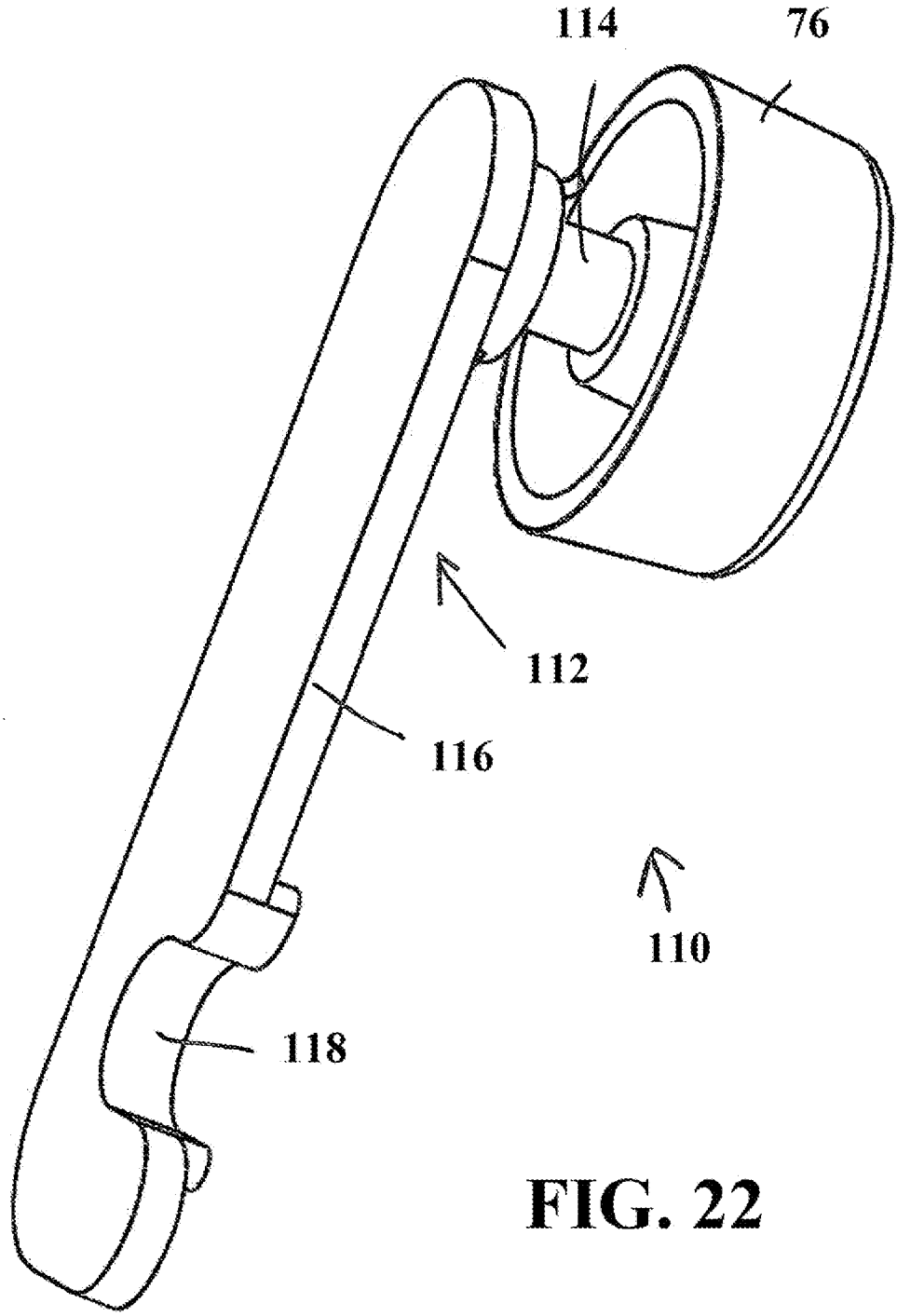
FIG. 22 is a perspective, rear view of the switch mechanism of the waste disposal device shown in FIG. 18.
Figure 23:
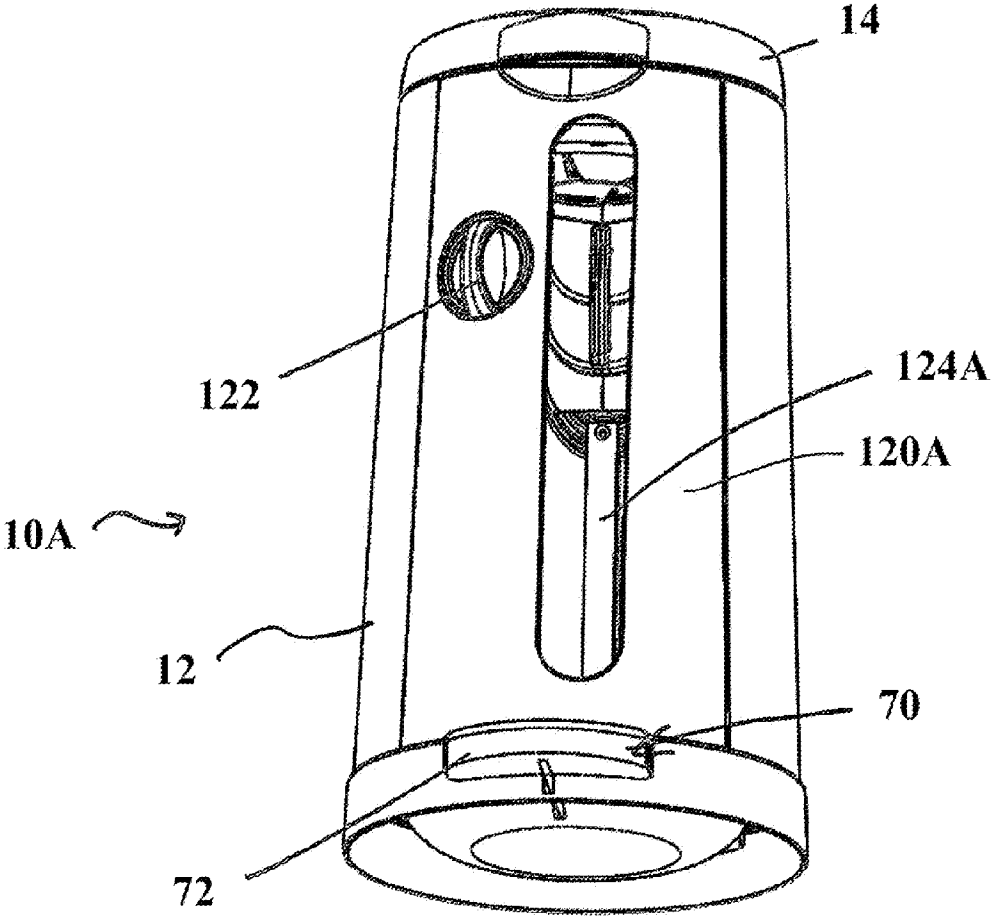
FIG. 23 is a front view of a waste disposal device with a variant of the window of the waste disposal device shown in FIGS. 1 and 2.
Figure 24:
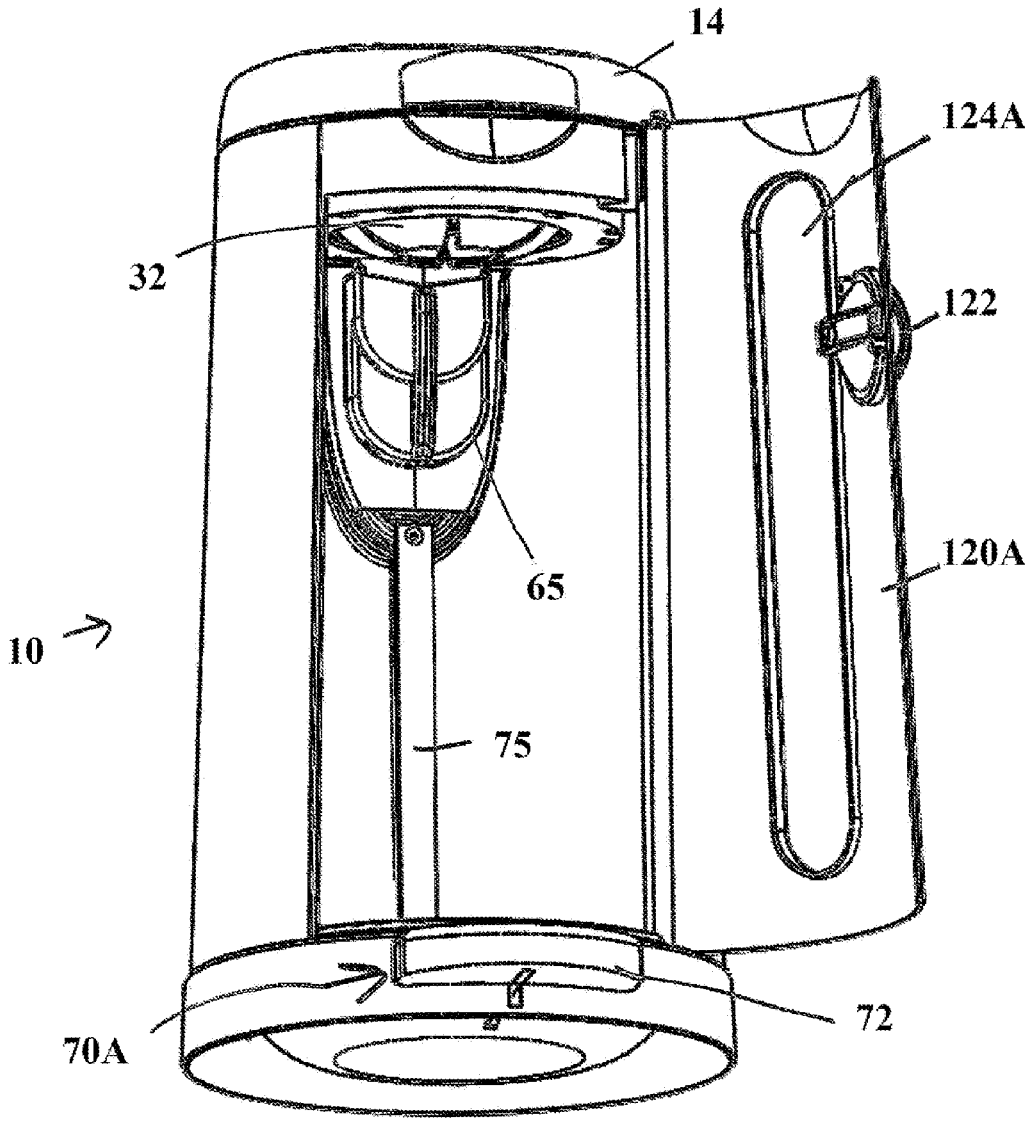
FIG. 24 is a front view of the waste disposal device shown in FIG. 23 with an access door in an open state.
Figure 25:
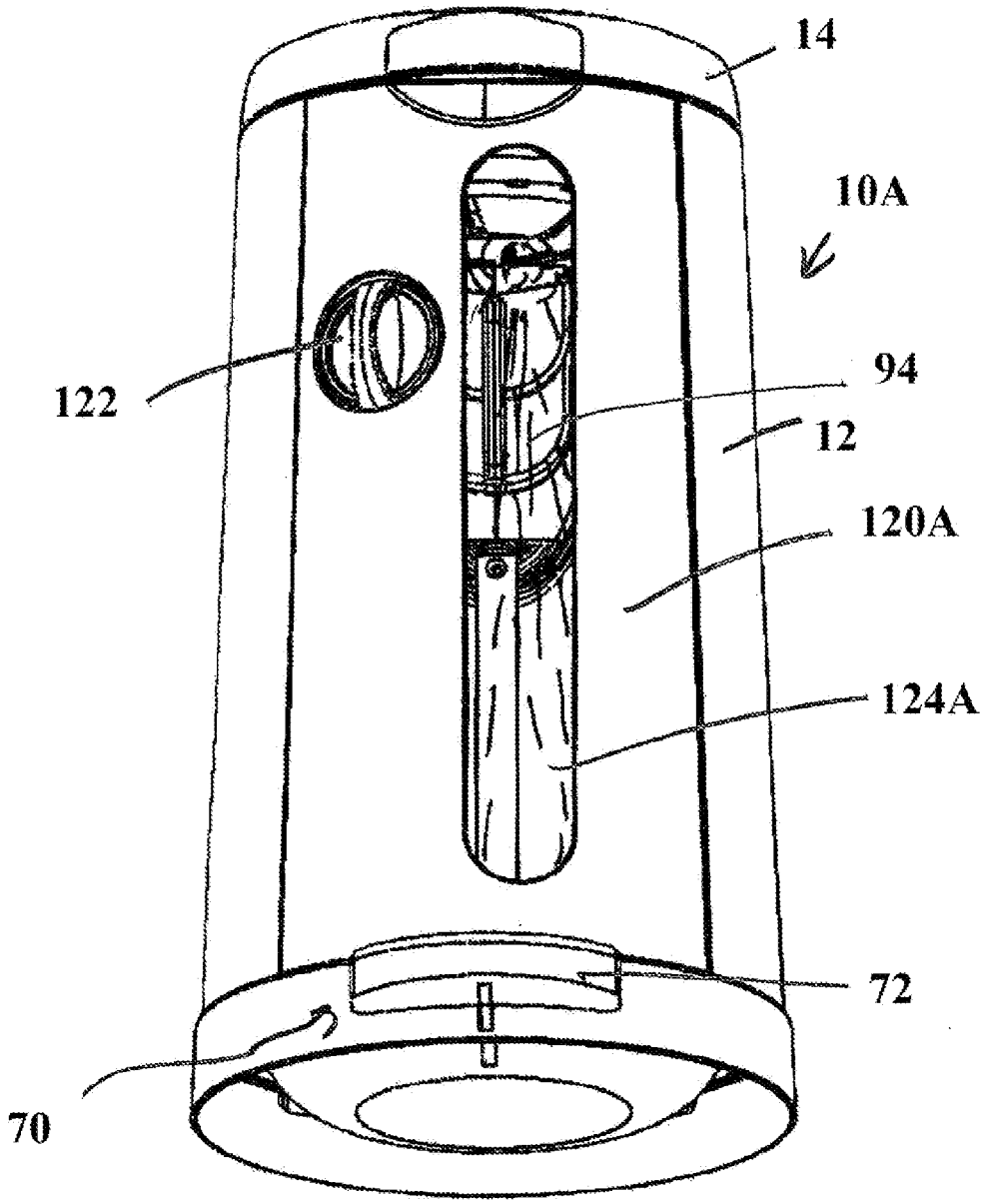
FIG. 25 is a view of the waste disposal device shown in FIG. 23 showing a bag with an un-twist partially viewable through the window in the door of the waste disposal device.
Figure 26:
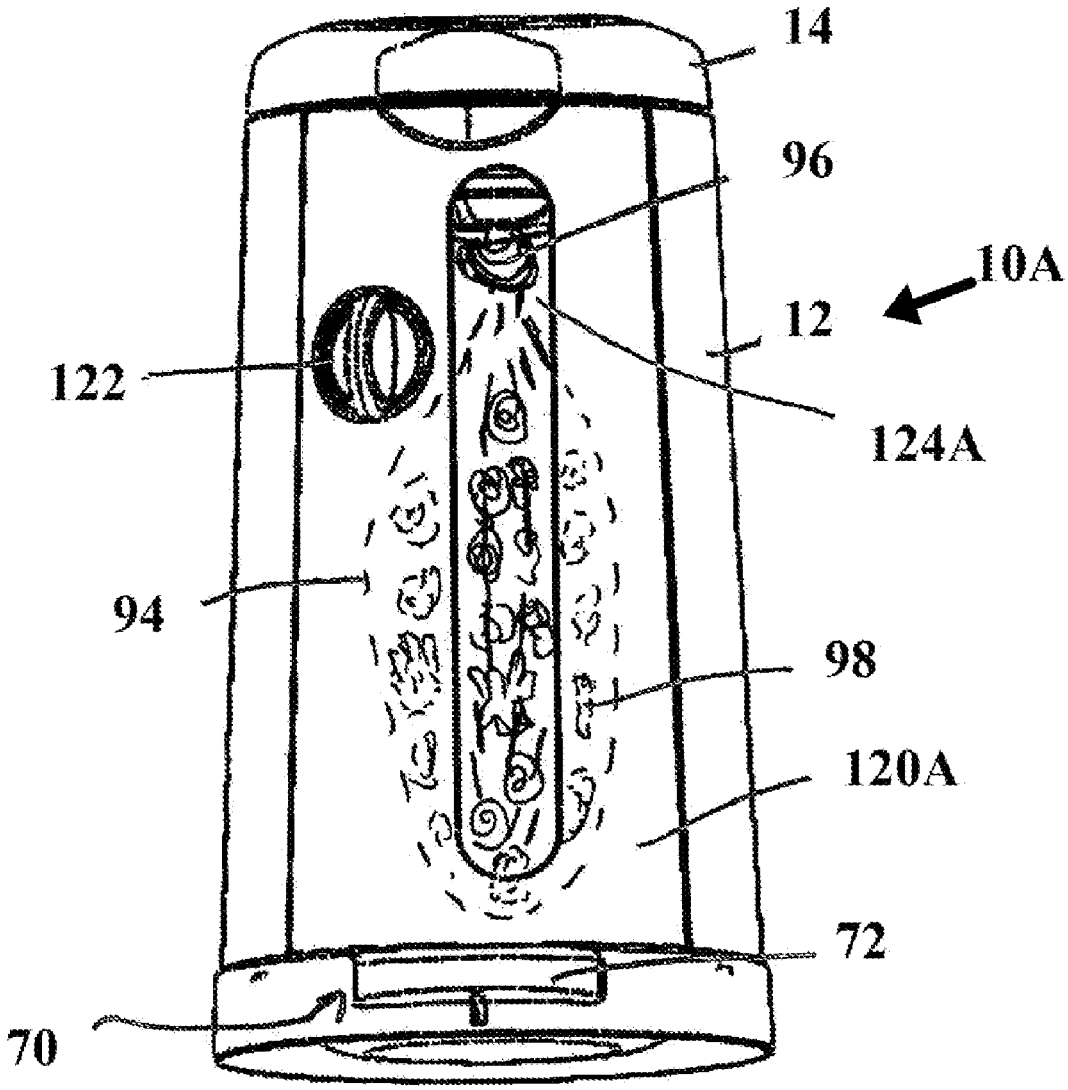
FIG. 26 is a view of the waste disposal device shown in FIG. 23 during use showing a bag with a twist containing waste partially viewable through the window in the door of the waste disposal device.
Figure 27:
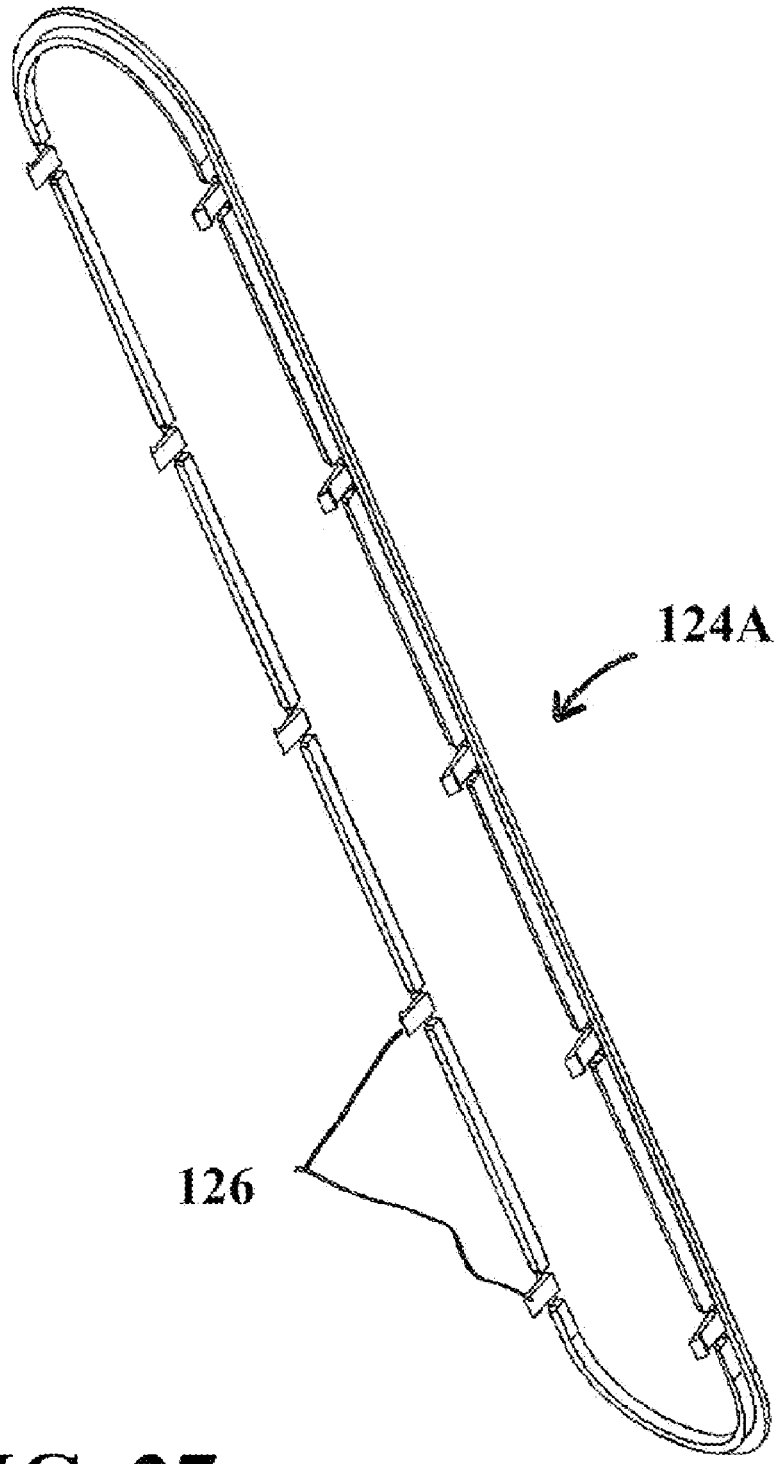
FIG. 27 is a perspective view of the window of the waste disposal device shown in FIG. 23.

When the locking member 116 is not engaged with the shaft 86 as shown in FIGS. 18 and 19, the opening movement of the lid 14 via a foot pedal 72 does not result in rotation of the twisting mechanism. However, as seen in FIGS. 20 and 21, when the locking member 116 is engaged with the shaft 86, i.e., the shaft 86 is fixed in the slot 118 of the locking member 116. Thus, as shown in FIGS. 20 and 21, the gears 60, 88 are maintained in the same position as during the closing movement of the lid 14, and therefore, there is a conveyance of motive force from the rack gear 54 attached to the lid 14 to the gear rim 30 attached to the twisting mechanism 16. The shaft 86 is therefore unable to move in the slot 92.

Figure 17:
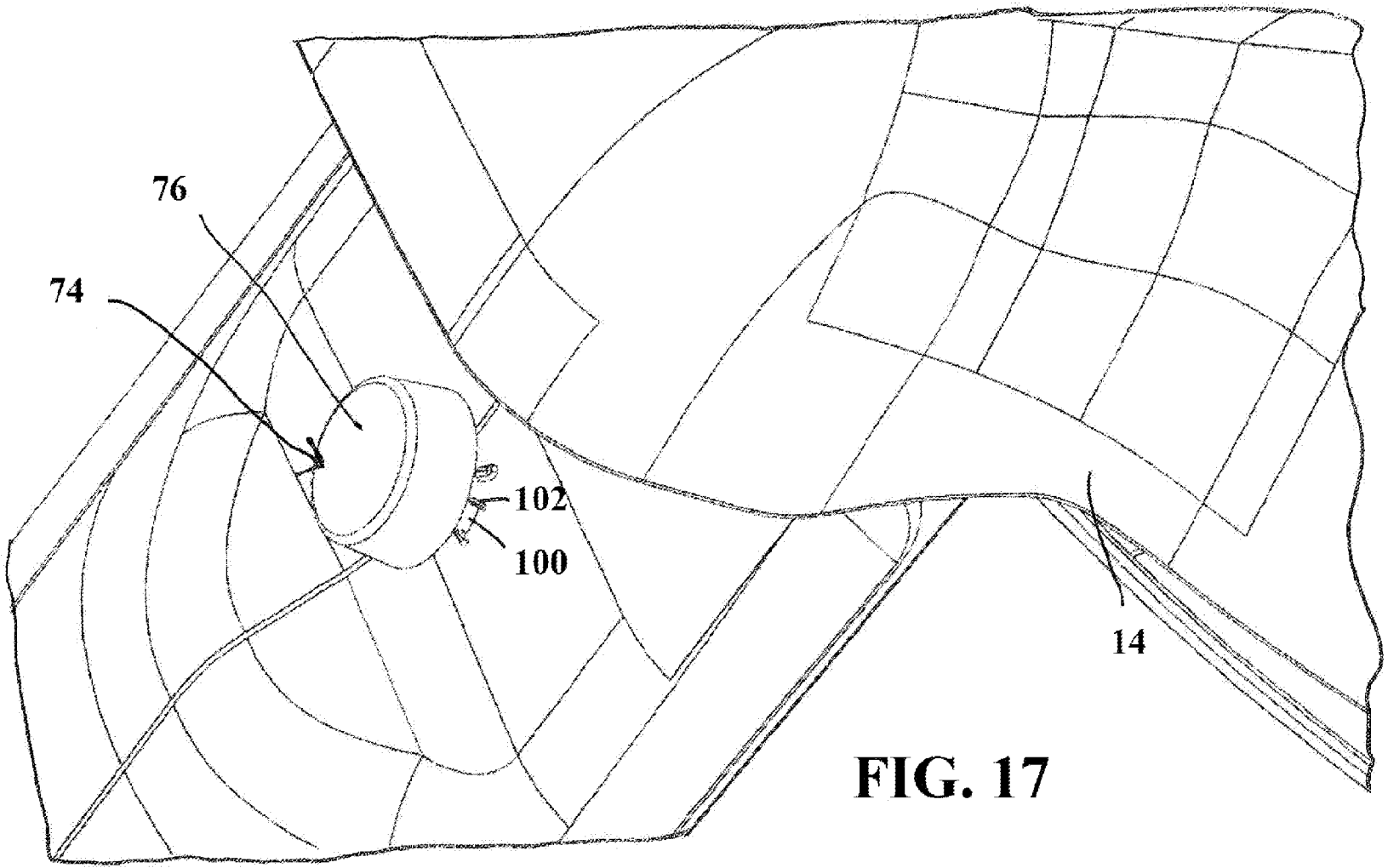
FIG. 17 is an enlarged view of the knob of the switch mechanism in accordance with the invention.

FIG. 17 is an enlarged view of the knob 76 with two positions. A first position is when the knob 76 is turned to the left and the locking members 82 are disengaged. When you rotate the knob 76 to the right over a bump 102, the shaft 86 is now trapped by the locking members 82 which will now cause the waste-containing member 94 to untwist or unwind when the user lifts the lid 14. FIG. 17 also shows a small projection 100 of knob 76 which rides over the bump 102 on the container 12. The small projection 100 rotates to two positions and when seated between the center ridge and the left or right ridge, locking members 82 are either engaged or disengaged with the shaft 86.

Figure 4:
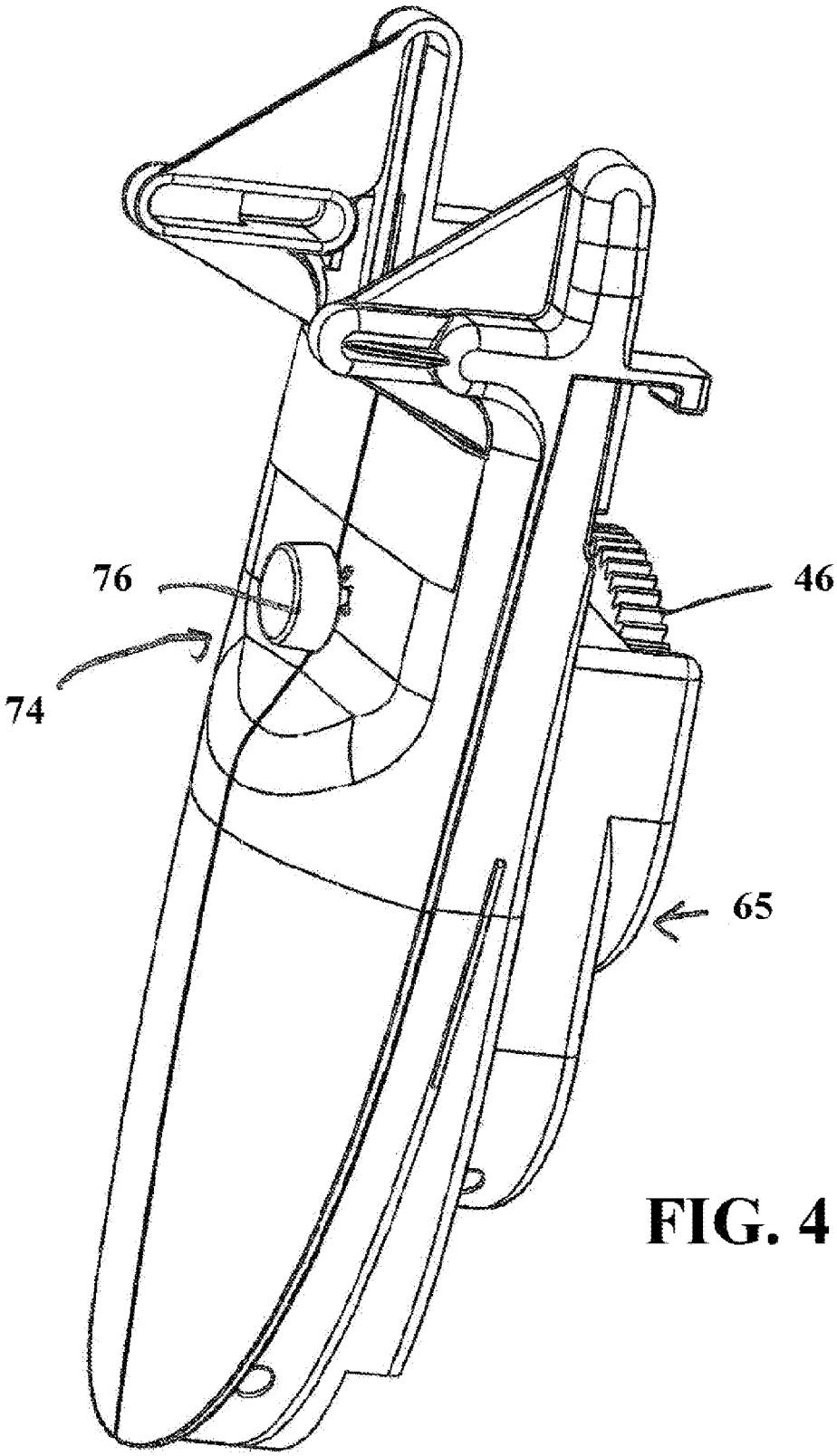
FIG. 4 is a perspective view of part of the waste disposal device shown in FIG. 1.
Figure 5:
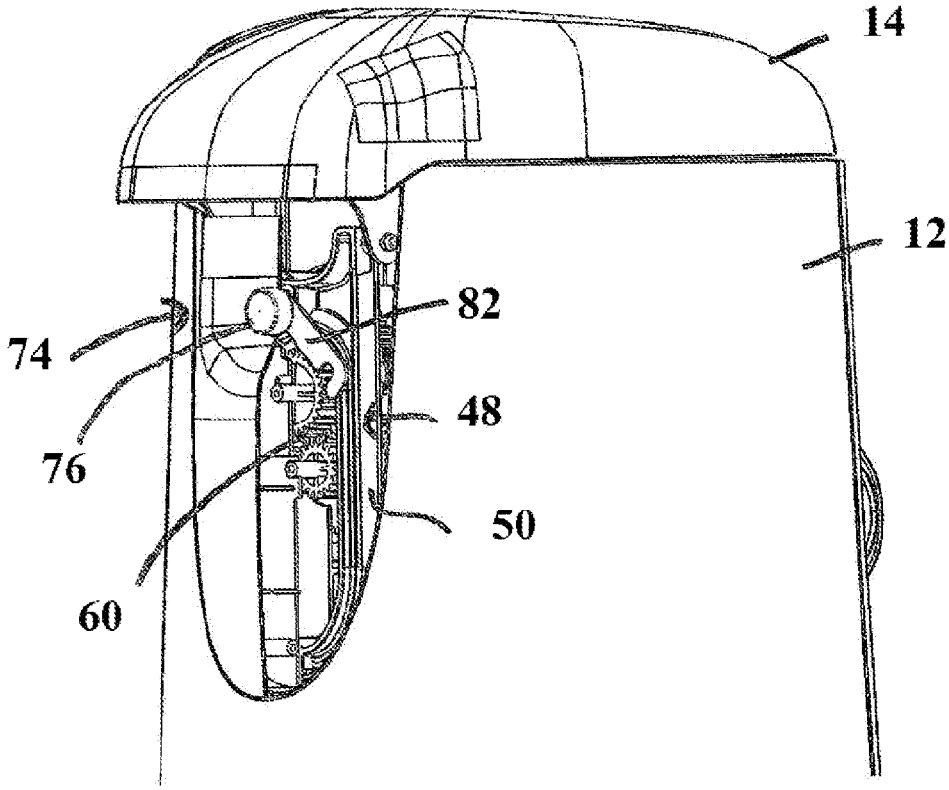
FIG. 5 is a perspective view of part of the waste disposal device shown in FIG. 1 with a switch mechanism in a first position.

As shown in FIG. 4, the two different positions of the knob 76 may be indicated by indicators 90, one representing the trapping of the shaft 86 by locking members 82 and the other representing the positioning of the locking members 82 out of engagement with the shaft 86.

A user can decide whether to provide for rotation of the twisting mechanism 16 with the opening movement of the lid 14 based on, for example, the use of the waste disposal device 10 for a particular type of waste. If the user wants the opening of the lid 14 to provide for untwisting of the bag or tubing and closing of the lid to provide for twisting of the bag or tubing, then they would set the knob 76 to a second position (see, e.g., FIGS. 7 and 9) such that the locking members 82 engage with the shaft 86 and prevents disengagement of the gear assembly from the rack gear. In this case, all movement of the lid will result in rotation of the twisting mechanism. On the other hand, if the user wants only the closing movement of the lid to provide twisting of the bag or tubing via the twisting mechanism, they would move the knob 76 to the first position (See FIGS. 5, 6, 8 and 10) in which the locking members 82 do not restrict the movement of the shaft 86 thereby allowing the shaft 86 to move and disengage the gear assembly from the rack gear, i.e., the shaft 86 travels freely up the slot 92 (FIG. 7).

Referring now to FIGS. 23-27, this embodiment of a waste disposal device 10A includes all of the same features as waste disposal device 10 except for a variant of access door 120A (and thus the same reference numbers refer to the same elements). Waste disposal device 10A includes an access door 120A that has a see-through or transparent window 124A (a safety preview window) that extends substantially along the entire height of the door 120A (see FIGS. 23-26), and thus is larger than the window 124 shown in FIGS. 1 and 2. The shape of the window 124A may be varied from that shown, i.e., differ from the vertically oriented elongate shape with curved upper and lower ends shown in FIGS. 23-27.

Also, the window 124A may be located apart from the door 120A if so desired. As such, the window 124A would be dimensioned relative to the container 12 such that the window extends along substantially the entire height of the container 12, or at least the height of the waste-containing member in the interior thereof (a bag or tubing) to enable viewing of the interior of the container 12 and thus the height of the waste-containing member when present.

The window 124A can be water clear plastic or glass, for example. Or, the window 124A could be tinted a transparent color, such as red, to indicate that this is a biohazard waste container. The choice of color for the window 124A is up to the customer. In fact, it is possible to have different color windows (lenses) that could be easily snapped in place via a plurality of snap tabs 126 arranged around the periphery of the window 124A, see FIG. 27. Other fastening arrangements for attaching the window 124A to the door 120A, either a permanent attachment, such as by adhesive, or a removable attachment, such as the snap-fit using snap-tabs 126, are also within the scope and spirit of the invention.

Main purposes of the access door 120A with a window 124A are to enable a user of the waste disposal device 10A to view the status of the bag 94, facilitate by the larger size of the window 124A, as well as the status of any twist 96 in the bag 94 through the window 124A. Window 124A therefore provides an added measure of safety when previewing hazardous waste or biohazards prior to ultimate safe removal thereof, and as well as provides the person discarding the waste into the container 10A with a full or almost full view of the status of the bag 94 as it is being filled with waste 98. This minimizes the need for the user to open the door 120A to check the how full, or not, the bag 94 is. This preview window 124A, especially in view of its extension along substantially the entire height of the door 120A and thus which shows the waste 98 from the membrane 32 to the bottom of the bag 94 allows the user the option of opening the door 120A only when they are ready (full or not) to remove the waste 98.

Also, the presence of the window 124A lets a user know when it's time to change bags 94. Here, the user will only need to open the door 120A once for safe removal, as opposed to having to open the door 120A several times to ascertain how full the bag 94 is. Repeated unnecessary door openings and closings produce more engagement (contact) with odor and bacterial than is needed. The window 124A solves these problems.

The safety window 124A also offers a person using the waste disposal device 10A in a healthcare situation minimal contact with the container, which is especially important where STREPH, MRSA and other potentially harmful bacteria is concerned. The safety or preview window 124A is also a major improvement where adult and children's diapers are concerned.

The presence of the access door 120A differentiates the pail body in accordance with the invention from conventional pails that have an inner liner which must be lifted up to remove the waste.

Figure 28:
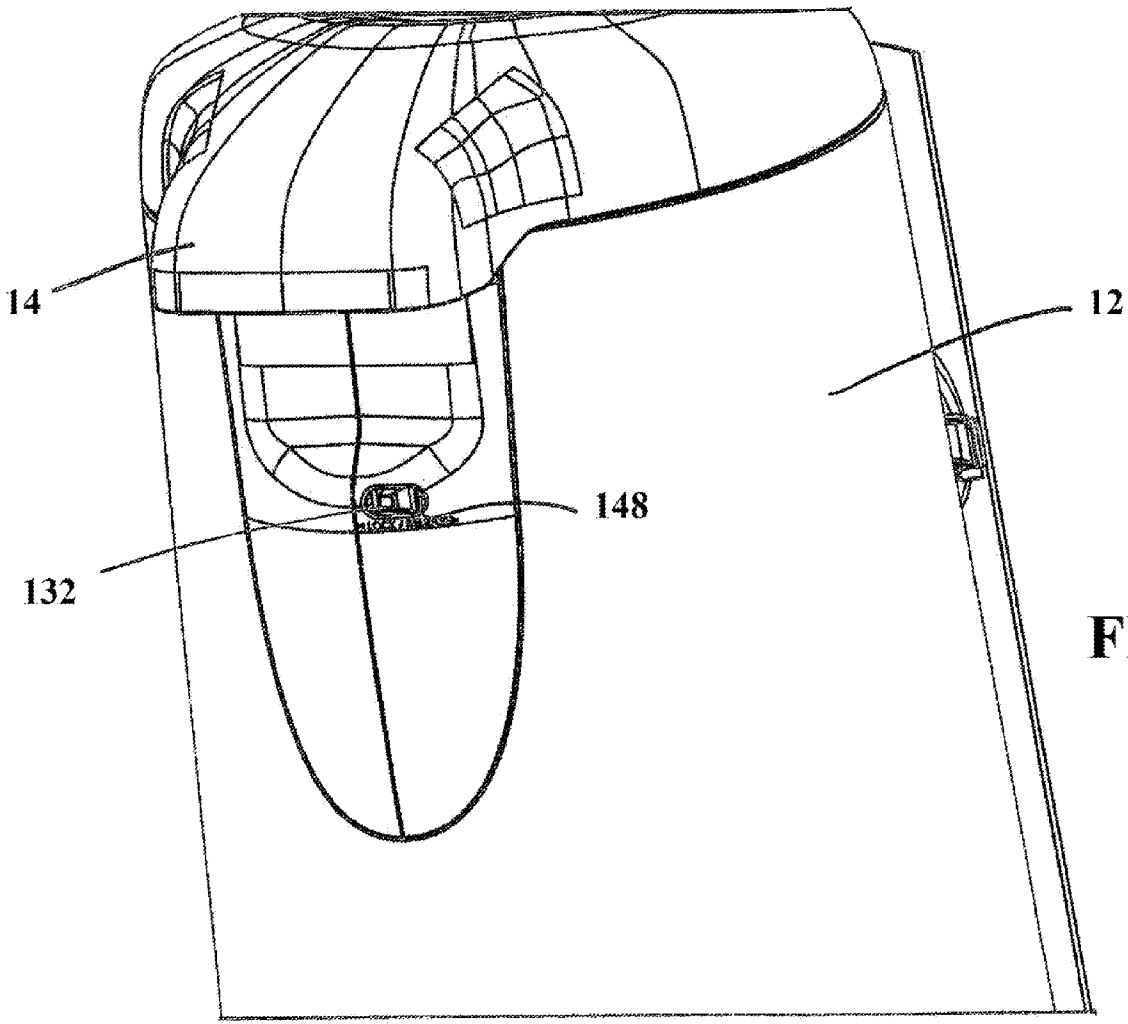
FIG. 28 is a partial, rear perspective view of another embodiment of a waste disposal device in accordance with the invention.

Referring now to FIGS. 28-32, another embodiment of a waste disposal device in accordance with the invention is shown, designated 130, and includes a different switch mechanism 132 that enables the opening movement of the lid 14 to either cause rotation of the twisting mechanism 16 or prevent rotation of the twisting mechanism 16. These two different positions, conditions or states of the switch mechanism 132 may be indicated by text on the outer surface of the pail 12, e.g., the word "LOCK" with an arrow in one direction and the word "RELEASE" with an arrow in the other direction as shown in FIG. 28.

Switch mechanism 132 is a slide lock with a single engagement on one side of the shaft 86 of the pinion gear assembly (of gears 60, 88) that causes the pinion gear assembly 60, 88 to be trapped or untrapped in the gear chain between the lid 14 and the twisting mechanism 16.

FIGS. 33-37 show another embodiment of a switch mechanism 134 that also enables the opening movement of the lid 14 to either cause rotation of the twisting mechanism 16 or prevent rotation of the twisting mechanism 16, but instead of being a slide lock with a single engagement on only one side of the shaft 86 as in FIGS. 28-32, provides a double engagement on two parts of the shaft 86 that are axially separate from one another.

Figure 32:
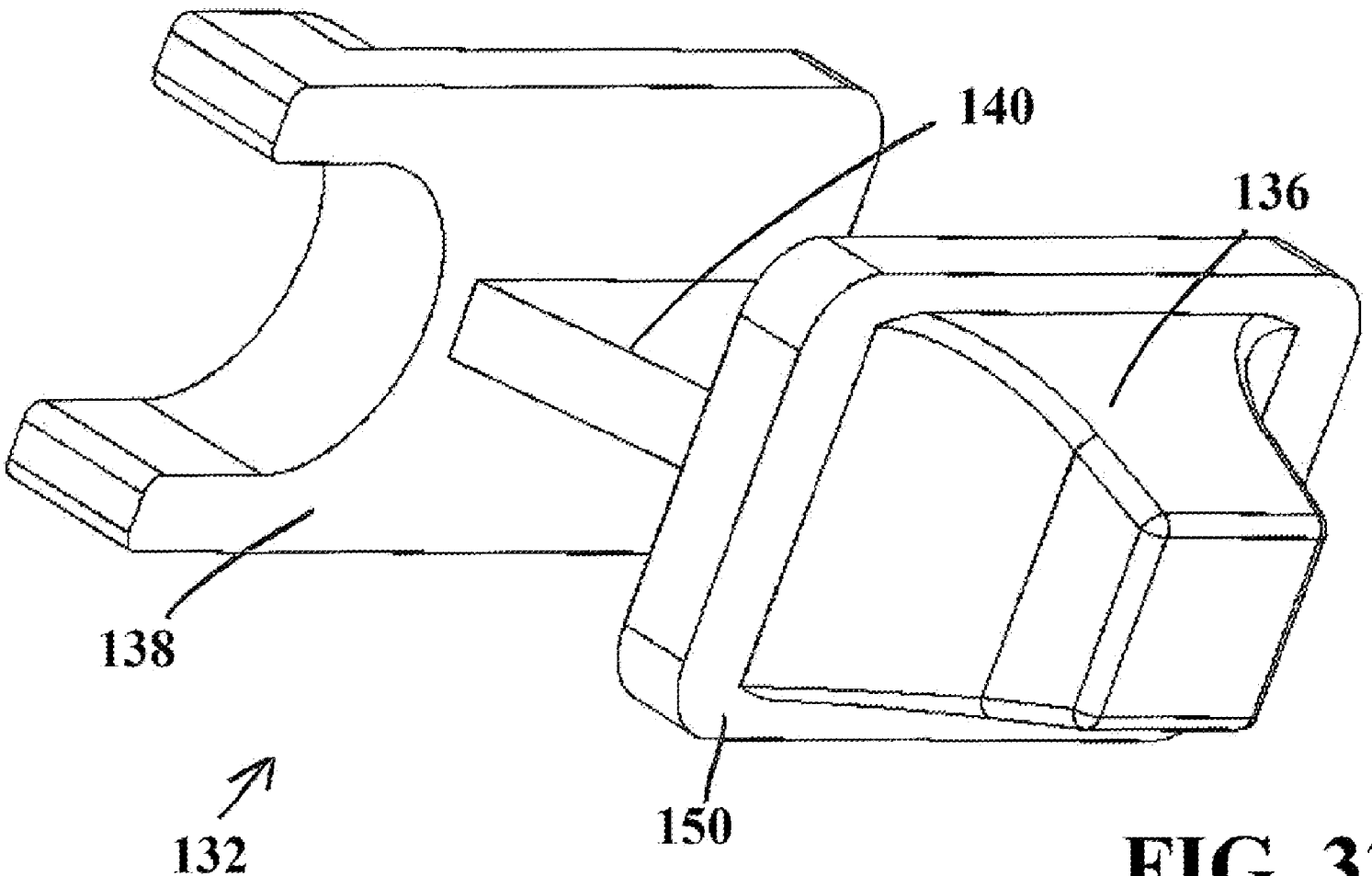
FIG. 32 is a perspective view of the switch mechanism of the waste disposal device shown in FIG. 28.
Figure 33:
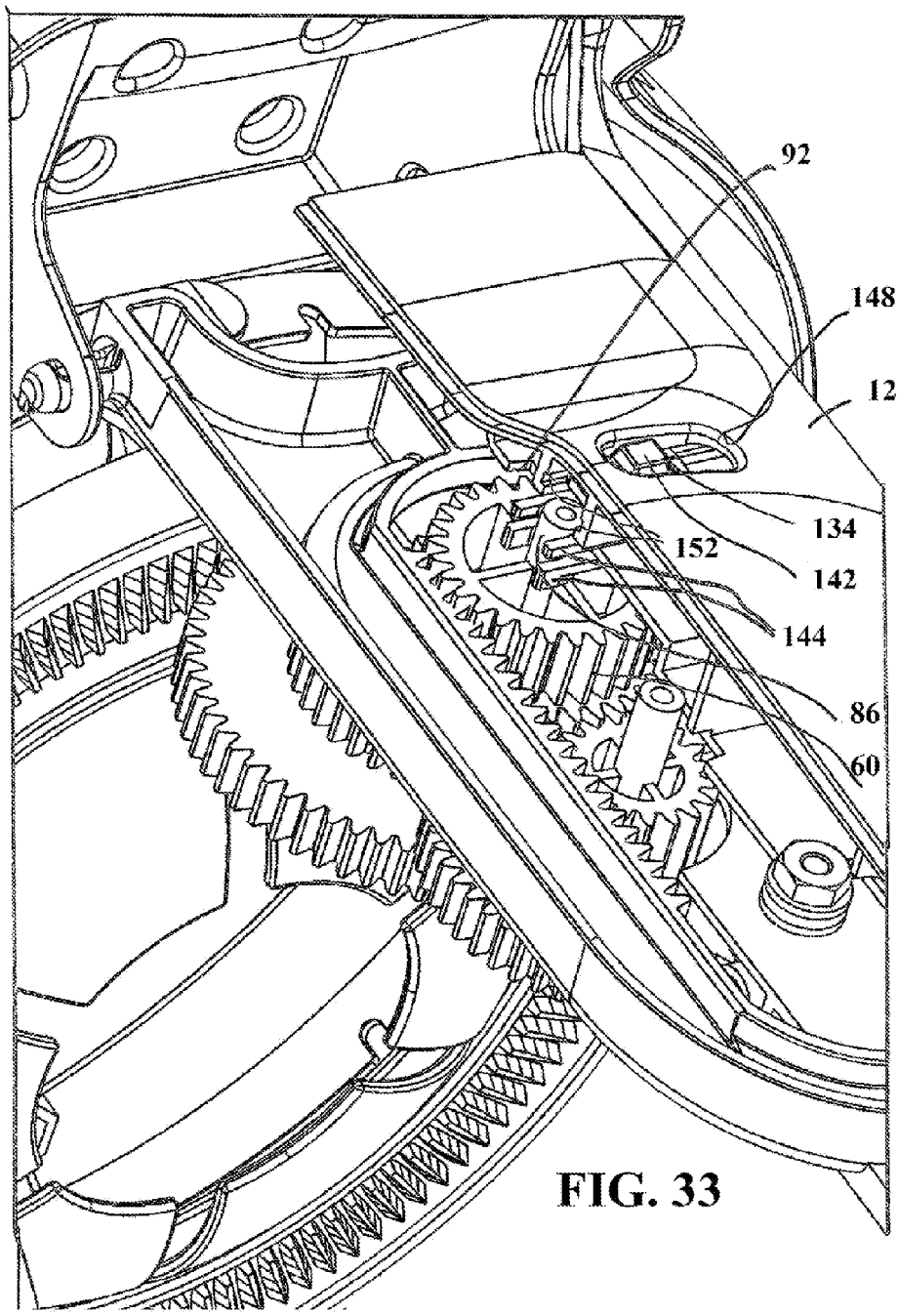
FIG. 33 is a view of the rotation mechanism of another embodiment of a waste disposal device with a switch mechanism in a trapping state.
Figure 34:
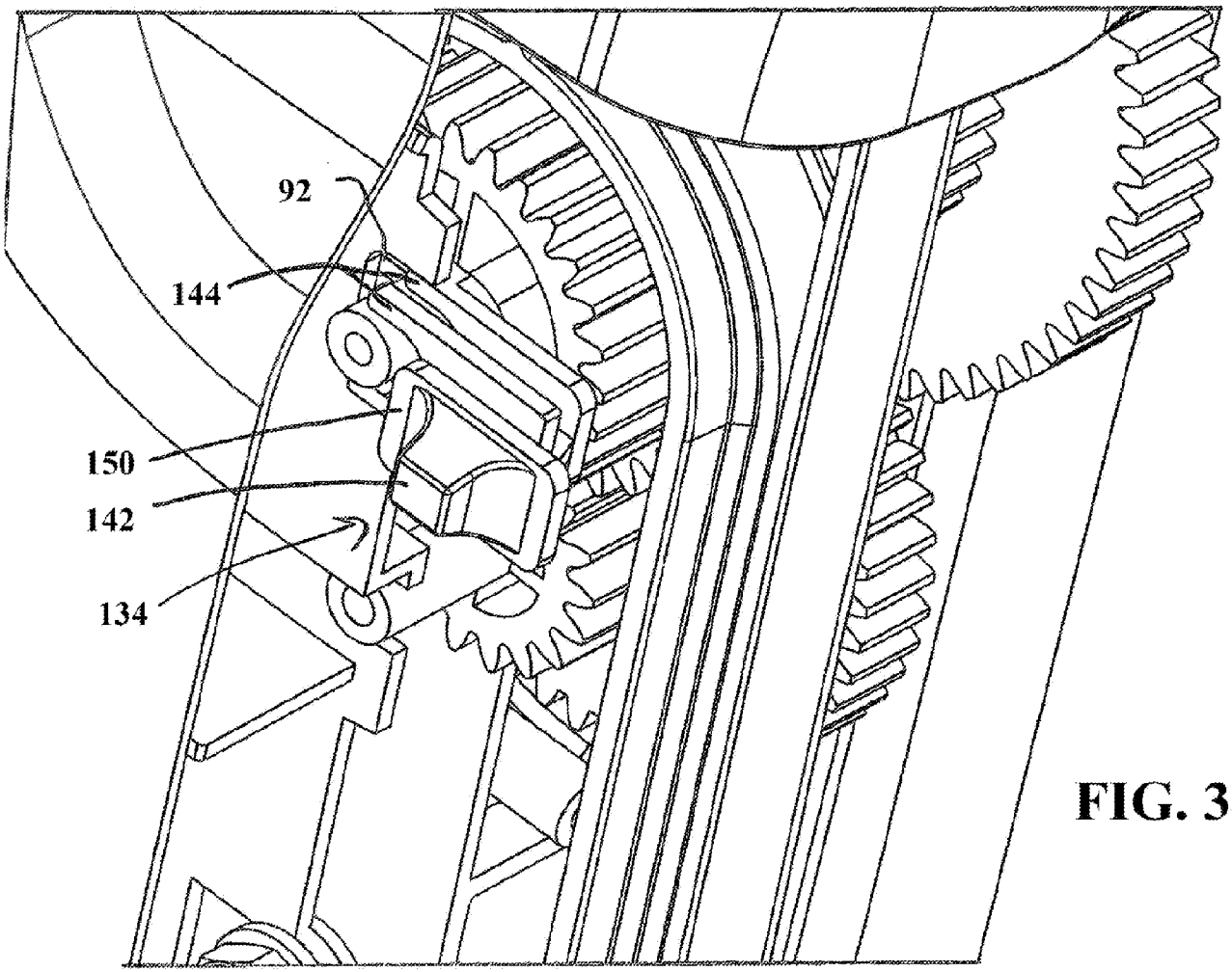
FIG. 34 is a view of the rotation mechanism of the waste disposal device shown in FIG. 33 with a switch mechanism in a trapping state with the wall of the pail partially removed.

Switch mechanism 132 includes a slide 136, a single trapping portion 138 and a connecting portion 140 therebetween (see FIG. 32). Switch mechanism 134 includes a slide 142, two spaced apart trapping portions 144 and a connecting portion 146 therebetween (see FIG. 37). Slides 136, 142 are positioned to be accessible through an opening 148 in the pail 12 (see FIGS. 28-30, 33 and 35) to enable the switch mechanisms 132, 134 to be manually actuated into or out of engagement with the shaft 86.

Switch mechanism 132 includes a slide 136, a single trapping portion 138 and a connecting portion 140 therebetween (see FIG. 32). Switch mechanism 134 includes a slide 142, two spaced apart trapping portions 144 and a connecting portion 146 therebetween (see FIG. 37). Slides 136, 142 are positioned to be accessible through an opening 148 in the pail 12 (see FIGS. 28-30, 33 and 35) to enable the switch mechanisms 134, 136 to be manually actuated into or out of engagement with the shaft 86.

Figure 29:
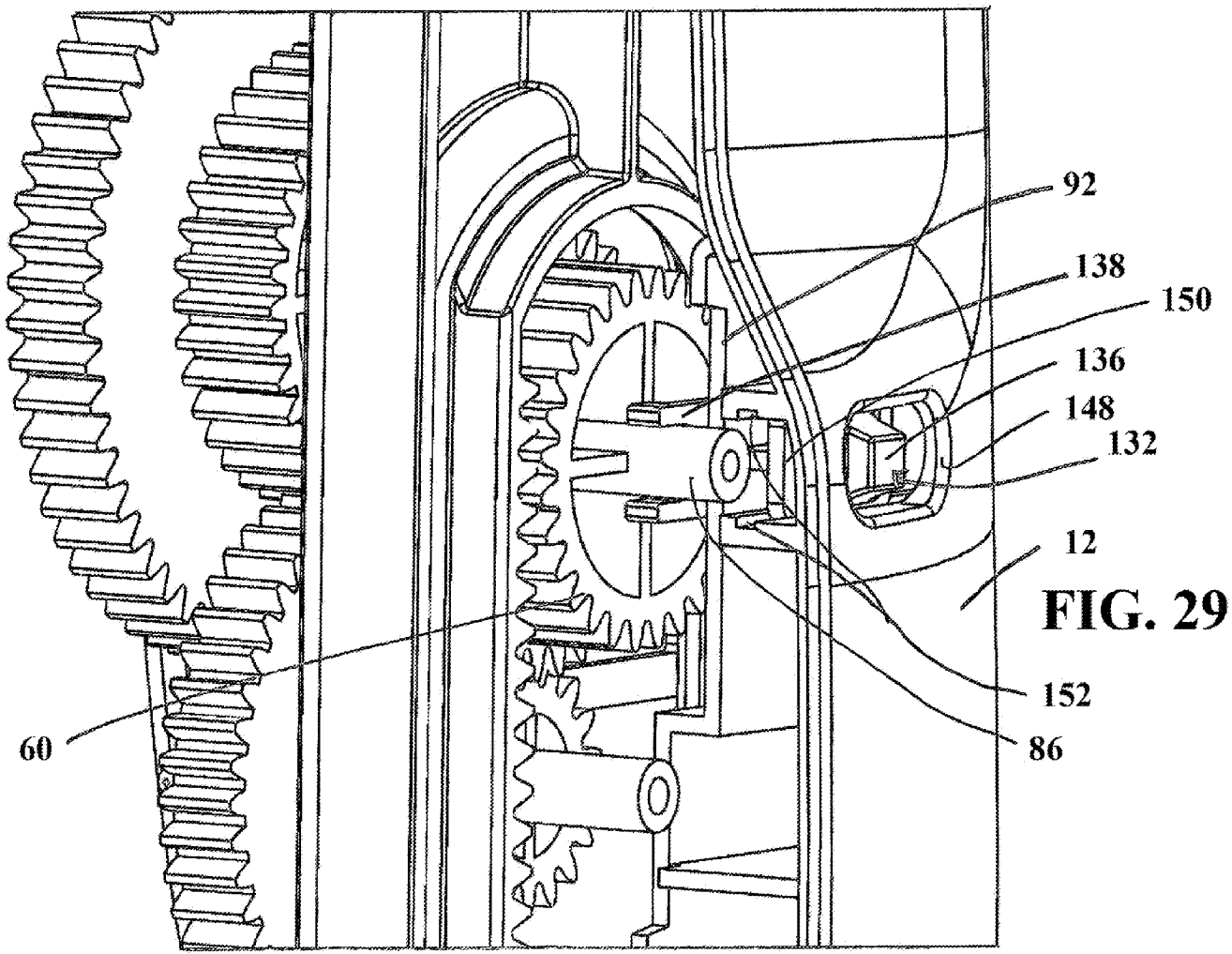
FIG. 29 is a view of the rotation mechanism of the waste disposal device shown in FIG. 28 with a switch mechanism in a trapping state.
Figure 35:
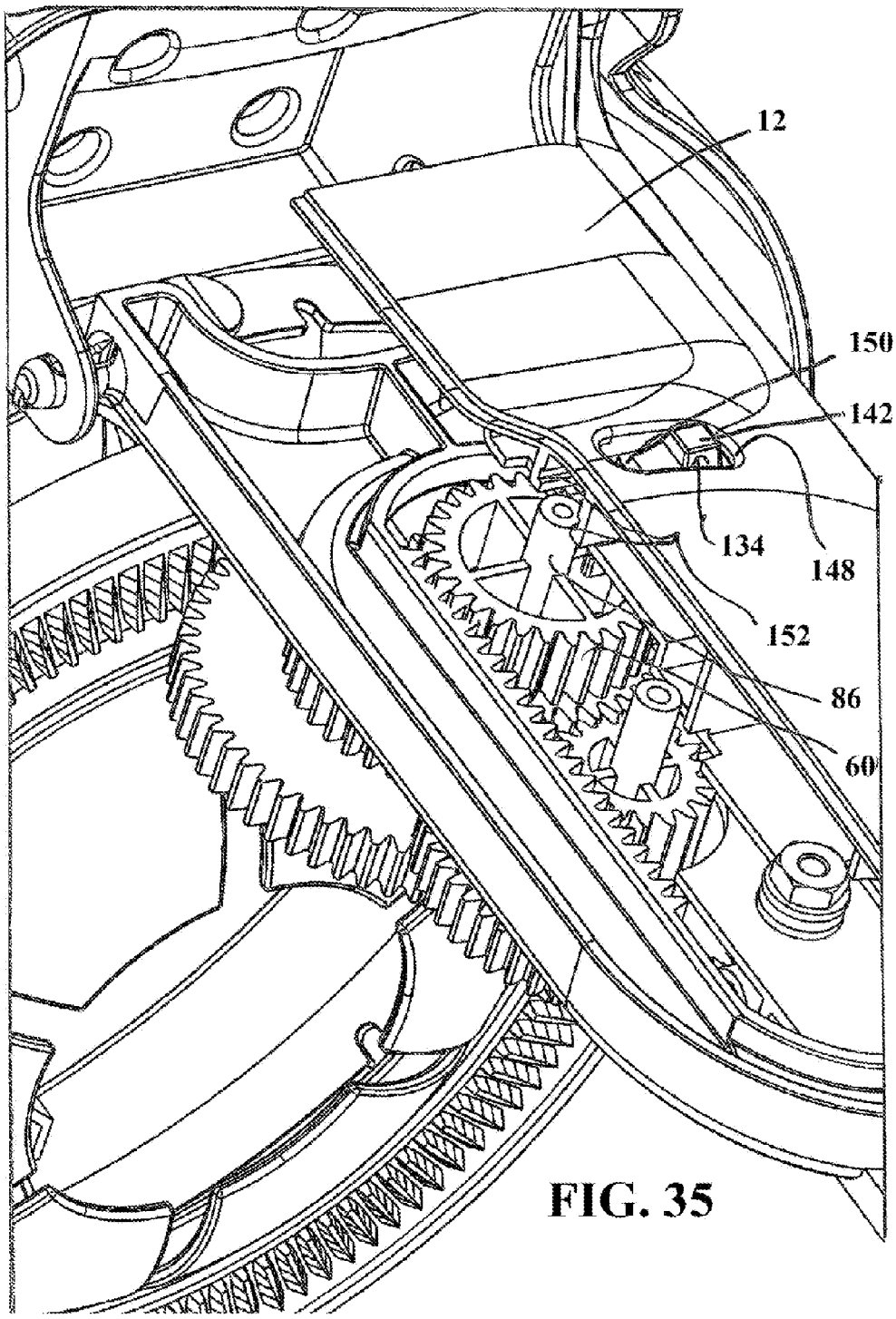
FIG. 35 is a view of the rotation mechanism of the waste disposal device shown in FIG. 23 with a switch mechanism in a non-trapping state with the wall of the pail partially removed.
Figure 36:
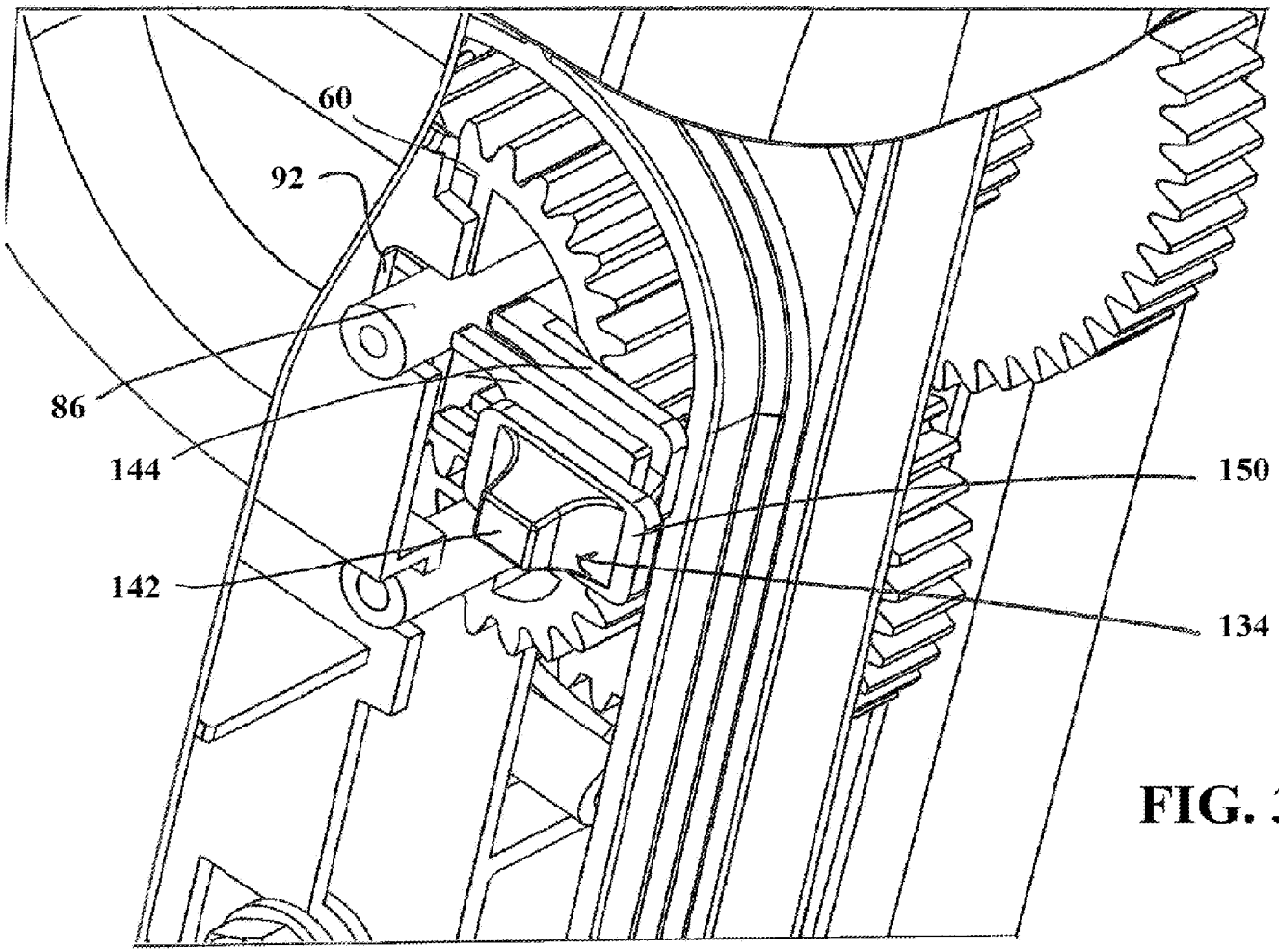
FIG. 36 is a view of the rotation mechanism of the waste disposal device shown in FIG. 33 with a switch mechanism in a non-trapping state with the wall of the pail partially removed.
Figure 37:
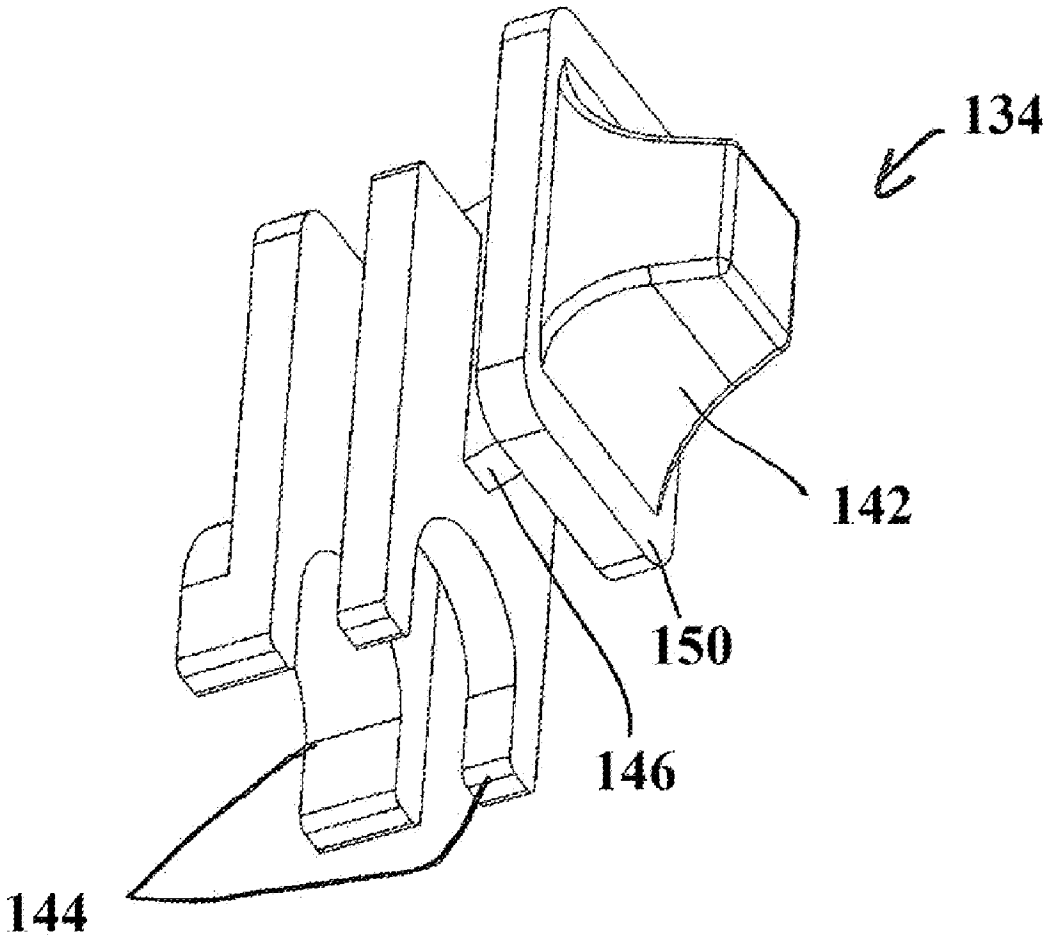
FIG. 37 is a perspective view of the switch mechanism of the waste disposal device shown in FIG. 33.

Movement of the switch mechanisms 132, 134 is guided by opposed grooves 152 formed in a support structure of the container 12 that accommodate, slidingly, lateral edges of a support portion 150 of the slide 136, 142 (see FIGS. 29 and 35).

Figure 30:
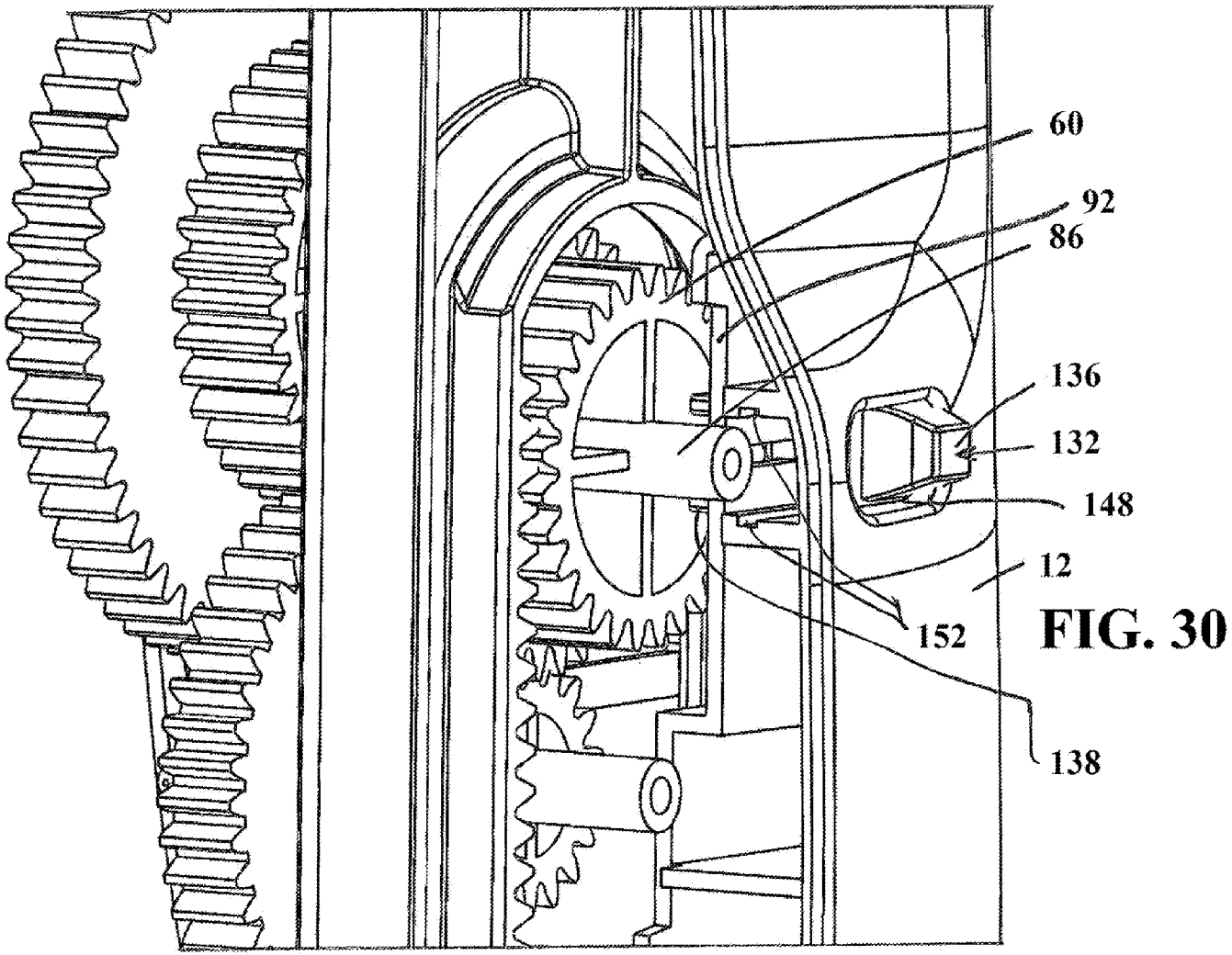
FIG. 30 is a view of the rotation mechanism of the waste disposal device shown in FIG. 28 with a switch mechanism in a non-trapping state.
Figure 31:
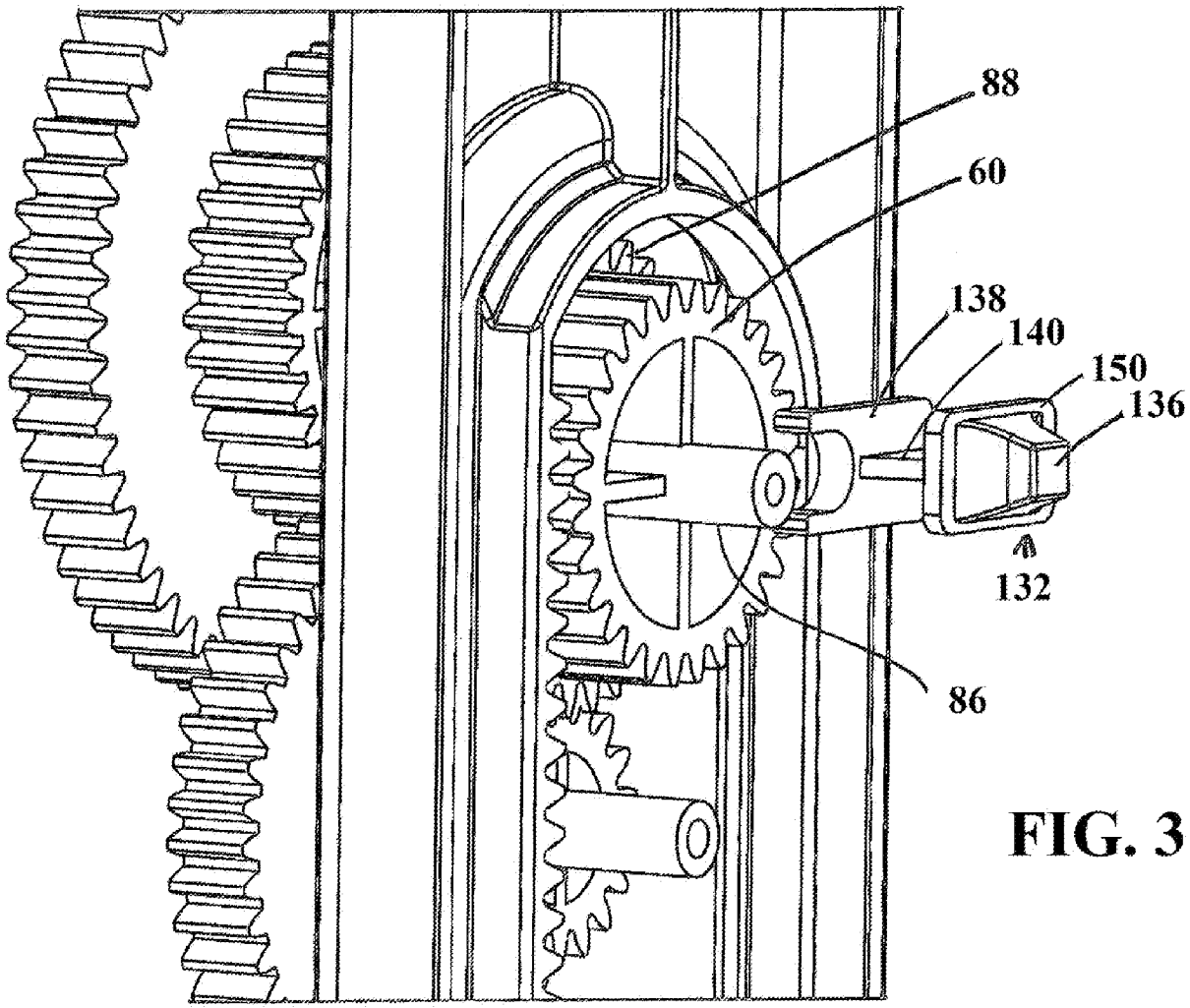
FIG. 31 is a view of the rotation mechanism of the waste disposal device shown in FIG. 28 with a switch mechanism in a non-trapping state with the wall of the pail removed.

Engagement of the trapping portion 138 takes place along the shaft 86 of the gear 60 and on the inside of the wall containing the oval slot 92 (see FIGS. 29 and 30). Engagement of the trapping portions 144 traps the shaft 86 on the same side but also straddles the wall containing the oval slot 92 and engages the shaft 86 on both sides (see FIGS. 33, 34 and 36), thus insuring more surface engagement and stability.

The slide lock mechanisms shown in FIGS. 28-37 function equally as well as switch mechanism 74, shown for example, in FIG. 6 which engages both sides of the pinion gear assembly. Furthermore, the single slide lock mechanism 132 can simplify the manufacturing process, insofar as the pinion gear assembly is being locked or trapped only on the side facing the outer wall of the pail 12, and this is far less complicated to design and manufacture.

In the trapping portions 138, 144, there is an extra amount of surface material that engages the shaft 86. This is used primarily to keep the uniform wall thickness to a minimum of the proposed injection molded plastic part(s). The extra protrusion on the trapping portions 138, 144 traps the shaft 86 on the inside of the wall defining the oval slot 92. For example, it is possible to add about $1/16^{th}$ of an inch of surface material, because this corresponds to the extra room between the pinion gear and the inner wall along the shaft 86. Taking up that extra space also insures a more stabile, positive engagement in trapping the single side of the shaft 86. Furthermore, it provides less "play" which could cause cocking or disengagement otherwise. For these reasons, the switch mechanism 134 with two trapping portions 144 is more advantageous than switch mechanism 132 with only a single trapping portion 138.

Alternative constructions of the switch mechanisms 132, 134 have been invented. In one alternative, the switch mechanisms 132, 134 are constructed such that the trapping portions 138, 144 engage shaft 86 on the outside of the wall with the oval slot 92. For example, it is possible that shaft 86 could be extended longer on one side and the switch and slides can have yet more surface engagement.

Yet another embodiment of a waste disposal device in accordance with the invention, which may be a modification or particular use of any of the waste disposal devices disclosed herein, provides an improvement in minimizing or eliminating the common vacuum sucking into the air of airborne odorous and potentially harmful bacteria and fungus. In this regard, reference is made to an Abstract, entitled "Analysis of Airborne Microorganisms from Biohazard Waste Containers" by Sabrina S. Jedlicka et al., which is incorporated by reference herein.

In any of these modified embodiments, with the pinion gear assembly 60, 88 locked to cause the untwisting condition to take place upon opening the lid 14, the previously created knot starts to unwind which always happens (with and without trapping the pinion gear assembly 60, 88). As such, the moment the user "cracks open" the lid 14, even an inch or less, a portion of the knot begins to unwind. Similarly, in the invention, as the lid is lifted, the knot in the bag begins to unwind. Once the lid is lifted a tad, the vacuum seal has been cracked open. The only vacuum draft that will be created, if at all, is between the lid 14 and the upper knotted area of the bag. So, when the lid is lifted up further and the knot unwinds, there is no longer vacuum pressure pulling up the airborne waste matter in the bag as occurs in a conventional step/lid pail.

To enhance this effect, the pinion gear assembly 60, 88 may be arranged to have a momentary delay before engagement, although having a knot that has to unwind already breaks the vacuum seal. By breaking the vacuum seal between the lid 14 and the container 12, before the complete unwinding of the knot in the bag, a significant improvement over every other step pedal pail on the marketplace is provided.

Another advantage is that a knot is always created in the bag when the lid 14 closes. By creating a knot in this open/close setting, the build-up of airborne bacteria and fungus that could migrate to the upper inside surface area of the lid is prevented (see the paper mentioned above which addresses some harmful to human bacteria and fungus). Bacteria can be very odorous and by keeping it safely contained in a knotted bag when the lid 14 is closed, humans are kept safe from offensive smell and potentially harmful contagions.

In some of the embodiments above, the invention involves trapping a shaft 86 of a gear 60 to prevent radial movement of the shaft and thus maintain the gear 60 in meshing engagement with other gears to cause the rotation mechanism 46 to rotate the twisting mechanism or assembly 16. Other mechanisms that are effective to prevent radial movement of the gear shaft 86, or the gear 60, yet allow rotation of the gear 60 are also encompassed within the scope and spirit of the invention.

Figure 45:
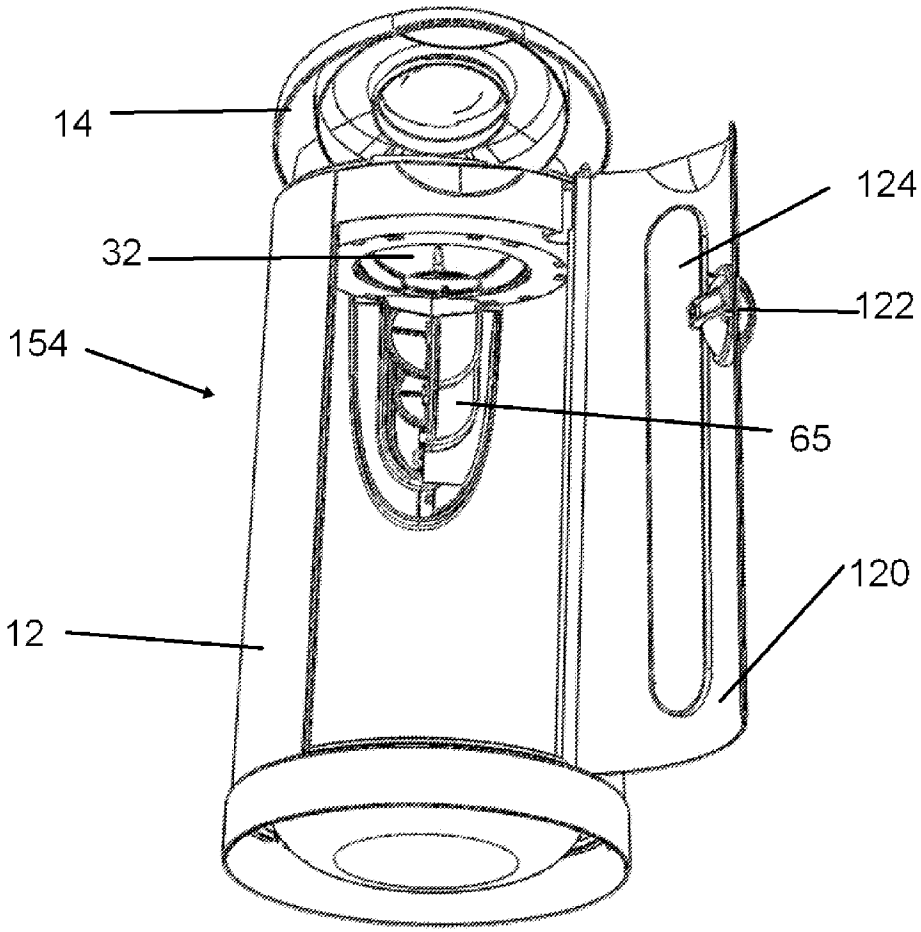
FIG. 45 is a view of another embodiment of a waste disposal device that does not include a foot pedal assembly.

A final waste disposal device 154 in accordance with the invention is shown in FIG. 45. Waste disposal device 154 differs from the waste disposal device 10, in any of the configurations disclosed above, in that it does not include a foot pedal assembly. Rather, waste disposal device 154 is operated solely based on manual lifting of the lid 14. The remaining structure of waste disposal device 154 may be the same as waste disposal devices 10, e.g., the switch mechanism in any of its constructions.

Disclosed above is a waste disposal device adapted to receive a waste-containing member and that includes a container defining a waste-receiving compartment having an opening, a lid connected to the container, a rotation mechanism arranged in the container to rotate the waste-containing member, when present, upon closure of the lid, and a switch mechanism including a knob accessible exterior of the container. The knob has a first position in which, when turned into the first position, at least one locking member is disengaged from a shaft of a gear and prevents motive force arising from opening of the lid from being converted into actuation of the rotation mechanism and thus precludes rotation of the waste-containing member. Each locking member may be situated on a respective side of a pinion gear assembly including the gear, while if only one locking member is provided, it may be situated on the outer side of the gear. The knob has a second position in which, when turned into the second position in a direction opposite to the turn into the first position over a bump on the container, each locking member is engaged with the shaft and allows motive force arising from opening of the lid to convert into actuation of the rotation mechanism and thus unwind of the waste-containing member.

An alternative switch mechanism includes a slide with a single or double engagement to the shaft. That is, the slide may have only a single trapping portion that engages with and traps the gear shaft, e.g., on an outer side of the gear shaft, or two trapping portions, one on each side of the gear shaft.

A variation of any of the embodiments disclosed herein entails inclusion of a mechanical battery or direct current arrangements that provides energy to a motor. The motor has an on and off position and in the on position, the gear shaft 86 is trapped and in the off position, the gear shaft 86 is not trapped and free to move radially.

An indicator may also be provided to indicate the statue of the switch mechanism. The indicator may be a visual indicator, such as a red light or illuminatable icon, whereby the light or icon is illuminated when the waste disposal device is in its state whereby opening and closing of the lid both cause rotation of the twisting mechanism. The light color is red because this state may be best used to dispose of medical waste and biohazardous material which is commonly associated with a red color disposal container. Another icon, or different color light, may be illuminated when the waste disposal device is in its state wherein opening of the lid does not cause untwisting or unwinding of the bag or tubing, While particular embodiments of the invention have been shown and described, it will be obvious to those skilled in the art that changes and modifications may be made without departing from the invention in its broader aspects, and, therefore, the aim in the appended claims is to cover all such changes and modifications as fall within the true spirit and scope of the invention. Further, any of the waste disposal device features disclosed in the inventor's other patent applications mentioned above may be incorporated into the waste disposal devices disclosed herein, to the extent there is no conflict, and such combinations are encompassed within the scope and spirit of the disclosed inventions herein, and considered as inventions by the inventor.

The invention claimed is:

1. A waste disposal device adapted to receive a waste-containing member, comprising:

a container defining a waste-receiving compartment having an opening;

a lid connected to said container, said lid having a first, closed position covering said opening of said container and a second, open position in which said opening is exposed;

a rotation mechanism arranged in said container to rotate the waste-containing member when present in said container, said rotation mechanism being arranged to rotate the waste-containing member upon closure of said lid; and a switch mechanism that is set to one of two different positions to regulate rotation of the waste-containing members based on opening movement of said lid such that when said switch mechanism is in one position, the opening movement of said lid causes said rotation mechanism to rotate the waste-containing member and when said switch mechanism is in the other position, the opening movement of said lid does not cause said rotation mechanism to rotate the waste-containing member.

2. The device of claim 1, wherein said switch mechanism includes a knob accessible from an exterior of said container and a lever mechanism controlled by said knob.

3. The device of claim 2, wherein said rotation mechanism includes at least one gear, said lever mechanism includes a lever mechanism shaft and at least one locking member fixed thereto, each of said at least one locking member including a slot designed to receive a gear shaft about which said at least one gear rotates and retain said gear shaft to thereby prevent radial movement of said gear shaft and thus said at least one gear.

4. The device of claim 3, wherein said rotation mechanism further comprises a rack gear attached to said lid, said at least one gear being motively interposed between said rack gear and a gear rim on the waste-containing member such that when said gear shaft of said at least one gear is retained by said at least one locking member, motive force is transferred from said rack gear to the gear rim and when said gear shaft of said at least on gear is not retained by said at least one locking member, motive force is not transferred from said rack gear to the gear rim.

5. The device of claim 3, wherein said at least one locking member consists of a single locking member arranged at an end of said lever mechanism shaft opposite an end of said lever mechanism shaft attached to said knob.

6. The device of claim 3, wherein said at least one locking member consists of two locking members arranged on opposite sides of said at least one gear.

7. The device of claim 1, wherein said switch mechanism comprises a slide lock with a single engagement on one side of a gear shaft about which said at least one gear rotates to thereby retain said gear shaft and prevent radial movement of said gear shaft and thus radial movement of said at least one gear.

8. The device of claim 1, wherein said switch mechanism comprises a slide lock with a double engagement on two parts of a gear shaft about which said at least one gear rotates to thereby retain said gear shaft and prevent radial movement of said gear shaft and thus radial movement of said at least one gear.

9. The device of claim 1, wherein said switch mechanism comprises a manually accessible and movable slide and at least one trapping portion that is moved upon movement of said slide in one direction to cause said at least one trapping portion to trap a gear shaft about which said at least one gear rotates and moved upon movement of said slide in an opposite direction to cause said at least one trapping portion to move away from said gear shaft and thereby allow radial movement of said gear shaft.

10. The device of claim 1, wherein said rotation mechanism comprises:

at least one rack gear coupled to said lid;

a gear assembly having a first gear in meshing engagement with said at least one rack gear, and a second, drive gear in meshing engagement with the waste-containing member and which is rotationally coupled to said first gear; and a U-shaped frame pivotally coupled to the lid at an upper end region thereof, said at least one rack gear being arranged on an inside surface of a respective leg of said U-shaped frame.

11. The device of claim 1, further comprising a foot pedal assembly which causes both opening of said lid when depressed and closure of said lid when a pressing force on said foot pedal assembly is removed.

12. The device of claim 11, wherein said switch mechanism and said rotation mechanism are arranged alongside a vertically extending side of said container, and said foot pedal assembly is arranged at a different location and at a bottom of said container.

13. The device of claim 1, wherein said rotation mechanism comprises a first member coupled to said lid, and a force transmission mechanism having a second member engaging with said first member coupled to said lid and a third member engaging with the waste-containing member and which is motively coupled to said second member.

14. The device of claim 13, wherein said first member comprises a rack gear, and said second and third members comprise gears rotationally coupled together.

15. The device of claim 1, further comprising a twisting member that retains the waste-containing member, and comprises a membrane, said membrane being substantially circular and including a plurality of slots extending to a common central aperture, whereby a size of said slots and said central aperture is variable depending on a type of waste for which the waste disposal device is being used.

16. The device of claim 1, wherein said container comprises a transparent window that extends along substantially the entire height of said container to enable viewing of an interior of said container and thus whether the waste-containing member in the interior of said container is full or not.

17. The device of claim 16, wherein said container further comprises an access door that opens to enable access to the interior of said container, said window being formed in said access door.

18. The device of claim 1, wherein said switch mechanism comprises a lever mechanism shaft and at least one locking member fixed to said lever mechanism shaft, and said rotation mechanism includes at least one gear, each of said at least one locking member including a slot designed to receive a gear shaft about which said at least one gear rotates and retain said gear shaft to thereby prevent radial movement of said gear shaft and thus said at least one gear.

19. The device of claim 18, wherein said rotation mechanism further comprises a rack gear attached to said lid.

20. The device of claim 19, wherein said at least one gear is motively interposed between said rack gear and a gear rim on the waste-containing member such that when said gear shaft of said at least one gear is retained by said at least one locking member, motive force is transferred from said rack gear to the gear rim and when said gear shaft of said at least one gear is not retained by said at least one locking member, motive force is not transferred from said rack gear to the gear rim.

21. The device of claim 18, wherein said at least one locking member consists of a single locking member arranged at an end of said lever mechanism shaft.

22. The device of claim 18, wherein said at least one locking member consists of two locking members arranged on opposite sides of said at least one gear.

23. The device of claim 1, wherein said switch mechanism comprises a knob extending beyond an outer surface of said container to enable manual access thereto.

24. The device of claim 1, wherein said switch mechanism is configured to be pivotable about an axis defined by a shaft to the two different positions.

* * * * *

UNITED STATES PATENT AND TRADEMARK OFFICE

CERTIFICATE OF CORRECTION

PATENT NO. : 8,266,871 B1
APPLICATION NO. : 13/173001
DATED : September 18, 2012
INVENTOR(S) : David M. Stravitz It is certified that error appears in the above-identified patent and that said Letters Patent is hereby corrected as shown below:

Col. 19, line 13, after "said at least", change "on" to --one--.

Signed and Sealed this
Twenty-third Day of October, 2012

David J. Kappos

David J. Kappos
*Director of the United States Patent and Trademark Office*